US012214984B2

(12) United States Patent
Akamatsu et al.

(10) Patent No.: US 12,214,984 B2
(45) Date of Patent: Feb. 4, 2025

(54) MEDIUM PROCESSING APPARATUS AND IMAGE FORMING SYSTEM INCORPORATING SAME

(71) Applicants: Eiji Akamatsu, Kanagawa (JP); Kei Sasaki, Kanagawa (JP); Kazuki Seto, Kanagawa (JP)

(72) Inventors: Eiji Akamatsu, Kanagawa (JP); Kei Sasaki, Kanagawa (JP); Kazuki Seto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 126 days.

(21) Appl. No.: 18/322,858

(22) Filed: May 24, 2023

(65) Prior Publication Data

US 2023/0399191 A1 Dec. 14, 2023

(30) Foreign Application Priority Data

Jun. 8, 2022 (JP) ..... 2022-093040
Apr. 5, 2023 (JP) ..... 2023-061670

(51) Int. Cl.
*B65H 37/04* (2006.01)

(52) U.S. Cl.
CPC ..... *B65H 37/04* (2013.01); *B65H 2406/20* (2013.01); *B65H 2406/42* (2013.01); *B65H 2551/10* (2013.01)

(58) Field of Classification Search
CPC ..... B31F 1/07; B31F 5/02; B31F 2201/0784; B31F 2201/0707; G03G 15/6544; G03G 2215/00852; B65H 37/04; B65H 2301/51616; B65H 2301/43828; B65H 2801/27; B42C 1/12
USPC ..... 270/58.07, 58.08
See application file for complete search history.

(56) References Cited

U.S. PATENT DOCUMENTS

| | | | | |
|---|---|---|---|---|
| 11,868,073 | B2 * | 1/2024 | Sasaki | G03G 15/6544 |
| 11,987,468 | B2 * | 5/2024 | Suzuki | B65H 35/04 |
| 12,005,675 | B2 * | 6/2024 | Matsumoto | B31F 5/02 |
| 12,043,508 | B2 * | 7/2024 | Oikawa | B31F 1/36 |
| 2022/0394145 | A1 | 12/2022 | Seto et al. | |

FOREIGN PATENT DOCUMENTS

| | | |
|---|---|---|
| JP | 2014-201432 | 10/2014 |
| JP | 2015-166281 | 9/2015 |

OTHER PUBLICATIONS

U.S. Appl. No. 18/153,023, filed Jan. 11, 2023, Junya Suzuki, et al.
U.S. Appl. No. 18/157,142, filed Jan. 20, 2023, Kensuke Fukuchi, et al.

(Continued)

*Primary Examiner* — Leslie A Nicholson, III
(74) *Attorney, Agent, or Firm* — IPUSA, PLLC

(57) ABSTRACT

A medium processing apparatus includes a liquid applier, a post-processing device, and circuitry. The liquid applier applies liquid to a part of a medium, the medium being at least one medium. The post-processing device binds a bundle of media including the medium to which the liquid is applied by the liquid applier. The circuitry controls operations of the liquid applier and the post-processing device. The circuitry causes the liquid applier to apply different amounts of liquid to a plurality of sample areas in the medium.

9 Claims, 29 Drawing Sheets

(56) References Cited

OTHER PUBLICATIONS

U.S. Appl. No. 18/159,238, filed Jan. 25, 2023, Jun Saito, et al.
U.S. Appl. No. 18/174,061, filed Feb. 24, 2023, Kohta Abe, et al.
U.S. Appl. No. 18/176,728, filed Mar. 1, 2023, Hitoshi Ibuka, et al.

* cited by examiner

MEDIUM PROCESSING APPARATUS AND IMAGE FORMING SYSTEM INCORPORATING SAME

CROSS-REFERENCE TO RELATED APPLICATIONS

This patent application is based on and claims priority pursuant to 35 U.S.C. § 119(a) to Japanese Patent Application Nos. 2022-093040, filed on Jun. 8, 2022, and 2023-061670, filed on Apr. 5, 2023, in the Japan Patent Office, the entire disclosure of each of which is hereby incorporated by reference herein.

BACKGROUND

Technical Field

Embodiments of the present disclosure relate to a medium processing apparatus and an image forming system incorporating the medium processing apparatus.

Related Art

Medium processing apparatuses are known in the related art that bind, into a bundle, sheet-shaped media on which images are formed by image forming apparatuses. Since sheets of paper are widely known as an example of sheet-shaped media, a "sheet bundle" that is a stack of sheets of paper is used as an example of a bundle of sheet-shaped media in the following description. Some medium processing apparatuses include a crimper that can perform so-called "crimp binding" without metal binding needles from a viewpoint of resource saving and reduction in environmental load. Specifically, the crimper sandwiches a sheet bundle with serrate binding teeth to press and deform the sheet bundle.

An increased number of sheets of the sheet bundle hamper the binding teeth in biting into the sheet bundle and may cause some sheets to peel off from the bound sheets. Thus, the crimp binding has some difficulties in keeping the sheet bundle bound as appropriate. To cause the binding teeth to easily bite into the sheet bundle, some medium processing apparatuses that execute the crimp binding include a liquid applier that applies liquid by an amount corresponding to the number of sheets to be bound to a "binding position" where the binding teeth contact the sheet.

The amount of liquid to be applied by the liquid applier changes due to product variations or aging of the medium processing apparatus. As a result, the liquid may be excessively or insufficiently applied, resulting in insufficient binding strength.

SUMMARY

According to an embodiment of the present disclosure, a novel medium processing apparatus includes a liquid applier, a post-processing device, and circuitry. The liquid applier applies liquid to a part of a medium, the medium being at least one medium. The post-processing device binds a bundle of media including the medium to which the liquid is applied by the liquid applier. The circuitry controls operations of the liquid applier and the post-processing device. The circuitry causes the liquid applier to apply different amounts of liquid to a plurality of sample areas in the medium.

According to an embodiment of the present disclosure, a novel image forming system includes an image forming apparatus and the medium processing apparatus described above. The image forming apparatus forms an image on the medium. The circuitry of the medium processing apparatus causes the liquid applier to apply the different amounts of liquid to the plurality of sample areas in the medium on which the image is formed by the image forming apparatus.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
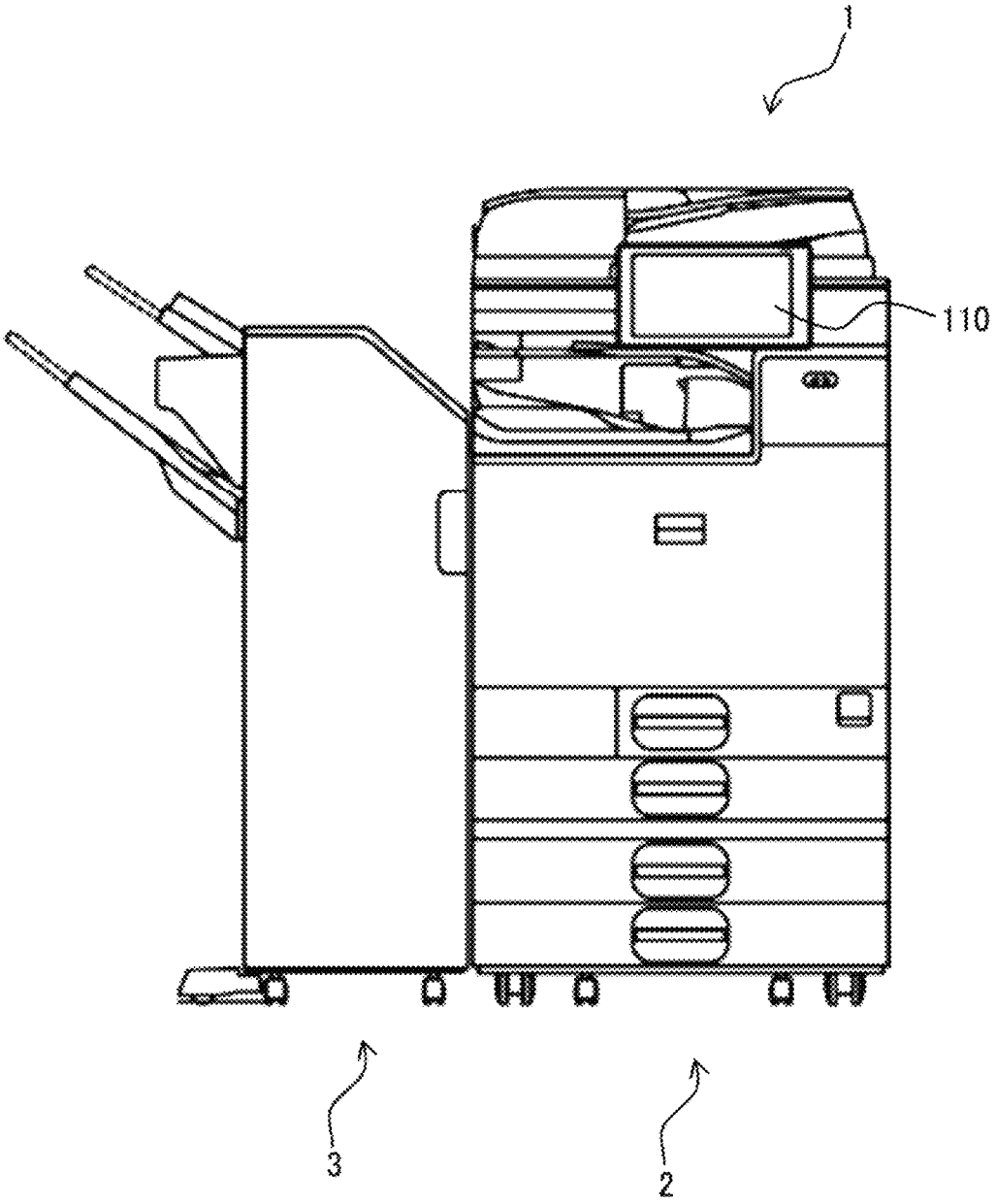
FIG. 1 is a diagram illustrating the overall configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

For the sake of simplicity, like reference numerals are given to identical or corresponding constituent elements such as parts and materials having the same functions, and redundant descriptions thereof are omitted unless otherwise required.

As used herein, the term "connected/coupled" includes both direct connections and connections in which there are one or more intermediate connecting elements.

With reference to the drawings, a description is now given of an image forming system 1 according to an embodiment of the present disclosure.

FIG. 1 is a diagram illustrating the overall configuration of the image forming system 1.

The image forming system 1 has a function of forming an image on a sheet P as a sheet-shaped medium and performing post-processing on the sheet P on which the image is formed. As illustrated in FIG. 1, the image forming system 1 includes an image forming apparatus 2 and a post-processing apparatus 3 serving as a medium processing apparatus according to the embodiments of the present disclosure.

The image forming apparatus 2 forms an image on the sheet P and outputs the sheet P bearing the image to the post-processing apparatus 3. The image forming apparatus 2 includes a tray that accommodates the sheet P, a conveyor that conveys the sheet P accommodated in the tray, and an image forming device that forms an image on the sheet P conveyed by the conveyor. The image forming device may be an inkjet image forming device that forms an image with ink or an electrophotographic image forming device that forms an image with toner. Since the image forming apparatus 2 has a typical configuration, a detailed description of the configuration and functions of the image forming apparatus 2 will be omitted unless otherwise required.

Now, a description is given of the post-processing apparatus 3 according to a first embodiment of the present disclosure.

Figure 2:
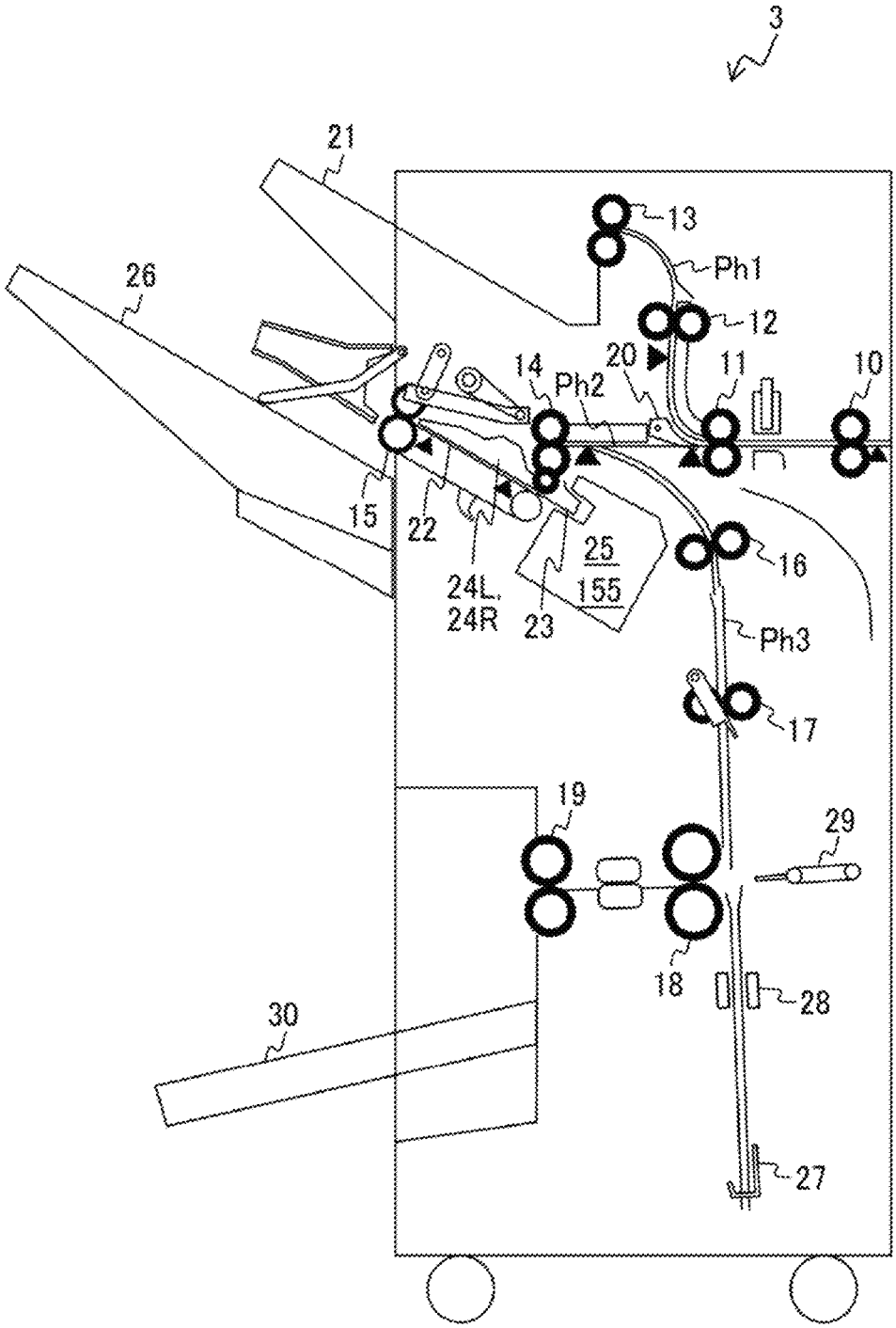
FIG. 2 is a diagram illustrating an internal configuration of a post-processing apparatus according to a first embodiment of the present disclosure.

FIG. 2 is a diagram illustrating an internal configuration of the post-processing apparatus 3 according to the first embodiment of the present disclosure.

The post-processing apparatus 3 performs post-processing on the sheet P on which an image is formed by the image forming apparatus 2. An example of the post-processing according to the present embodiment is binding or a binding process as a "crimp binding process" to bind, without staples, a plurality of sheets P on each of which an image is formed as a bundle of sheets P, which may be referred to as a sheet bundle. Another example of the post-processing according to the present embodiment is binding or a binding process as a "stapling process" to bind, with staples, a plurality of sheets P on each of which an image is formed as a bundle of sheets P (i.e., sheet bundle). In the following description, the bundle of sheets P as a bundle of recording media may be referred to as a "sheet bundle Pb."

More specifically, the "crimp binding process" according to the present embodiment is a process called "crimp binding" to apply pressure to the binding position corresponding to a part of the sheet bundle Pb to deform (pressure-deform) the binding position and bind the sheet bundle Pb. The binding that can be executed by the post-processing apparatus 3 includes edge binding and saddle binding. The edge binding is a process to bind an end (including an edge) of the sheet bundle Pb. The saddle binding is a process to bind the center of the sheet bundle Pb.

The post-processing apparatus 3 includes conveyance roller pairs 10 to 19 serving as conveyors and a switching claw 20. The conveyance roller pairs 10 to 19 convey, inside the post-processing apparatus 3, the sheet P supplied from the image forming apparatus 2. More specifically, the conveyance roller pairs 10 to 13 convey the sheet P along a first conveyance passage Ph1. The conveyance roller pairs 14 and 15 convey the sheet P along a second conveyance passage Ph2. The conveyance roller pairs 16 to 19 convey the sheet P along a third conveyance passage Ph3.

The first conveyance passage Ph1 is a passage extending to an output tray 21 from a supply port through which the sheet P is supplied from the image forming apparatus 2. The second conveyance passage Ph2 is a passage branching from the first conveyance passage Ph1 between the conveyance roller pairs 11 and 14 in a conveyance direction and extending to an output tray 26 via an internal tray 22. The third conveyance passage Ph3 is a passage branching from the first conveyance passage Ph1 between the conveyance roller pairs 11 and 14 in the conveyance direction and extending to an output tray 30.

The switching claw 20 is disposed at a branching position of the first conveyance passage Ph1 and the second conveyance passage Ph2.

The switching claw 20 can be switched between a first position and a second position. The switching claw 20 in the first position guides the sheet P to be output to the output tray 21 through the first conveyance passage Ph1. The switching claw 20 in the second position guides the sheet P conveyed through the first conveyance passage Ph1 to the second conveyance passage Ph2. When a trailing end of the sheet P entering the second conveyance passage Ph2 passes through the conveyance roller pair 11, the conveyance roller pair 14 is rotated in the reverse direction to guide the sheet P to the third conveyance passage Ph3. The post-processing apparatus 3 further includes a plurality of sensors that detects the positions of the sheet P in the first conveyance passage Ph1, the second conveyance passage Ph2, and the third conveyance passage Ph3. Each of the plurality of sensors is indicated by a black triangle mark in FIG. 2.

The post-processing apparatus 3 includes the output tray 21. The sheet P that is output through the first conveyance passage Ph1 is placed on the output tray 21. Among the sheets P supplied from the image forming apparatus 2, the sheets P that are not bound are output to the output tray 21.

The post-processing apparatus 3 further includes the internal tray 22 serving as a receptacle, an end fence 23, side fences 24L and 24R, an edge binder 25, a stapling unit 155, and the output tray 26. The internal tray 22, the end fence 23, the side fences 24L and 24R, the edge binder 25, and the stapling unit 155 perform the edge binding on the sheet bundle Pb constructed of the plurality of sheets P conveyed through the second conveyance passage Ph2. Among the sheets P supplied from the image forming apparatus 2, the sheet bundle Pb subjected to the edge binding is output to the output tray 26.

The "edge binding" includes "parallel binding," "oblique binding," and "vertical binding." The "parallel binding" is a process to bind the sheet bundle Pb along one side of the sheet bundle Pb parallel to the main scanning direction. The "oblique binding" is a process to bind a corner of the sheet bundle Pb. The "vertical binding" is a process to bind the sheet bundle Pb along one side of the sheet bundle Pb parallel to the conveyance direction.

In the following description, a direction in which the sheet P is conveyed from the conveyance roller pair 15 toward the end fence 23 is defined as a "conveyance direction" of the sheet P. In other words, the "conveyance direction" herein corresponds to a direction in which the sheet P that has been output from the image forming apparatus 2 is moved toward the output tray 26 by, for example, the conveyance roller pair 10 and then is moved toward the end fence 23 by the conveyance roller pair 15. A direction that is orthogonal to the conveyance direction and a thickness direction of the sheet P is defined as a "main scanning direction" or a "width direction of the sheet P."

The sheets P that are sequentially conveyed through the second conveyance passage Ph2 are temporarily placed on the internal tray 22 serving as a receptacle. The end fence 23 aligns the position, in the conveyance direction, of the sheet P or the sheet bundle Pb placed on the internal tray 22. The side fences 24L and 24R align the position, in the main scanning direction, of the sheet P or the sheet bundle Pb placed on the internal tray 22. The edge binder 25 and the stapling unit 155 bind an end of the sheet bundle Pb aligned by the end fence 23 and the side fences 24L and 24R. Then, the conveyance roller pair 15 outputs the sheet bundle Pb subjected to the edge binding to the output tray 26.

The post-processing apparatus 3 further includes an end fence 27, a saddle binder 28, a sheet folding blade 29, and the output tray 30. The end fence 27, the saddle binder 28, and the sheet folding blade 29 perform the saddle binding on the sheet bundle Pb constructed of the sheets P that are conveyed through the third conveyance passage Ph3. Among the sheets P supplied from the image forming apparatus 2, the sheet bundle Pb subjected to the saddle binding is output to the output tray 30.

The end fence 27 aligns the positions of the sheets P that are sequentially conveyed through the third conveyance passage Ph3, in a direction in which the sheets P are conveyed. The end fence 27 is movable between a binding position where the end fence 27 causes the center of the sheet bundle Pb to face the saddle binder 28 and a folding position where the end fence 27 causes the center of the sheet bundle Pb to face the sheet folding blade 29. The saddle binder 28 binds the center of the sheet bundle Pb aligned by the end fence 27 at the binding position. The sheet folding blade 29 folds, in half, the sheet bundle Pb placed on the end fence 27 at the folding position and causes the conveyance roller pair 18 to sandwich the sheet bundle Pb. The conveyance roller pairs 18 and 19 output the sheet bundle Pb subjected to the saddle binding to the output tray 30.

Now, a detailed description is given of the edge binder 25.

Figure 3:
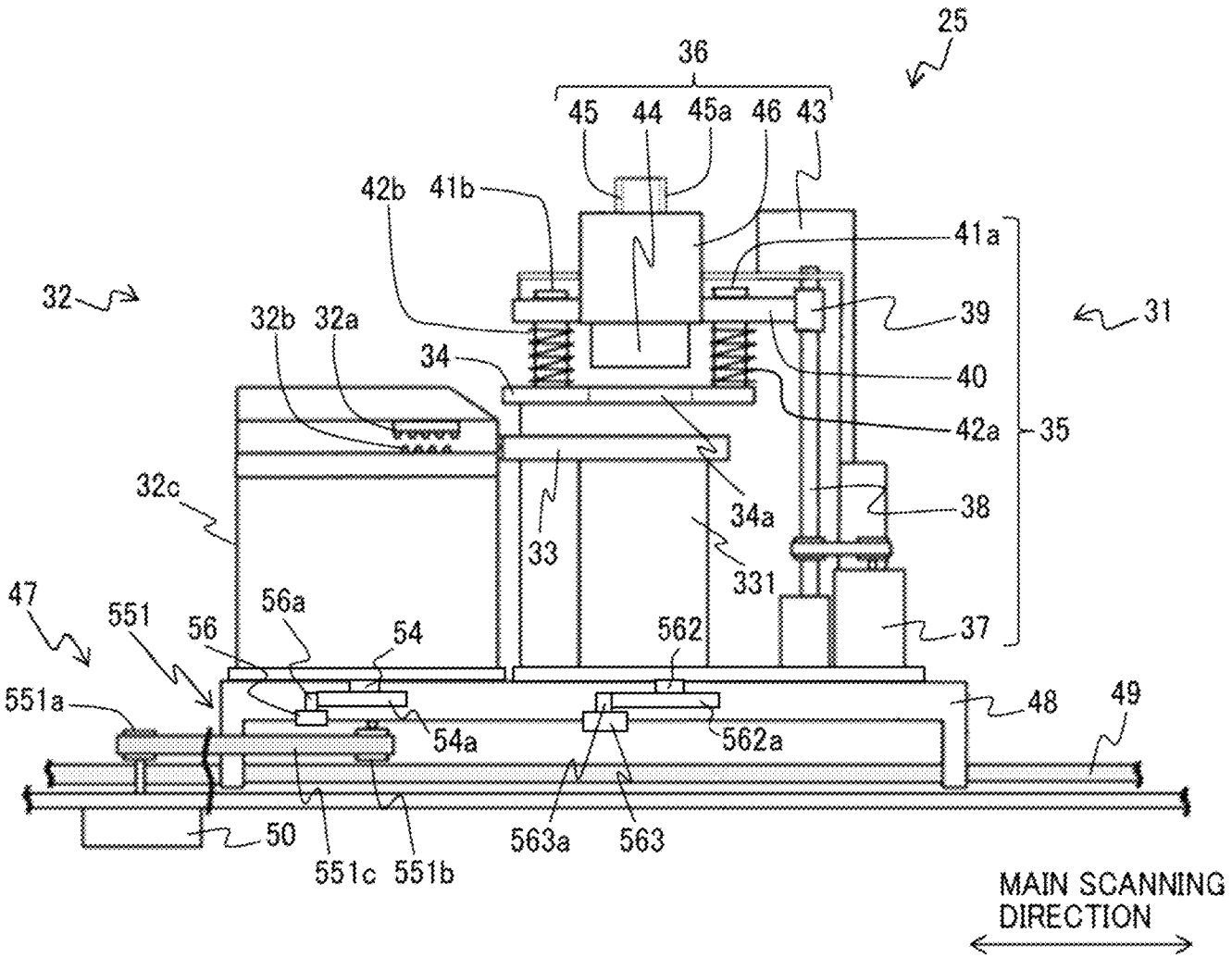
FIG. 3 is a schematic view of an upstream side of an edge binder of the post-processing apparatus of FIG. 2 in a conveyance direction.

FIG. 3 is a schematic view of an upstream side of the edge binder 25 in the conveyance direction. The edge binder 25 performs liquid application and crimp binding.

Figure 4:
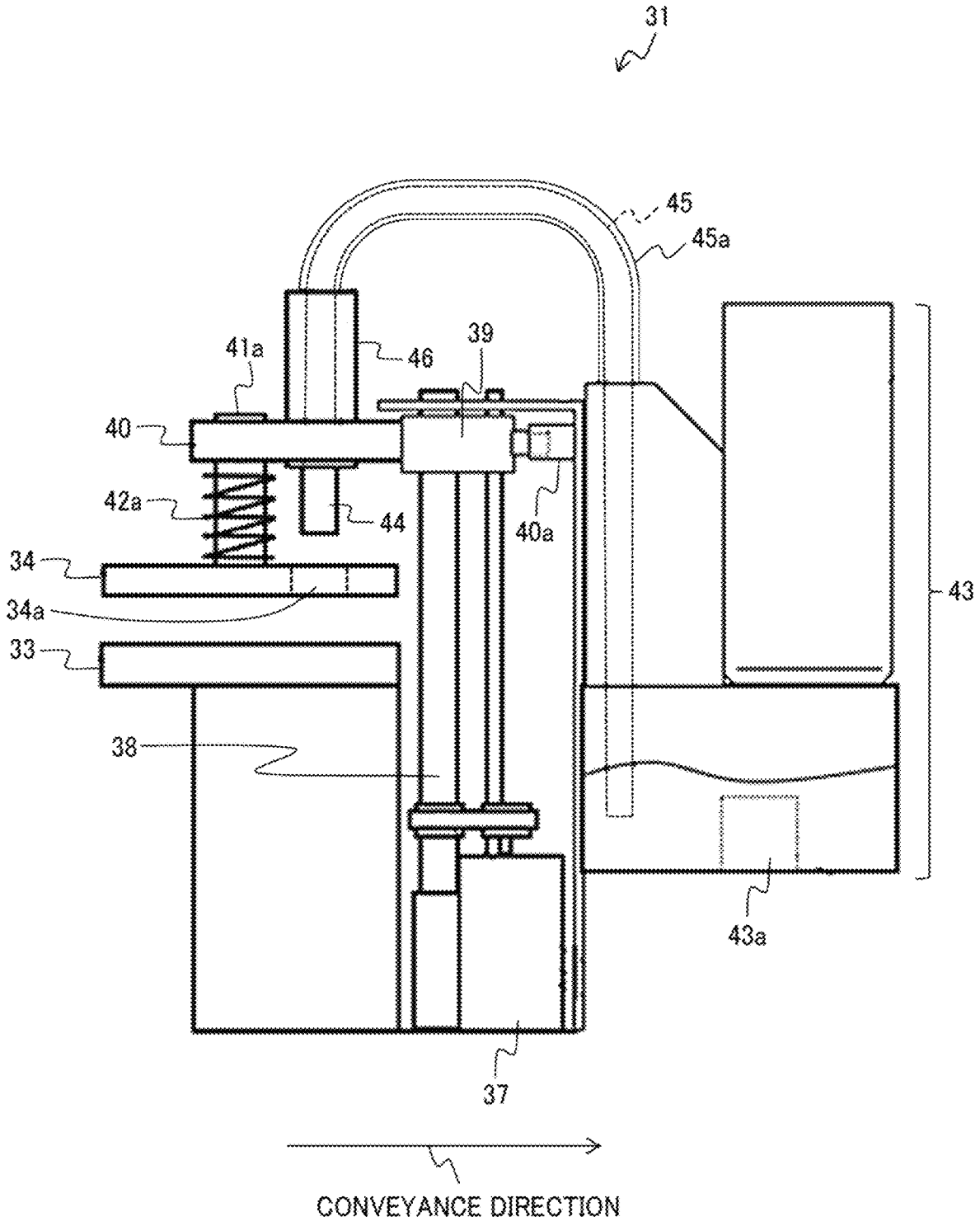
FIG. 4 is a schematic view of a liquid applier of the edge binder of FIG. 3 in a main scanning direction.

FIG. 4 is a schematic view of a liquid applier 31 of the edge binder 25 in the main scanning direction.

As illustrated in FIGS. 3 and 4, the edge binder 25 includes the liquid applier 31 and a crimper 32. The liquid applier 31 executes a processing operation related to the liquid application. The crimper 32 serves as a post-processing device and executes the crimp binding. The liquid applier 31 and the crimper 32 are disposed downstream from the internal tray 22 in the conveyance direction and adjacent to each other in the main scanning direction.

The liquid applier 31 applies liquid that is stored in a liquid storage tank 43 to the sheet P or the sheet bundle Pb placed on the internal tray 22. In the following description, the application of liquid to the sheet P or the sheet bundle Pb may be referred to as "liquid application" whereas a process to apply liquid may be referred to as a "liquid application process."

More specifically, the liquid that is stored in the liquid storage tank 43 to be applied includes, as a main component, the liquid state of a compound of hydrogen and oxygen represented by the chemical formula $H_2O$. The liquid state of the compound of hydrogen and oxygen is at any temperature. For example, the liquid state of the compound of hydrogen and oxygen may be so-called warm water or hot water. The liquid state of the compound of hydrogen and oxygen is not limited to pure water. The liquid state of the compound of hydrogen and oxygen may be purified water or may contain ionized salts. The metal ion content ranges from so-called soft water to ultrahard water. In other words, the liquid state of the compound of hydrogen and oxygen is at any hardness.

The liquid that is stored in the liquid storage tank 43 may include an additive in addition to the main component. The liquid that is stored in the liquid storage tank 43 may include residual chlorine used as tap water. Preferably, for example, the liquid that is stored in the liquid storage tank 43 may include, as an additive, a colorant, a penetrant, a pH adjuster, a preservative such as phenoxyethanol, a drying inhibitor such as glycerin, or a combination thereof. Since water is used as a component of ink used for inkjet printers or ink used for water-based pens, such water or ink may be used for the "liquid application."

The water is not limited to the specific examples described above. The water may be water in a broad sense such as hypochlorous acid water or an ethanol aqueous solution diluted for disinfection. However, tap water may be used simply to enhance the binding strength after the binding process because tap water is easy to obtain and store. A liquid including water as a main component as exemplified above enhances the binding strength of the sheet bundle Pb, as compared with a liquid of which the main component is not water.

Now, a description is given of the configurations of the liquid applier 31 and the crimper 32.

The liquid applier 31 and the crimper 32 can be moved together in the main scanning direction by a driving force transmitted from the edge-binder movement motor 50. A liquid application position to which the liquid is applied on the sheet P or the sheet bundle Pb by the liquid applier 31 corresponds to a crimp binding position to be crimped and bound by the crimper 32. For this reason, in the following description, the liquid application position and the crimp binding position are denoted by the same reference numeral.

As illustrated in FIGS. 3 and 4, the liquid applier 31 can be moved in the main scanning direction together with the crimper 32 by the driving force transmitted from the edge-binder movement motor 50.

The liquid applier 31 includes a lower pressure plate 33 serving as a receptacle for the sheet P or the sheet bundle Pb, an upper pressure plate 34, a liquid-applier movement assembly 35, and a liquid application assembly 36. The components of the liquid applier 31 such as the lower pressure plate 33, the upper pressure plate 34, the liquid-applier movement assembly 35, and the liquid application assembly 36 are held by a liquid application frame 31*a* and a base 48.

The lower pressure plate 33 and the upper pressure plate 34 are disposed downstream from the internal tray 22 in the conveyance direction. The sheets P or the sheet bundle Pb that is placed on the internal tray 22 is also placed on the lower pressure plate 33. The lower pressure plate 33 is disposed on a lower-pressure-plate holder 331. The upper pressure plate 34 is movable in the thickness direction of the sheet P or the sheet bundle Pb at a position where the upper pressure plate 34 faces the sheet P or the sheet bundle Pb placed on the internal tray 22. In other words, in a space where the lower pressure plate 33 and the upper pressure plate 34 face each other, the lower pressure plate 33 and the upper pressure plate 34 are disposed to face each other in the thickness direction of the sheet P or the sheet bundle Pb so as to sandwich the sheet P or the sheet bundle Pb placed on the internal tray 22. In the following description, the thickness direction of the sheet P or the sheet bundle Pb may be referred to simply as "thickness direction." The upper pressure plate 34 has a through hole 34*a* penetrating in the thickness direction at a position where the through hole 34*a* faces an end of a liquid application member 44 held via a joint 46 attached to a base plate 40.

The liquid-applier movement assembly 35 moves the upper pressure plate 34, the base plate 40, and the liquid application member 44 in the thickness direction of the sheet P or the sheet bundle Pb. The liquid-applier movement assembly 35 according to the present embodiment moves the upper pressure plate 34, the base plate 40, and the liquid application member 44 in conjunction with each other by a single liquid-applier movement motor 37. The liquid-applier movement assembly 35 includes, for example, the liquid-applier movement motor 37, a trapezoidal screw 38, a nut 39, the base plate 40, columns 41*a* and 41*b*, and coil springs 42*a* and 42*b*.

The liquid-applier movement motor 37 generates a driving force to move the upper pressure plate 34, the base plate 40, and the liquid application member 44. The trapezoidal screw 38 extends in the thickness direction of the sheet P or the sheet bundle Pb and is attached to the liquid application frame 31*a* so as to be rotatable in the forward and reverse directions. The trapezoidal screw 38 is coupled to an output shaft of the liquid-applier movement motor 37 via, for example, a pulley and a belt. The nut 39 is screwed to the trapezoidal screw 38. The trapezoidal screw 38 is rotated in the forward and reverse directions by the driving force transmitted from the liquid-applier movement motor 37. The rotation of the trapezoidal screw 38 causes the nut 39 to reciprocate on the trapezoidal screw 38.

The base plate 40 is positioned apart from the upper pressure plate 34.

The base plate 40 holds the liquid application member 44 with the end of the liquid application member 44 projecting from the base plate 40 toward the upper pressure plate 34. The base plate 40 is coupled to the trapezoidal screw 38 via the nut 39 so as to reciprocate along the trapezoidal screw 38 when the trapezoidal screw 38 rotates in the forward and reverse directions. The position of the base plate 40 in the thickness direction of the sheet P or the sheet bundle Pb is detected by a movement sensor 40*a* illustrated in FIG. 11.

The columns 41*a* and 41*b* project from the base plate 40 toward the upper pressure plate 34 around the end of the liquid application member 44. The columns 41*a* and 41*b* are movable relative to the base plate 40 in the thickness direction. The columns 41*a* and 41*b* hold the upper pressure plate 34 with the respective ends closer to the lower pressure plate 33 than the other ends of the columns 41*a* and 41*b*. The other ends of the columns 41*a* and 41 are provided with stoppers that prevent the columns 41*a* and 41*b* from being removed from the base plate 40. The coil springs 42*a* and 42*b* are fitted around the columns 41*a* and 41*b*, respectively, between the base plate 40 and the upper pressure plate 34. The coil springs 42*a* and 42*b* bias the upper pressure plate 34 and the columns 41*a* and 41*b* toward the lower pressure plate 33 with respect to the base plate 40.

The liquid application assembly 36 applies liquid to the sheet P or the sheet bundle Pb placed on the internal tray 22. More specifically, the liquid application assembly 36 brings the end of the liquid application member 44 into contact with the sheet P or the sheet bundle Pb to apply the liquid to at least one sheet P of the sheet bundle Pb. The liquid application assembly 36 includes the liquid storage tank 43, the liquid application member 44, a liquid supplier 45, and the joint 46.

The liquid storage tank 43 stores the liquid to be supplied to the sheet P or the sheet bundle Pb. The amount of liquid that is stored in the liquid storage tank 43 is detected by a liquid amount sensor 43*a*. The liquid application member 44 applies the liquid stored in the liquid storage tank 43 to the sheet P or the sheet bundle Pb. The liquid application member 44 is attached to the base plate 40 with the end of the liquid application member 44 oriented toward the upper pressure plate 34.

The liquid application member 44 is made of a porous material having a relatively high liquid absorption or a fiber material that can absorb liquid by capillary action. The liquid application member 44 is not limited to a particular kind provided that the liquid application member 44 is made of a material having a property of absorbing and holding the liquid and has a property of being crushed according to a pressing force applied when the liquid application member 44 is in contact with the sheet P. For example, the liquid application member 44 may be a foam material such as a sponge or a fiber material that can absorb liquid by capillary action.

The liquid supplier 45 is an elongated member having a base end (proximal end) immersed in the liquid stored in the liquid storage tank 43 and a distal end coupled to the liquid application member 44. Like the liquid application member 44, for example, the liquid supplier 45 is made of a material having a relatively high liquid absorption. Accordingly, the liquid is absorbed from the base end of the liquid supplier 45 and travels through the liquid supplier 45 by capillary action to be supplied to the liquid application member 44. Although the liquid application member 44 and the liquid supplier 45 are separately disposed in the embodiment described above, the liquid application member 44 and the liquid supplier 45 may be made of materials having like properties to be a single unit. In this case, like the embodiment described above, the liquid that is stored in the liquid storage tank 43 is absorbed by capillary action. This case further attains cost reduction.

A protector 45*a* is an elongated cylindrical body (for example, a tube) that is fitted around the liquid supplier 45. The protector 45*a* prevents the liquid absorbed by the liquid supplier 45 from leaking or evaporating. Each of the liquid supplier 45 and the protector 45*a* is made of a flexible material. The joint 46 fixes the liquid application member 44 to the base plate 40. Accordingly, the liquid application member 44 keeps projecting from the base plate 40 toward the upper pressure plate 34 with the end of the liquid application member 44 facing downward when the liquid application member 44 is moved by the liquid-applier movement assembly 35.

A liquid-applier shaft 562 provided with a drive transmission gear 562*a* is fixed to a bottom face of the liquid application frame 31*a* that holds the components of the liquid applier 31. The liquid-applier shaft 562 and the drive transmission gear 562*a* are held by the base 48 on which the liquid application frame 31*a* is disposed, so as to be rotatable in the forward and reverse directions. The drive transmission gear 562*a* meshes with an output gear 563*a* of a liquid-applier pivot motor 563. The liquid applier 31 can be rotated in the forward and reverse directions about the liquid-applier shaft 562 on the base 48 by a driving force transmitted from the liquid-applier pivot motor 563 to the liquid-applier shaft 562 via the output gear 563*a* and the drive transmission gear 562*a*.

The crimper 32 serving as a post-processing device sandwiches, with serrate upper crimping teeth 32*a* and serrate lower crimping teeth 32*b*, at least a part (in other words, the liquid application position) of the sheet bundle Pb to which liquid is applied by the liquid applier 31 to press and deform at least the part of the sheet bundle Pb. Thus, the crimper 32 binds the sheet bundle Pb. In the following description, such a binding way in which the upper crimping teeth 32*a* and the lower crimping teeth 32*b* sandwich and press the sheet bundle Pb to deform at least a part of the sheet bundle Pb may be referred to as "crimp binding." In other words, the crimper 32 crimps and binds the sheet bundle Pb or performs the crimp binding on the sheet bundle Pb. In short, the crimper 32 binds the sheet bundle Pb without binding materials such as staples. The components of the crimper 32 such as the upper crimping teeth 32*a* and the lower crimping teeth 32*b* are disposed on a crimping frame 32*c*.

Figure 5A:
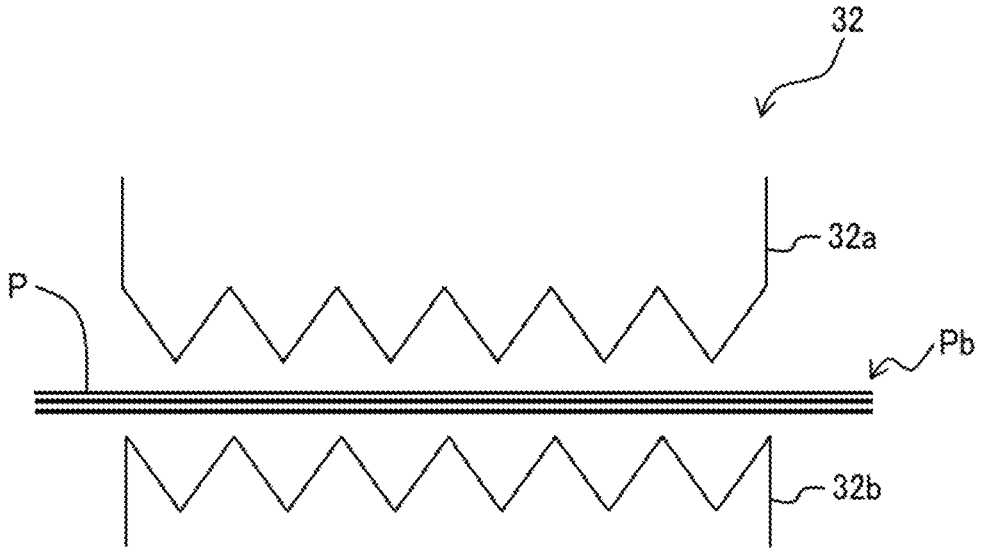
FIGS. 5A and 5B are schematic diagrams illustrating a configuration of a crimper according to an embodiment of the present disclosure.
Figure 5B:
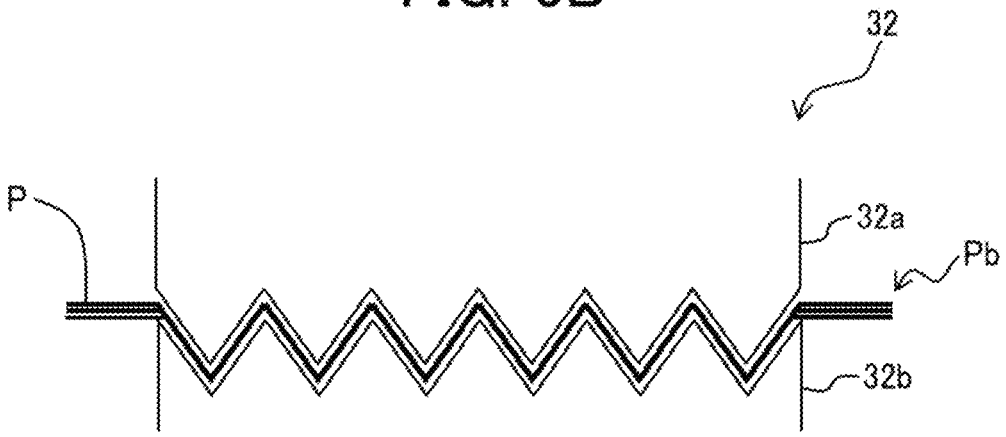

FIGS. 5A and 5B are schematic diagrams illustrating the configuration of the crimper 32.

As illustrated in FIGS. 5A and 5B, the crimper 32 includes a pair of binding teeth (i.e., the upper crimping teeth 32*a* and the lower crimping teeth 32*b*). The upper crimping teeth 32*a* and the lower crimping teeth 32*b* are disposed to face each other in the thickness direction of the sheet bundle Pb so as to sandwich the sheet bundle Pb placed on the internal tray 22. The upper crimping teeth 32*a* and the lower crimping teeth 32*b* have respective serrate faces facing each other. The serrate face of each of the upper crimping teeth 32*a* and the lower crimping teeth 32*b* includes concave portions and convex portions alternately formed. The concave portions and the convex portions of the upper crimping teeth 32*a* are shifted from those of the lower crimping teeth 32*b* such that the upper crimping teeth 32*a* are engaged with the lower crimping teeth 32*b*. The upper crimping teeth 32*a* and the lower crimping teeth 32*b* are brought into contact with and separated from each other by a driving force of a contact-separation motor 32*d* illustrated in FIG. 11.

In the process of supplying the sheets P of the sheet bundle Pb to the internal tray 22, the upper crimping teeth 32*a* and the lower crimping teeth 32*b* are apart from each other as illustrated in FIG. 5A. When all the sheets P of the sheet bundle Pb are placed on the internal tray 22, the upper crimping teeth 32*a* and the lower crimping teeth 32*b* are engaged with each other to press and deform the sheet bundle Pb in the thickness direction as illustrated in FIG. 5B. As a result, the sheet bundle Pb that has been placed on the internal tray 22 is crimped and bound. The sheet bundle Pb thus crimped and bound is output to the output tray 26 by the conveyance roller pair 15.

The configuration of the crimper 32 as a crimping assembly is not limited to the configuration according to some aspects of the embodiment described above, provided that the upper crimping teeth 32*a* and the lower crimping teeth 32*b* of the crimping assembly are engaged with each other. For example, the crimping assembly may be a crimping assembly disclosed in Japanese Patent No. 6057167 or its corresponding U.S. Patent Application Publication No. 2014-0219747, which is hereby incorporated by reference as though disclosed herein in its entirety. In this case, the crimping assembly brings the upper crimping teeth 32*a* and the lower crimping teeth 32*b* into contact with each other and separates the upper crimping teeth 32*a* and the lower crimping teeth 32*b* from each other with a link assembly and a driving source that simply rotates forward or that rotates forward and backward. Alternatively, the crimping assembly may employ a linear motion system to linearly bring the upper crimping teeth 32*a* and the lower crimping teeth 32*b* into contact with each other and separate the upper crimping teeth 32*a* and the lower crimping teeth 32*b* from each other with a screw assembly that converts the forward and backward rotational motions of a driving source into linear reciprocating motion.

A crimper shaft 54 provided with a drive transmission gear 54*a* is fixed to a bottom face of the crimping frame 32*c* that holds the components of the crimper 32. The crimper shaft 54 and the drive transmission gear 54*a* are held by the base 48 on which the crimping frame 32*c* is disposed, so as to be rotatable in the forward and reverse directions. The drive transmission gear 54*a* meshes with an output gear 56*a* of a crimper pivot motor 56. The crimper 32 can be rotated in the forward and reverse directions about the crimper shaft 54 on the base 48 by a driving force transmitted from the crimper pivot motor 56 to the crimper shaft 54 via the output gear 56*a* and the drive transmission gear 54*a*.

As illustrated in FIG. 3, the edge binder 25 includes an edge-binder movement assembly 47. The edge-binder movement assembly 47 moves the edge binder 25, specifically, the liquid applier 31 and the crimper 32, in the main scanning direction along a downstream end, in the conveyance direction, of the sheet P placed on the internal tray 22. The edge-binder movement assembly 47 includes, for example, the base 48, a guide shaft 49, the edge-binder movement motor 50, and a driving force transmission assembly 551.

The liquid applier 31 and the crimper 32 are attached to the base 48 so as to be adjacent to each other in the main scanning direction. The guide shaft 49 extends in the main scanning direction at a position downstream from the internal tray 22 in the conveyance direction. The guide shaft 49 supports the base 48 movably in the main scanning direction. The edge-binder movement motor 50 generates a driving force to move the edge binder 25. The driving force transmission assembly 551 transmits the driving force of the edge-binder movement motor 50 to the base 48 via pullies 551*a* and 551*b* and a timing belt 551*c*. As a result, the liquid applier 31 and the crimper 32 integrated by the base 48 move in the main scanning direction along the guide shaft 49.

Figure 16A:
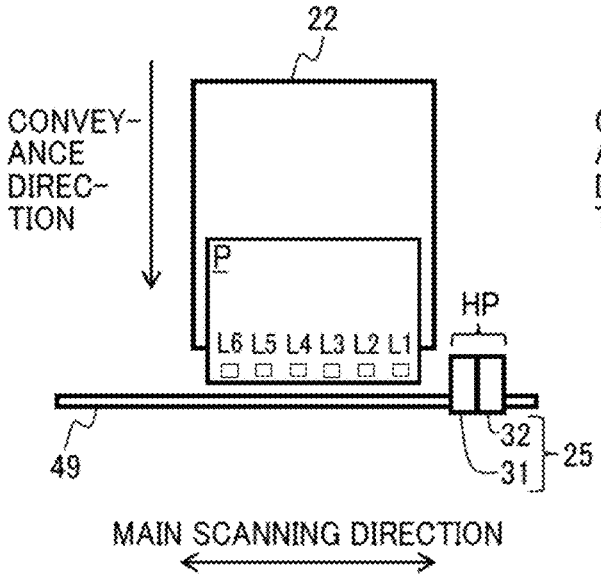
FIGS. 16A to 16D are diagrams illustrating positions of the edge binder in the process for adjusting the liquid application level of FIG. 14.
Figure 16B:
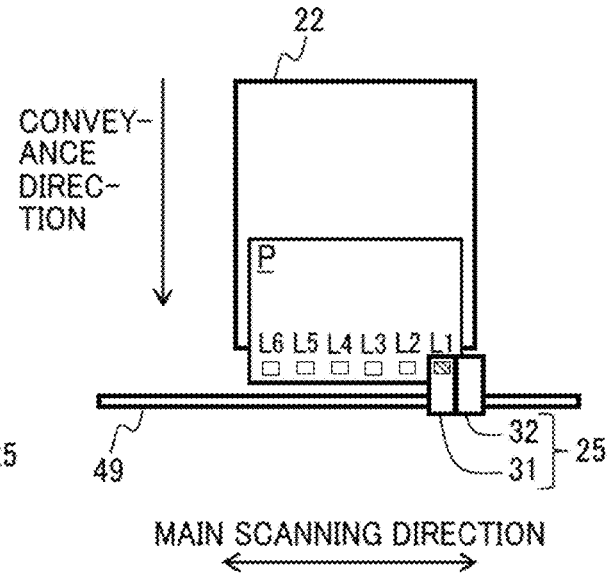
Figure 16C:
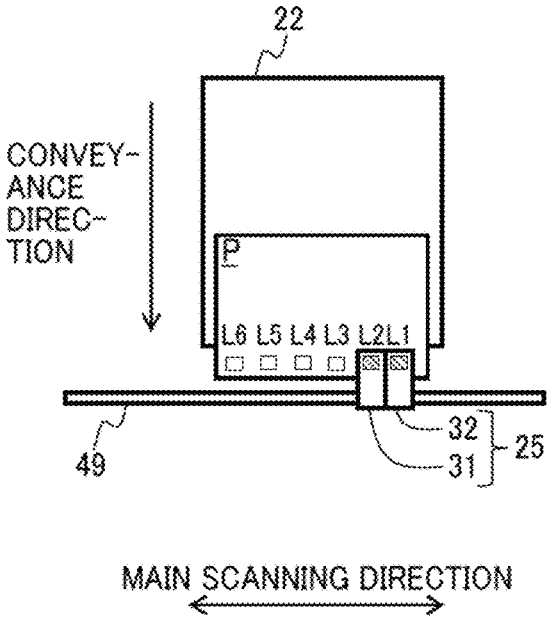
Figure 16D:
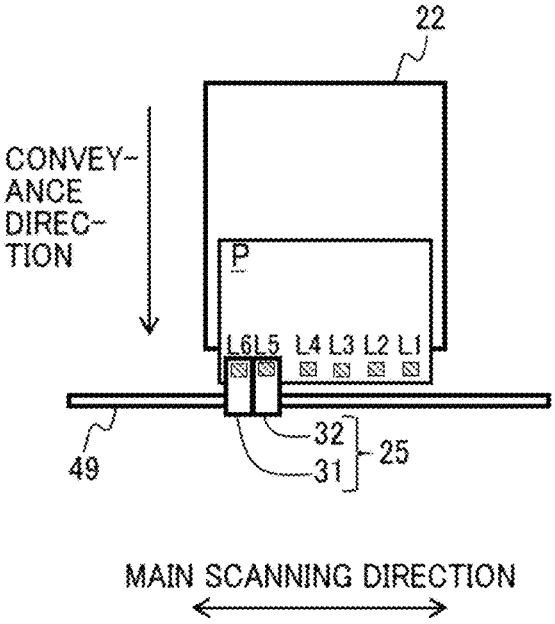

In other words, as illustrated in FIG. 16A, a standby position HP is away in the width direction from the sheet P placed on the internal tray 22. As illustrated in FIGS. 16B to 16D, the liquid applier 31 and the crimper 32 are movable along the guide shaft 49 to a position where the liquid applier 31 and the crimper 32 can face the sheet P placed on the internal tray 22 in the thickness direction of the sheet P.

The edge-binder movement motor 50 according to the present embodiment is, for example, a servo motor that can stop the edge binder 25 at a target position (i.e., a binding position B1) without returning the edge binder 25 to an origin position (for example, the standby position HP described later) each time the edge binder 25 is moved.

Figure 11:
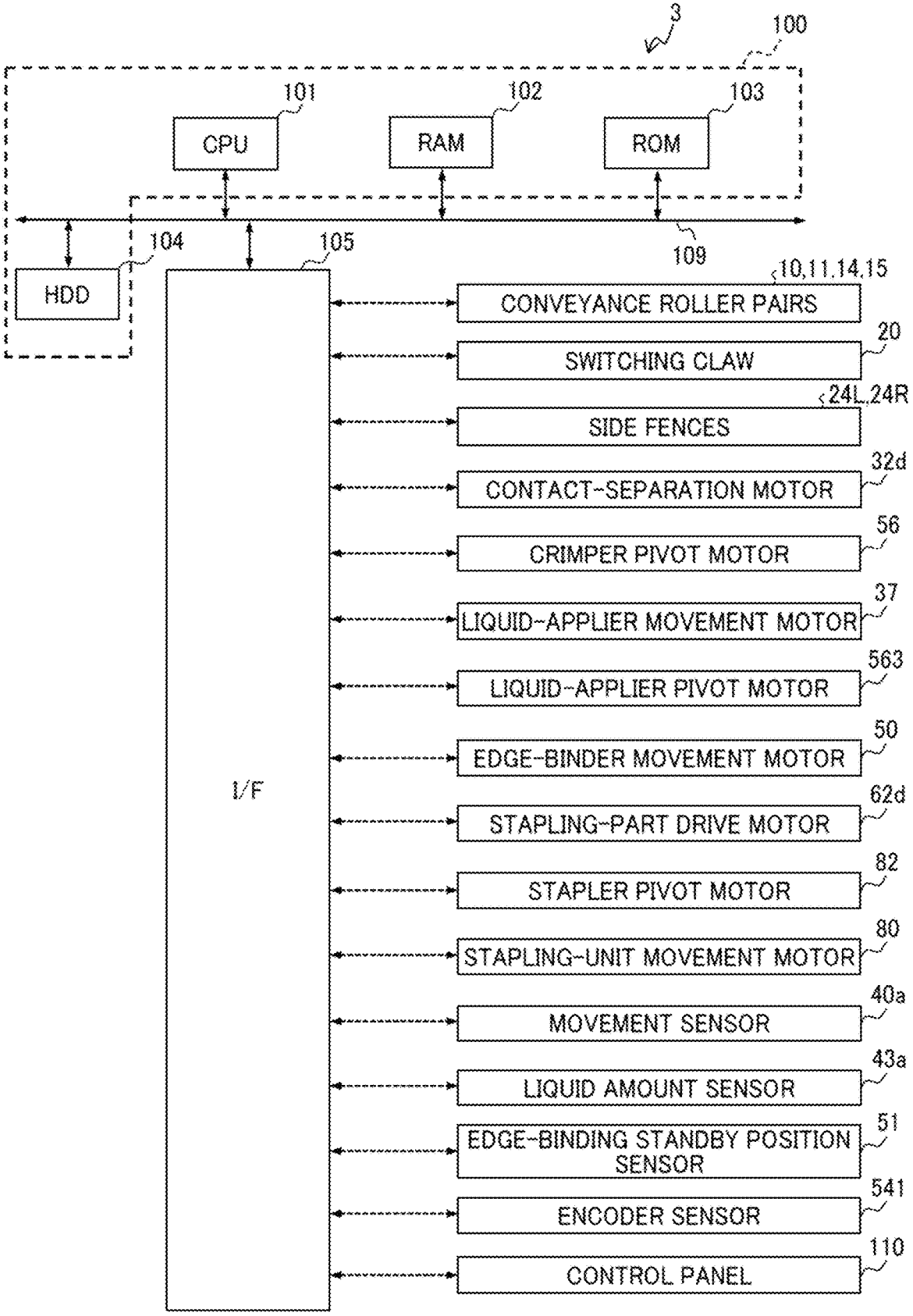
FIG. 11 is a block diagram illustrating a hardware configuration of the post-processing apparatus of FIG. 2 to control the post-processing apparatus.

As illustrated in FIG. 11, the post-processing apparatus 3 further includes an edge-binding standby position sensor 51 and an encoder sensor 541. The edge-binding standby position sensor 51 is, for example, a light-shielding optical sensor and detects the arrival of the edge binder 25 at the standby position HP illustrated in FIGS. 13A and 16A. The encoder sensor 541 is attached to an output shaft of the edge-binder movement motor 50. A controller 100, which will be described later, detects the arrival of the edge binder 25 at the standby position HP, based on a detection result of the edge-binding standby position sensor 51. The controller 100 also counts pulse signals output from the encoder sensor 541 to ascertain the current position of the edge binder 25 moved from the standby position HP.

However, a specific method of stopping the edge binder 25 at the target position without returning the edge binder 25 to the origin position is not limited to the aforementioned example. As another example, the post-processing apparatus 3 may include a sensor that detects the arrival of the edge binder 25 at a given target position.

Now, a description is given of a modification of the edge binder 25 described above.

Specifically, referring now to FIGS. 6 to 8C, a description is given of an edge binder as a post-processing device and as a modification of the edge binder 25 included in the post-processing apparatus 3.

The edge binder 25' is different from the edge binder 25 described above in that the liquid applier 31 and the crimper 32 are integrated as a single unit.

In the following description, components like those of the edge binder 25 described above are denoted by like reference numerals, and redundant descriptions thereof may be omitted unless otherwise required.

Figure 6:
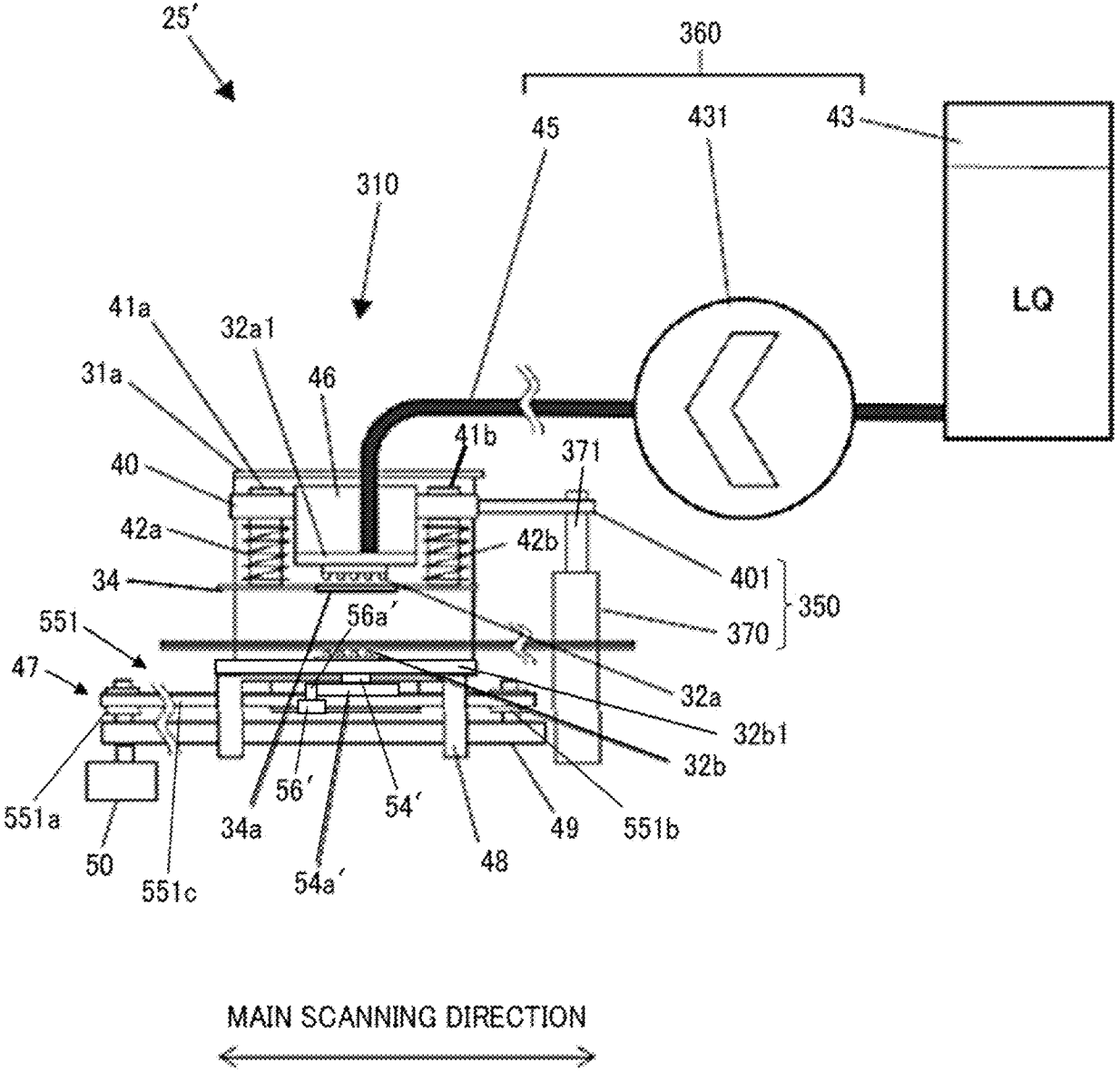
FIG. 6 is a diagram illustrating an edge binder as a modification of the edge binder of FIG. 3.

FIG. 6 is a schematic view of an upstream side of the edge binder 25' in the conveyance direction.

Figure 7A:
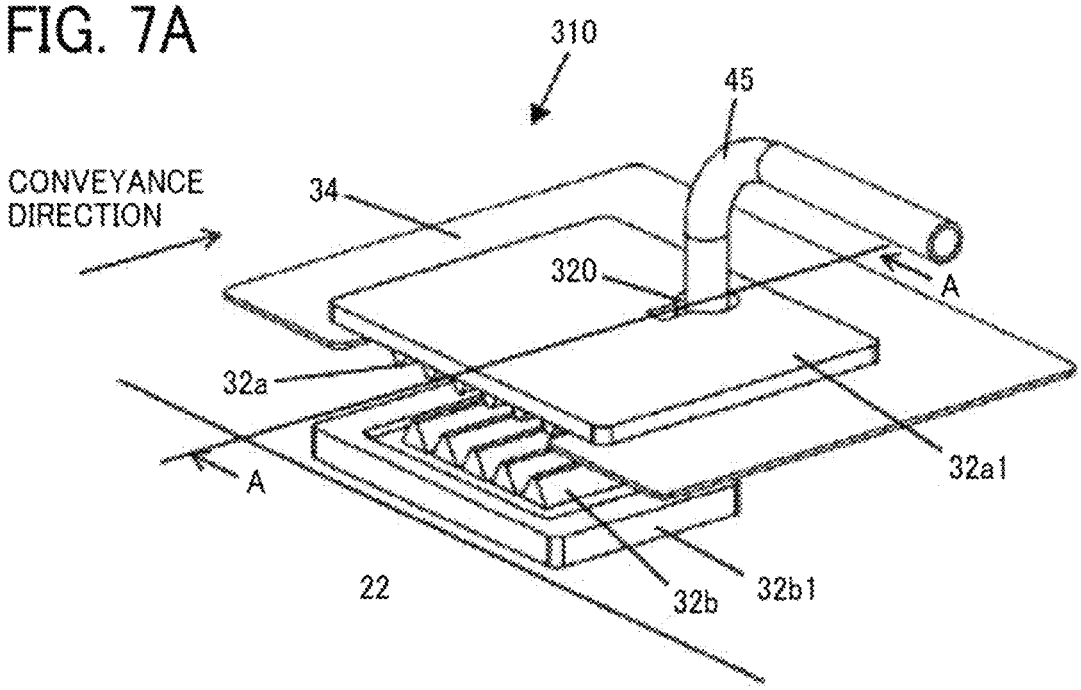
FIGS. 7A to 7C are diagrams illustrating a liquid application crimper of the edge binder of FIG. 6.

FIG. 7A is a perspective view of a liquid application crimper 310.

Figure 7B:
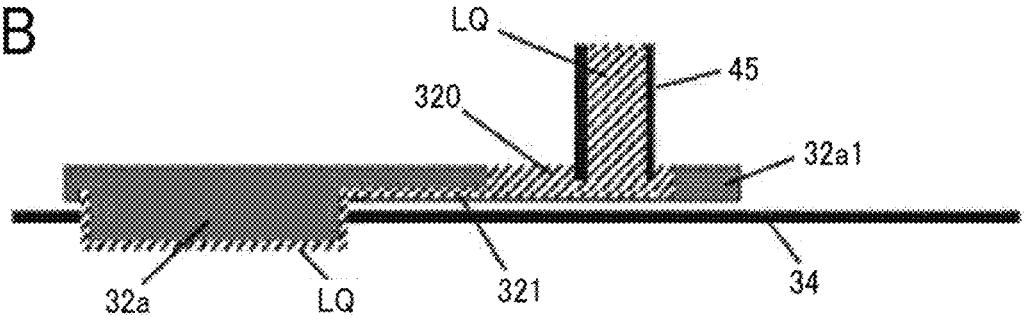

FIG. 7B is a cross-sectional view of the liquid application crimper 310 taken along line A-A in FIG. 7A.

Figure 7C:
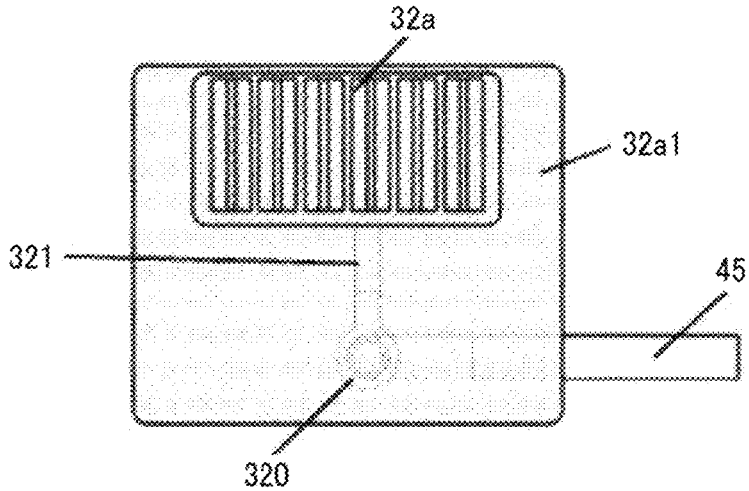

FIG. 7C is a plan view of the upper crimping teeth 32*a* of FIG. 7A as viewed from where the lower crimping teeth 32*b* are disposed.

Figure 8A:
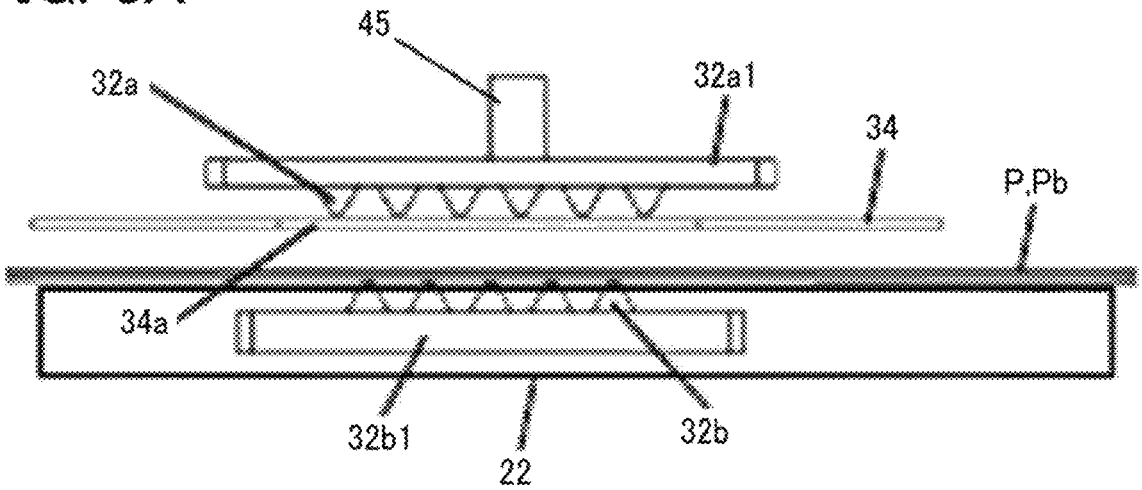
FIGS. 8A to 8C are diagrams illustrating a liquid applying operation and a crimp binding operation performed by the liquid application crimper of FIGS. 7A to 7C.
Figure 8B:
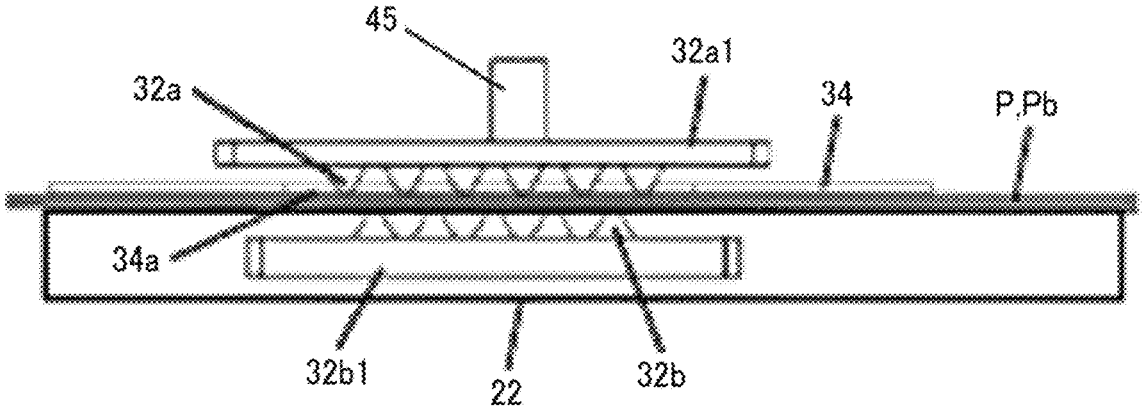
Figure 8C:
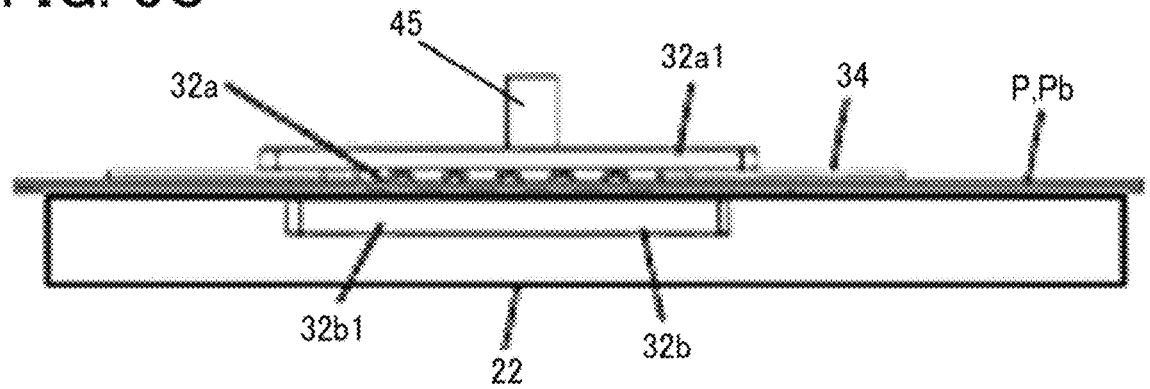

FIGS. 8A to 8C are diagrams illustrating a liquid applying operation and a crimp binding operation performed by the liquid application crimper 310. In other words, FIGS. 8A to 8C are schematic views of a downstream side of the liquid application crimper 310 in the conveyance direction.

As illustrated in FIG. 6, the edge binder 25' includes the liquid application crimper 310 in which the liquid applier 31 and the crimper 32 of the edge binder 25 according to the first embodiment are integrated as a single unit. The liquid application crimper 310 is disposed downstream from the internal tray 22 in the conveyance direction.

The liquid application crimper 310 applies liquid LQ stored in the liquid storage tank 43 to the sheet P or the sheet bundle Pb placed on the internal tray 22. The liquid application crimper 310 can be moved in the main scanning direction by the driving force that is transmitted from the edge-binder movement motor 50 to the base 48 by the driving force transmission assembly 551. The liquid application crimper 310 includes the upper pressure plate 34, the upper crimping teeth 32*a*, the lower crimping teeth 32*b*, a liquid-application-crimper movement assembly 350, and a liquid supply assembly 360. The components of the liquid application crimper 310 are held by the liquid application frame 31*a* and the base 48. A liquid-application-crimper shaft 54' provided with a drive transmission gear 54*a'* is fixed to a bottom face of the liquid application frame 31*a*. The liquid-application-crimper shaft 54' and the drive transmission gear 54*a'* are held by the base 48 on which the liquid application frame 31*a* is disposed, so as to be rotatable in the forward and reverse directions. The drive transmission gear 54*a'* meshes with an output gear 56*a'* of a liquid-application-crimper pivot motor 56'. The liquid application crimper 310 can be rotated in the forward and reverse directions about the liquid-application-crimper shaft 54' on the base 48 by a driving force transmitted from the liquid-application-crimper pivot motor 56' to the liquid-application-crimper shaft 54' via the output gear 56*a'* and the drive transmission gear 54*a'*.

The liquid-application-crimper movement assembly 350 moves the upper pressure plate 34, the base plate 40, and the upper crimping teeth 32*a* in conjunction with each other in the thickness direction of the sheet P or the sheet bundle Pb by an electric cylinder 370. The base plate 40 holds an upper-crimping-teeth holder 32*a*1 and the upper crimping teeth 32*a* via the joint 46. The base plate 40 movably holds the upper pressure plate 34 via the columns 41*a* and 41*b*. The base plate 40 is attached to an end of a rod 371 of the electric cylinder 370 via a connecter 401.

The columns 41*a* and 41*b* have respective lower ends holding the upper pressure plate 34. The coil springs 42*a* and 42*b* are fitted around the columns 41*a* and 41*b*, respectively, between the base plate 40 and the upper pressure plate 34.

The coil springs 42*a* and 42*b* bias the upper pressure plate 34 and the columns 41*a* and 41*b* in a direction away from the base plate 40.

The liquid supply assembly 360 includes the liquid storage tank 43, a liquid supply pump 431, and the liquid supplier 45. The liquid supply pump 431 supplies the liquid LQ via the liquid supplier 45 to a liquid reservoir 320 of the upper-crimping-teeth holder 32*a*1 as illustrated in FIG. 7A. The liquid supplier 45 is an elastic elongated member having a base end (proximal end) coupled to the liquid supply pump 431 and a distal end coupled to the liquid reservoir 320.

As illustrated in FIG. 7B, the upper crimping teeth 32*a* are integrated with the upper-crimping-teeth holder 32*a*1. The upper-crimping-teeth holder 32*a*1 includes the liquid reservoir 320 and a liquid supply path 321 to supply the liquid LQ stored in the liquid reservoir 320 to the upper crimping teeth 32*a*. The surface of the upper crimping teeth 32*a* is subjected to a hydrophilic treatment so that the liquid LQ that is supplied through the liquid supply path 321 uniformly spreads over the surface of the upper crimping teeth 32*a*. On the other hand, the portion of the upper-crimping-teeth holder 32*a*1 other than the upper crimping teeth 32*a* is subjected to a hydrophobic treatment so that the liquid LQ efficiently spreads over the surface of the upper crimping teeth 32*a*.

As illustrated in FIG. 6, the lower crimping teeth 32*b* are integrated with a lower-crimping-teeth holder 32*b*1, which is a part of the liquid application frame 31*a*. The lower crimping teeth 32*b* are attached to the base 48 via the lower-crimping-teeth holder 32*b*1.

Referring now to FIGS. 8A to 8C, a description is given of the liquid applying operation and the crimp binding operation performed by the liquid application crimper 310.

In the process of supplying the sheet P to the internal tray 22, as illustrated in FIG. 8A, the upper crimping teeth 32*a* and the lower crimping teeth 32*b* are apart from each other. When the sheet P is placed on the internal tray 22, the electric cylinder 370 is contracted to move the upper crimping teeth 32*a* and the upper pressure plate 34 toward the sheet P. Then, as illustrated in FIG. 8B, the upper pressure plate 34 first contacts the sheet P, and then the upper crimping teeth 32*a* pass through the through hole 34*a* of the upper pressure plate 34 and contacts the sheet P. At this time, since the liquid LQ has spread over the surface of the upper crimping teeth 32*a*, the liquid is applied from the upper crimping teeth 32*a* in contact with the sheet P to the liquid application position on the sheet P. When the liquid application to the liquid application position is completed, the electric cylinder 370 is extended to separate the upper crimping teeth 32*a* and the upper pressure plate 34 from the sheet P. The aforementioned contact and separation operation of the upper crimping teeth 32*a* and the upper pressure plate 34 with respect to the sheet P corresponds to the liquid applying operation, which is repeated on the sheets P of the sheet bundle Pb.

When the sheet bundle Pb constructed of a given number of sheets P is placed on the internal tray 22, the electric cylinder 370 is further contracted to move the upper crimping teeth 32*a* toward the lower crimping teeth 32*b*. As illustrated in FIG. 8C, the upper crimping teeth 32*a* further moves toward the lower crimping teeth 32*b* with the sheet bundle Pb sandwiched between the upper crimping teeth 32*a* and the lower crimping teeth 32*b*. Thus, the upper crimping teeth 32*a* and the lower crimping teeth 32*b* press and deform the sheet bundle Pb to crimp and bind the sheet bundle Pb. In short, the crimp binding operation is performed.

Now, a detailed description is given of the stapling unit 155 having a function of executing a stapling process.

Figure 9:
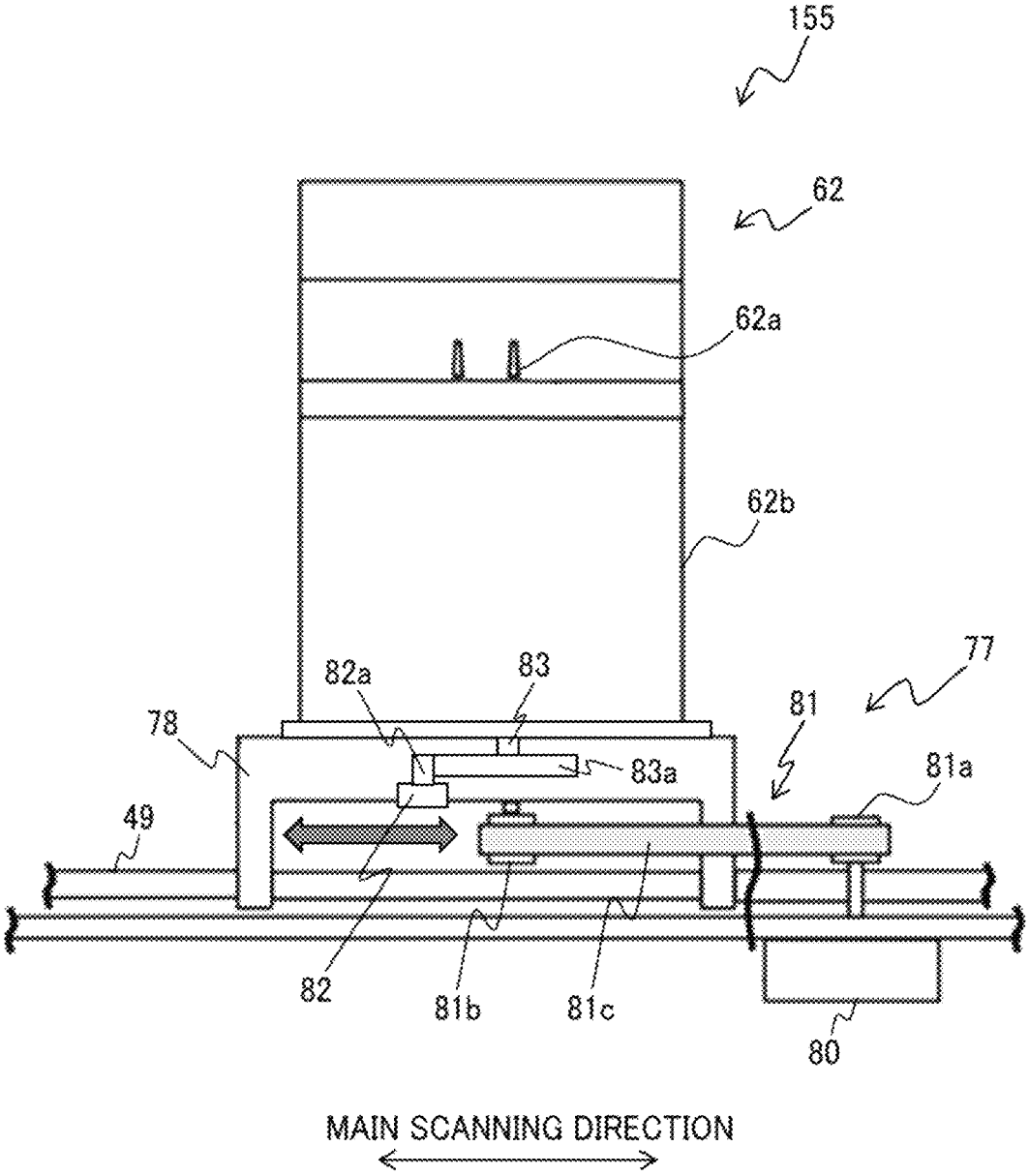
FIG. 9 is a schematic view of an upstream side of a stapling unit of the post-processing apparatus of FIG. 2 in a conveyance direction.

FIG. 9 is a view of an upstream side of the stapling unit 155 in the conveyance direction.

The stapling unit 155 includes a stapler 62 that binds the sheet bundle Pb with staples. The stapler 62 is disposed downstream from the internal tray 22 in the conveyance direction and apart from the edge binder 25 in the main scanning direction.

The stapler 62 serving as a post-processing device has a configuration of performing so-called "stapling" (i.e., stapling process) to bind the sheet bundle Pb with a staple or staples. More specifically, the stapler 62 includes a stapling-part drive motor 62*d* illustrated in FIG. 11. The stapling-part drive motor 62*d* drives a stapling part 62*a*. A driving force of the stapling-part drive motor 62*d* causes a staple loaded in the stapling part 62*a* to pass through the sheet bundle Pb. Thus, the stapling part 62*a* binds the sheet bundle Pb. Since the stapler 62 has a typical configuration, a detailed description thereof will be omitted unless otherwise required.

As illustrated in FIG. 9, the stapling unit 155 includes a stapling-unit movement assembly 77. The stapling-unit movement assembly 77 moves the stapling unit 155 in the main scanning direction along the downstream end, in the conveyance direction, of the sheet P or the sheet bundle Pb placed on the internal tray 22. The stapling-unit movement assembly 77 includes, for example, a base 78, the guide shaft 49, a stapling-unit movement motor 80, and a driving force transmission assembly 81. The driving force transmission assembly 81 transmits a driving force of the stapling-unit movement motor 80 to the base 78 via pullies 81*a* and 81*b* and a timing belt 81*c*. A stapler shaft 83 provided with a drive transmission gear 83*a* is fixed to a bottom face of a stapling frame 62*b* that holds the components of the stapler 62. The stapler shaft 83 and the drive transmission gear 83*a* are held by the base 78 on which the stapling frame 62*b* is disposed, so as to be rotatable in the forward and reverse directions. The drive transmission gear 83*a* meshes with an output gear 82*a* of a stapler pivot motor 82. The stapler 62 can be rotated in the forward and reverse directions about the stapler shaft 83 on the base 78 by a driving force transmitted from the stapler pivot motor 82 to the stapler shaft 83 via the output gear 82*a* and the drive transmission gear 83*a*.

The edge binder 25 and the stapling unit 155 are supported by the common guide shaft 49. The edge-binder movement assembly 47 and the stapling-unit movement assembly 77 move the edge binder 25 and the stapling unit 155 in the main scanning direction along the common guide shaft 49. The edge-binder movement assembly 47 and the stapling-unit movement assembly 77 can independently move the edge binder 25 and the stapling unit 155.

Figure 10:
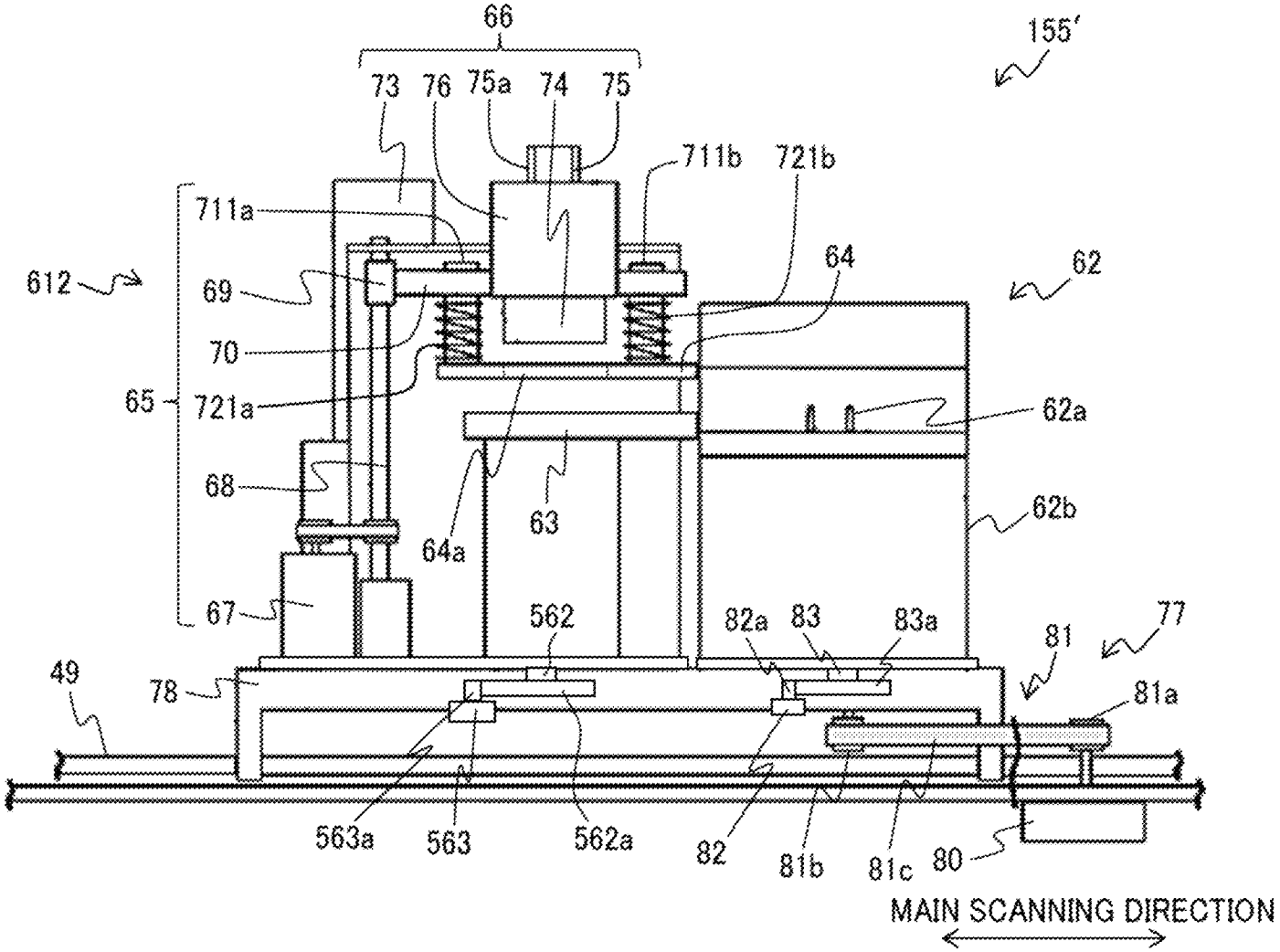
FIG. 10 is a schematic view of an upstream side of a stapling unit as a modification of the stapling unit of FIG. 9 in the conveyance direction.

FIG. 10 illustrates a stapling unit 155' as a modification of the stapling unit 155. Specifically, FIG. 10 is a view of an upstream side of the stapling unit 155' in the conveyance direction.

The stapling unit 155' is different from the stapling unit 155 in that the stapling unit 155' includes a second liquid applier 612 in addition to the stapler 62. As illustrated in FIG. 10, the stapling unit 155' includes the second liquid applier 612 and the stapler 62. The second liquid applier 612 and the stapler 62 are disposed downstream from the internal tray 22 in the conveyance direction and adjacent to each other in the main scanning direction.

The second liquid applier 612 executes "liquid application" of applying liquid stored in a second liquid storage tank 73 to the sheet P or the sheet bundle Pb supported on the internal tray 22. A given area including a position to which the liquid is applied on the sheet P or the sheet bundle Pb by the second liquid applier 612 corresponds to a binding position to be stapled. As illustrated in FIG. 10, the second liquid applier 612 includes a second lower pressure plate 63, a second upper pressure plate 64 having a through hole 64*a*, a second liquid-applier movement assembly 65, and a second liquid application assembly 66. The second liquid-applier movement assembly 65 includes, for example, a second liquid-applier movement motor 67, a second trapezoidal screw 68, a second nut 69, a second base plate 70, second columns 711*a* and 711*b*, and second coil springs 721*a* and 721*b*. The second liquid application assembly 66 includes the second liquid storage tank 73, a second liquid application member 74, a third liquid supplier 75 around which a protector 75*a* is fitted, and a second joint 76. Since the second liquid application assembly 66 and the liquid application assembly 36 have common configurations, redundant descriptions thereof will be omitted unless otherwise required. Since the configuration of the stapler 62 is like the configuration illustrated in FIG. 9, a detailed description thereof will be omitted unless otherwise required. Since the second liquid applier 612 and the liquid applier 31 that is illustrated in FIG. 3 have common pivot mechanisms, redundant descriptions thereof will be omitted unless otherwise required.

In the binding process, the stapling unit 155' that is illustrated in FIG. 10 performs the liquid application process on the sheet P to loosen and soften the binding position, allowing the staple to easily pass through the sheet bundle Pb. As a result, the number of sheets to be bound per sheet bundle Pb is increased as compared with a case where the stapling process is performed without applying the liquid.

Now, a description is given of a control block of the post-processing apparatus 3.

FIG. 11 is a diagram illustrating a hardware configuration of the post-processing apparatus 3.

As illustrated in FIG. 11, the post-processing apparatus 3 includes a central processing unit (CPU) 101, a random access memory (RAM) 102, a read only memory (ROM) 103, a hard disk drive (HDD) 104, and an interface (I/F) 105. The CPU 101, the RAM 102, the ROM 103, the HDD 104, and the I/F 105 are connected to each other via a common bus 109.

The CPU 101 is an arithmetic unit and controls the overall operation of the post-processing apparatus 3. The RAM 102 is a volatile storage medium that allows data to be read and written at high speed. The CPU 101 uses the RAM 102 as a work area for data processing. The ROM 103 is a read-only non-volatile storage medium that stores programs such as firmware. The HDD 104 is a non-volatile storage medium that allows data to be read and written and has a relatively large storage capacity. The HDD 104 stores, for example, an operating system (OS), various control programs, and application programs.

By an arithmetic function of the CPU 101, the post-processing apparatus 3 processes, for example, a control program stored in the ROM 103 and an information processing program (application program) loaded into the RAM 102 from a storage medium such as the HDD 104. Such processing configures a software controller including various functional modules of the post-processing apparatus 3. The software controller that is thus configured cooperates with hardware resources of the post-processing apparatus 3 to construct functional blocks that implement functions of the post-processing apparatus 3. In other words, the CPU 101, the RAM 102, the ROM 103, and the HDD 104 construct the controller 100 as circuitry that controls the operation of the post-processing apparatus 3.

The I/F 105 is an interface that connects the conveyance roller pairs 10, 11, 14, and the switching claw 20, the side fences 24L and 24R, the contact-separation motor 32*d*, the crimper pivot motor 56, the liquid-applier movement motor 37, the liquid-applier pivot motor 563, the edge-binder movement motor 50, the stapling-part drive motor 62*d*, the stapler pivot motor 82, the stapling-unit movement motor 80, the movement sensor 40*a*, the liquid amount sensor 43*a*, the edge-binding standby position sensor 51, the encoder sensor 541, and a control panel 110 to the common bus 109. The controller 100 controls, via the I/F 105, the operations of the conveyance roller pairs 10, 11, 14, and 15, the switching claw 20, the side fences 24L and 24R, the contact-separation motor 32*d*, the crimper pivot motor 56, the liquid-applier movement motor 37, the liquid-applier pivot motor 563, the edge-binder movement motor 50, the stapling-part drive motor 62*d*, the stapler pivot motor 82, and the stapling-unit movement motor 80.

On the other hand, the controller 100 acquires detection results from the movement sensor 40*a*, the liquid amount sensor 43*a*, the edge-binding standby position sensor 51, and the encoder sensor 541. Although FIG. 11 illustrates the components related to the stapling unit 155 and the edge binder 25 that executes the edge binding, the components related to the saddle binder 28 that executes the saddle binding are controlled by the controller 100 like the components related to the stapling unit 155 and the edge binder 25 that executes the edge binding.

As illustrated in FIG. 1, the image forming apparatus 2 includes the control panel 110. The control panel 110 includes an operation unit that receives instructions input by an operator and a display serving as a notifier that notifies the operator of information. Thus, the control panel 110 serves as an input device. The operation unit includes, for example, hard keys and a touch panel superimposed on the display. The control panel 110 acquires information from the operator through the operation unit and provides information to the operator through the display. Note that a specific example of the notifier is not limited to the display and may be a light emitting diode (LED) lamp or a speaker. The operator includes a so-called "worker" who is in charge of manufacturing the post-processing apparatus 3 or the maintenance of the post-processing apparatus 3 and a so-called "user" who uses the post-processing apparatus 3. The post-processing apparatus 3 may include the control panel 110 like the control panel 110 described above.

Now, a description is given of a binding process.

Specifically, a description is now given of a flow of a binding process executed by the edge binder 25 included in the post-processing apparatus 3.

Figure 12:
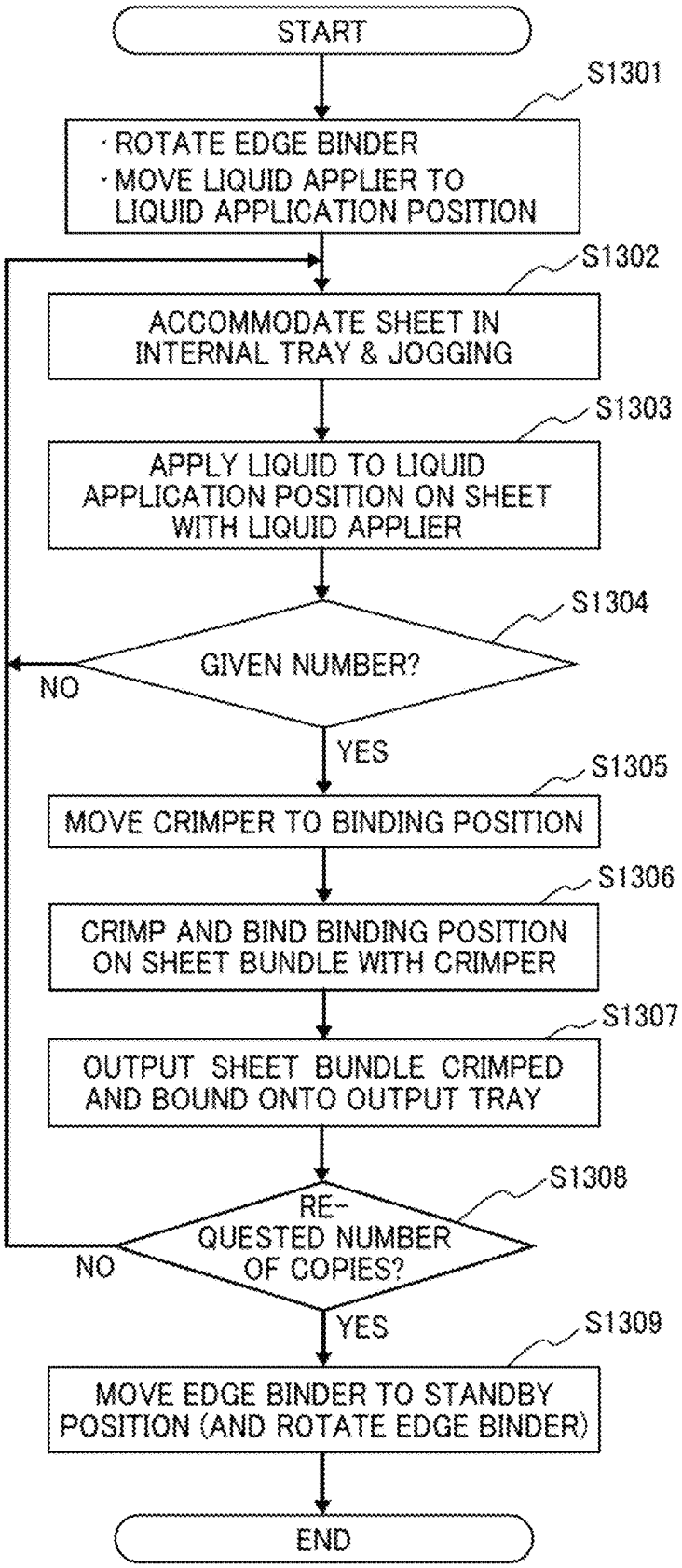
FIG. 12 is a flowchart of a binding process performed by the edge binder of FIG. 3.

FIG. 12 is a flowchart of an example binding process.

Figure 13A:
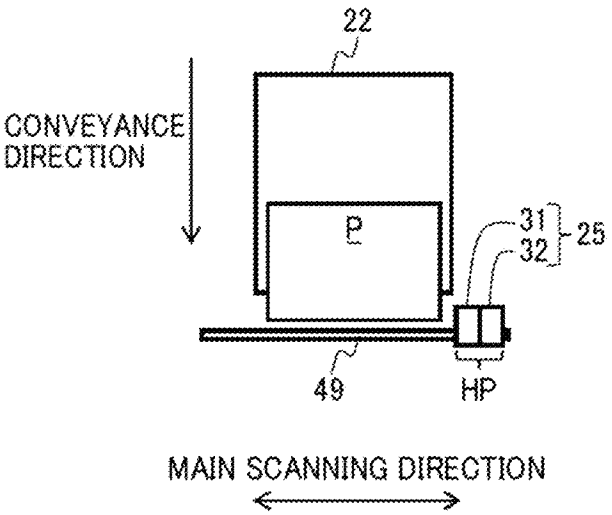
FIGS. 13A to 13C are diagrams illustrating the positions of the liquid applier and the crimper during the binding process of FIG. 12.
Figure 13B:
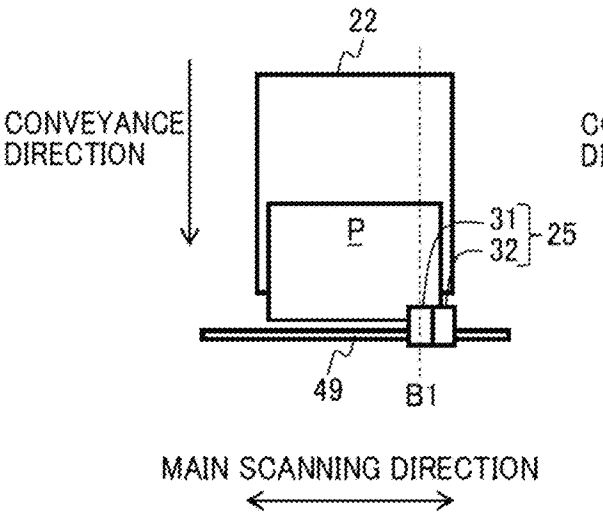
Figure 13C:
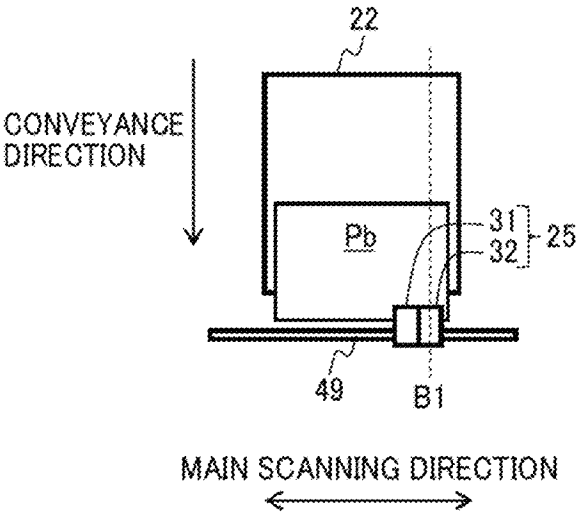

FIGS. 13A to 13C are diagrams illustrating the positions of the liquid applier 31 and the crimper 32 during the binding process.

FIGS. 13A to 13C do not illustrate changes in the postures of the liquid applier 31 and the crimper 32. The liquid application position to which the liquid is applied on the sheet P or the sheet bundle Pb by the liquid applier 31 corresponds to the binding position on the sheet bundle Pb to be crimped and bound by the crimper 32. For this reason, in the following description, the liquid application position and the binding position are denoted by the same reference numeral.

For example, the controller 100 starts the binding process illustrated in FIG. 12 when the controller 100 acquires an instruction to execute the binding process from the image forming apparatus 2. In the following description, the instruction to execute the binding process may be referred to as a "binding command."

The binding command includes, for example, the type of the sheet P (i.e., information affecting the spread of liquid, such as material and thickness), the number of sheets P of the sheet bundle Pb, the number of sheet bundles Pb to be bound, the binding position on the sheet bundle Pb, and the binding posture of the edge binder 25. In the following description, the number of sheets P of the sheet bundle Pb may be referred to as "given number" whereas the number of sheet bundles Pb to be bound may be referred to as "requested number of copies." The liquid applier 31 and the crimper 32 are in the parallel binding posture and at the standby position HP as illustrated in FIG. 13A at the start of the binding process. As described above, the standby position HP is away in the width direction from the sheet P placed on the internal tray 22 as illustrated in FIG. 13A.

When the posture that is instructed by the binding command is the "oblique binding posture," in step S1301, the controller 100 drives the liquid-applier pivot motor 563 and the crimper pivot motor 56 to rotate the liquid applier 31 and the crimper 32 of the edge binder 25 into the oblique binding posture. Alternatively, when the posture that is instructed by the binding command is the "oblique binding posture," only the crimper 32 may be rotated to the oblique binding posture while the liquid applier 31 may not be rotated. In this case, the driving assembly may be simplified as compared with a case where both the liquid applier 31 and the crimper 32 are rotated in the forward and reverse directions, and thus effects of cost reduction, downsizing of the apparatus, and reduction of failure of the device are exhibited.

On the other hand, when the posture that is instructed by the binding command is the "parallel binding posture," the controller 100 omits the aforementioned operation of rotating the liquid applier 31 and the crimper 32 of the edge binder 25 to the oblique binding posture. In step S1301, the controller 100 also drives the edge-binder movement motor 50 to move the edge binder 25 in the main scanning direction so that the liquid applier 31 faces a liquid application position B1 instructed by the binding command as illustrated in FIG. 13B. Note that the controller 100 executes the operation of step S1301 before a first sheet P is conveyed to the internal tray 22 by the conveyance roller pairs 10, 11, 14, and 15.

Subsequently, in step S1302, the controller 100 rotates the conveyance roller pairs 11, 14, and 15 to accommodate the sheet P on which an image is formed by the image forming apparatus 2 in the internal tray 22. In step S1302, the controller 100 also moves the side fences 24L and 24R to align the position, in the main scanning direction, of the sheet bundle Pb placed on the internal tray 22. In short, the controller 100 performs so-called jogging.

Subsequently, in step S1303, the controller 100 causes the liquid applier 31 facing the liquid application position B1 to apply liquid to the liquid application position B1 on the sheet P, which has been placed on the internal tray 22 in the immediately preceding step S1302, according to liquid application control data adjusted in advance.

In other words, the controller 100 drives the liquid-applier movement motor 37 to cause the liquid application member 44 to contact the liquid application position B1 on the sheet P placed on the internal tray 22 as illustrated in FIG. 13B.

More specifically, the controller 100 retrieves, from the HDD 104, an amount of liquid to be applied, which is represented by a liquid application level corresponding to the type of the sheet P indicated by the binding command. Then, in step S1303, the controller 100 causes the liquid applier 31 to apply the retrieved amount of liquid to the binding position on the sheet P. In other words, the controller 100 causes the liquid applier 31 to apply the liquid to the binding position on the sheet P placed on the internal tray 22, by the amount input through a screen for setting the amount of liquid to be applied.

Subsequently, in step S1304, the controller 100 determines whether the number of sheets P accommodated in the internal tray 22 has reached the given number instructed by the binding command.

When the controller 100 determines that the number of sheets P accommodated in the internal tray 22 has not reached the given number (NO in step S1304), the controller 100 executes the operations of steps S1302 and S1303 again. In other words, the controller 100 executes the operations of steps S1302 and S1303 each time the sheet P is conveyed to the internal tray 22 by the conveyance roller pairs 10, 11, 14, and 15. Note that the liquid applier 31 may apply liquid to all or some of the sheets P of the sheet bundle Pb. For example, the controller 100 may cause the liquid applier 31 to apply the liquid to the sheet P at intervals of one in every "n" sheets.

By contrast, when the controller 100 determines that the number of sheets P accommodated in the internal tray 22 has reached the given number (YES in step S1304), in step S1305, the controller 100 drives the edge-binder movement motor 50 to move the edge binder 25 in the main scanning direction so that the crimper 32 faces the binding position B1 as illustrated in FIG. 13C.

Subsequently, in step S1306, the controller 100 causes the crimper 32 to perform crimp binding on the sheet bundle Pb placed on the internal tray 22.

In step S1307, the controller 100 causes the conveyance roller pair 15 to output the sheet bundle Pb thus crimped and bound by the crimper 32 to the output tray 26.

Specifically, the controller 100 drives the contact-separation motor 32*d* to cause the upper crimping teeth 32*a* and the lower crimping teeth 32*b* to sandwich the binding position B1 on the sheet bundle Pb placed on the internal tray 22. The sheet bundle Pb is pressed and deformed between the upper crimping teeth 32*a* and the lower crimping teeth 32*b*. Thus, the crimper 32 crimps and binds the sheet bundle Pb. Thereafter, the controller 100 rotates the conveyance roller pair 15 to output the sheet bundle Pb thus crimped and bound to the output tray 26.

The sheet bundle Pb that is placed on the internal tray 22 has a crimping area (corresponding to the binding position B1) sandwiched between the upper crimping teeth 32*a* and the lower crimping teeth 32*b* in step S1306. The crimping area overlaps a liquid application area (corresponding to the liquid application position B1) contacted by the end of the liquid application member 44 in step S1303. In other words, the crimper 32 crimps and binds an area to which the liquid has been applied by the liquid applier 31 on the sheet bundle Pb placed on the internal tray 22. The crimping area that is sandwiched by the upper crimping teeth 32*a* and the lower crimping teeth 32*b* may completely or partially overlaps the liquid application area contacted by the end of the liquid application member 44, to obtain a sufficient binding strength.

Subsequently, in step S1308, the controller 100 determines whether the number of sheet bundles Pb thus output has reached the requested number of copies indicated by the binding command.

When the controller 100 determines that the number of sheet bundles Pb thus output has not reached the requested number of copies (NO in step S1308), the controller 100 executes the operations of step S1302 and the following steps again. In other words, when NO in step S1308, the controller 100 repeats the operations of steps S1302 to S1307 until the number of sheet bundles Pb output to the output tray 26 reaches the requested number of copies.

By contrast, when the controller 100 determines that the number of sheet bundles Pb output to the output tray 26 has reached the requested number of copies (YES in step S1308), in step S1309, the controller 100 drives the edge-binder movement motor 50 to move the edge binder 25 to the standby position HP as illustrated in FIG. 13A.

When the posture that is instructed by the binding command is the "oblique binding posture," in step S1309, the controller 100 also drives the liquid-applier pivot motor 563 and the crimper pivot motor 56 to rotate the liquid applier 31 and the crimper 32 into the parallel binding posture.

By contrast, when the posture that is instructed by the binding command is the "parallel binding posture," the controller 100 omits the aforementioned operation of rotating the liquid applier 31 and the crimper 32 to the parallel binding posture. As a result, the liquid applier 31 and the crimper 32 return to the standby position HP position illustrated in FIG. 13A.

Note that, in steps S1301 and S1309, the execution order of the movement in the main scanning direction and the rotation in the forward and reverse directions of the liquid applier 31 and the crimper 32 is not limited to the aforementioned order and may be reversed.

Now, a description is given of a process for adjusting the liquid application level.

Figure 14:
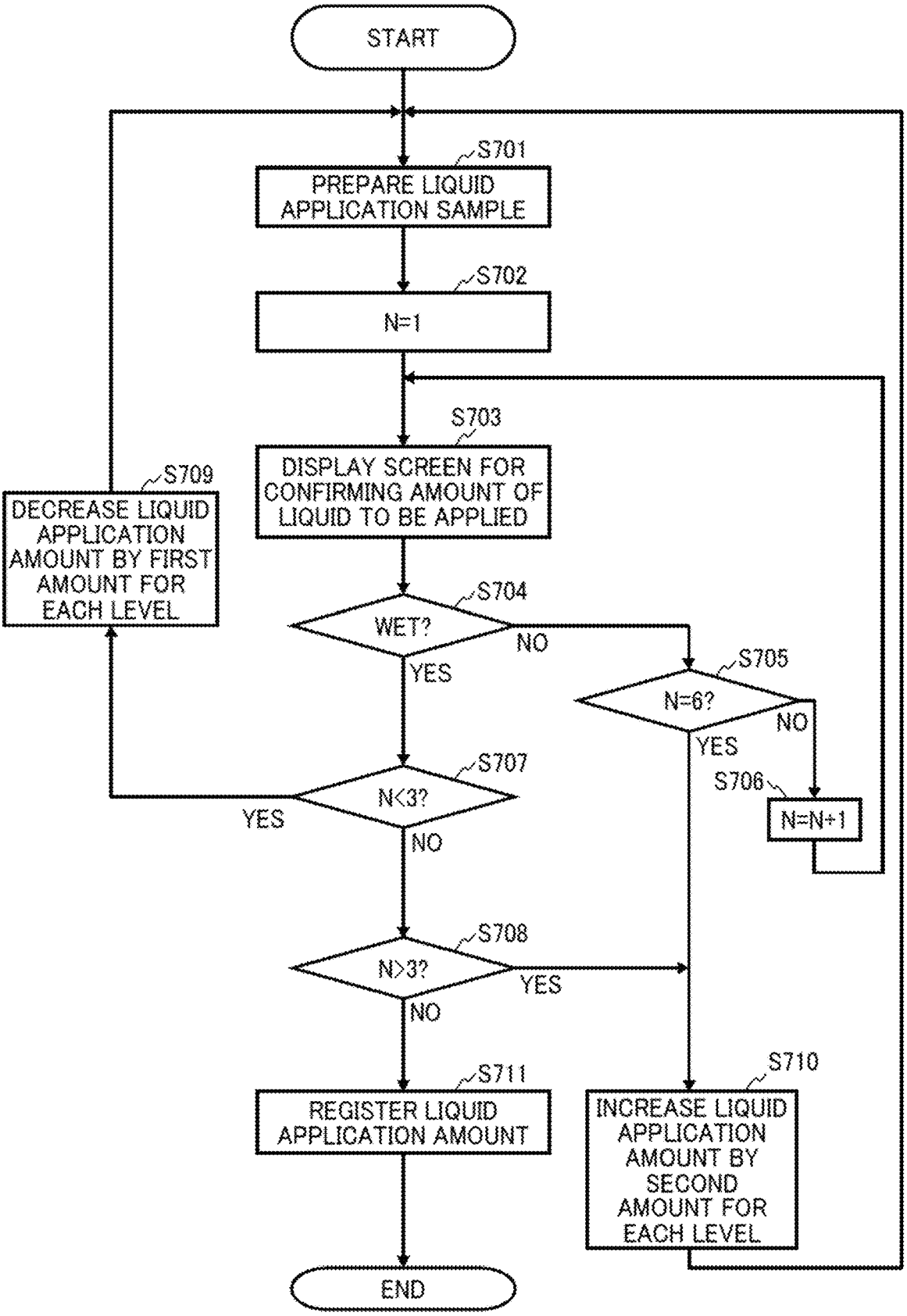
FIG. 14 is a flowchart of an example process for adjusting the liquid application level.

FIG. 14 is a flowchart of an example process for adjusting the liquid application level.

Figure 15A:
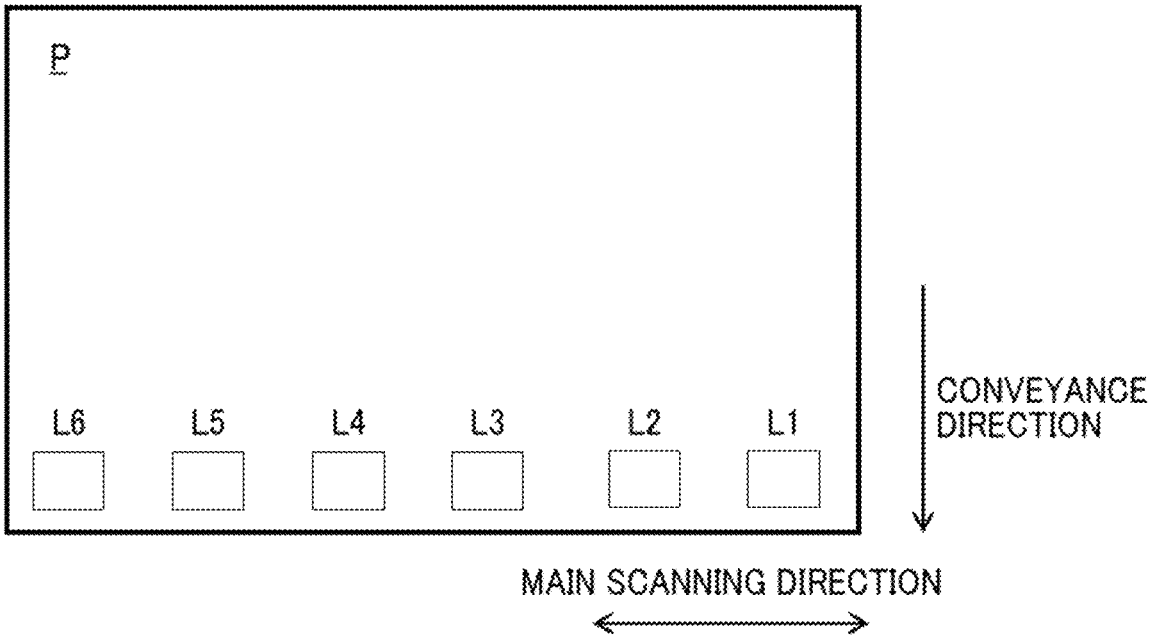
FIGS. 15A and 15B are diagrams illustrating example images formed by an image forming apparatus in the process for adjusting the liquid application level.
Figure 15B:
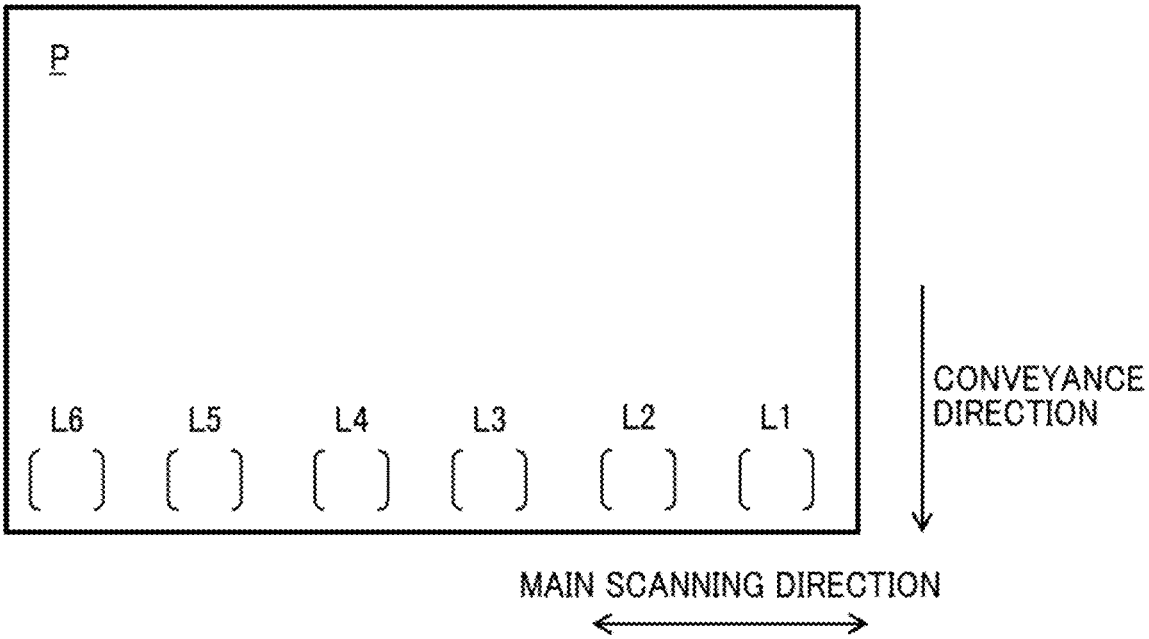

FIGS. 15A and 15B are diagrams illustrating example images formed by the image forming apparatus 2 in the process for adjusting the liquid application level.

FIGS. 16A to 16D are diagrams illustrating positions of the edge binder 25 in the process for adjusting the liquid application level.

Figure 17:
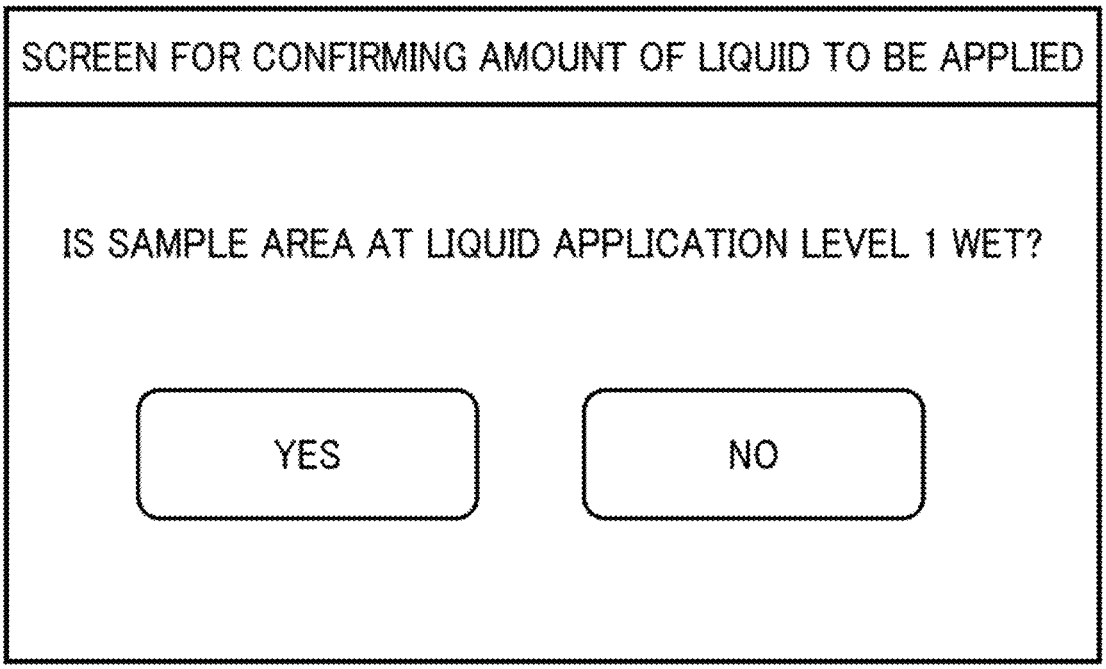
FIG. 17 is a diagram illustrating an example screen for confirming the amount of liquid to be applied.

FIG. 17 is a diagram illustrating an example screen for confirming the amount of liquid to be applied.

In the process for adjusting the liquid application level, the amount of liquid to be applied to the sheet P by the liquid applier 31 is adjusted. In the following description, the amount of liquid to be applied may be referred to simply as "liquid application amount."

The process for adjusting the liquid application level is executed at a desired time, for example, during the manufacturing process of the post-processing apparatus 3 or at the time of maintenance of the post-processing apparatus 3.

A plurality of liquid application levels 1 to 6, which specifies different liquid application amounts, is stored in the HDD 104. The liquid application levels 1 to 6 may be referred to simply as "L1" to "L6." The liquid application amount in the present embodiment is smallest at the liquid application level 1, gradually increases toward the liquid application level 6, and is largest at the liquid application level 6. However, the number of liquid application levels 1 to 6 is not limited to the aforementioned example.

First, in step S701, the controller 100 prepares a liquid sample.

The liquid sample refers to the sheet P on which the liquid has been applied to different positions in the main scanning direction by the liquid application amounts indicated by the plurality of liquid application levels 1 to 6. In other words, the liquid sample is the sheet P including a plurality of sample areas separated from each other in the main scanning direction. In each of the plurality of sample areas, the liquid is applied by the liquid application amount indicated by any one of the plurality of liquid application levels 1 to 6.

Referring now to FIGS. 15A to 16D, a detailed description is given of a process for preparing the liquid sample.

The controller 100 instructs the image forming apparatus 2 to form images for a liquid sample. As illustrated in FIGS. 15A and 15B, the image forming apparatus 2 forms, on the sheet P, images to specify the position of the plurality of sample areas (for example, rectangles illustrated in FIG. 15A or brackets illustrated in FIG. 15B) and images to specify the amounts of liquid applied to the plurality of sample areas (for example, characters "L1" to "L6" illustrated in FIGS. 15A and 15B). The images for specifying the sample areas are not limited to the examples illustrated in FIGS. 15A and 15B and may be frames, symbols, patterns, or a combination thereof. The images for specifying the liquid application amounts are not limited to the characters representing the corresponding liquid application levels and may be numbers, patterns, characters, symbols, or a combination thereof.

Then, the sheet P bearing the images illustrated in FIG. 15A or 15B is conveyed from the image forming apparatus 2 to the post-processing apparatus 3. The controller 100 rotates the conveyance roller pairs 10, 11, 14, and 15 to accommodate, in the internal tray 22, the sheet P bearing the images formed by the image forming apparatus 2. At this time, the edge binder 25 is at the standby position HP as illustrated in FIG. 16A.

Subsequently, the controller 100 drives the edge-binder movement motor 50 to move the edge binder 25 in the main scanning direction so that the liquid applier 31 faces the sample area corresponding to the liquid application level 1 as illustrated in FIG. 16B. When the liquid applier 31 faces the sample area, the controller 100 drives the liquid-applier movement motor 37 to cause the liquid applier 31 to apply the liquid by the liquid application amount indicated by the liquid application level 1 to the sample area corresponding to the liquid application level 1.

Subsequently, the controller 100 causes the liquid applier 31 to face the sample area corresponding to the liquid application level 2 as illustrated in FIG. 16C and then causes the liquid applier 31 to apply the liquid by the liquid application amount indicated by the liquid application level 2 to the sample area corresponding to the liquid application level 2. Similarly, the controller 100 causes the liquid applier 31 to apply the liquid by the liquid application amounts indicated by the liquid application levels 3, 4, and 5 to the sample areas corresponding to the liquid application levels 3, 4, and 5. Further, the controller 100 causes the liquid applier 31 to face the sample area corresponding to the liquid application level 6 as illustrated in FIG. 16D and then causes the liquid applier 31 to apply the liquid by the liquid application amount indicated by the liquid application level 6.

In other words, on the sheet P placed on the internal tray 22, the liquid is sequentially applied to each of the plurality of sample areas separated from each other in the main scanning direction, by the liquid application amount indicated by the corresponding liquid application level. Thus, the liquid sample is prepared. A specific method for adjusting the liquid application amount is not particularly limited. For example, the liquid application amount may be adjusted by adjusting the number of times of contact by the liquid application member 44, the contact time, or the contact pressure applied by the liquid application member 44. Thereafter, the controller 100 drives the edge-binder movement motor 50 to move the edge binder 25 to the standby position HP as illustrated in FIG. 16A. The controller 100 also causes the conveyance roller pair 15 to output the sheet P as the liquid sample to the output tray 26.

Subsequently, in step S702, the controller 100 initializes a variable N to be 1. The variable N is a value corresponding to each of the liquid application levels 1 to 6.

In step S703, the controller 100 displays, on the display of the control panel 110, the screen for confirming the amount of liquid to be applied, which is illustrated in FIG. 17. The screen for confirming the amount of liquid to be applied includes, for example, a message "Is the sample area at liquid application level N wet?," a "Yes" key, and a "No" key.

For example, when the variable N is 1, the screen for confirming the amount of liquid to be applied asks an operator whether the sample area at the liquid application level 1 is wet, as illustrated in FIG. 17. The operator touches, with a finger, the sample area corresponding to the liquid application level 1 in the liquid sample output to the output tray 26, to confirm whether the sample area is wet. When the operator feels that the sample area corresponding to the liquid application level 1 is wet, the operator presses the "Yes" key. By contrast, when the operator feels that the sample area is not wet, the operator presses the "No" key.

In step S704, the controller 100 receives the pressing of the "Yes" key or the "No" key by the operator through control panel 110. Pressing the "Yes" key is an example of an input indicating that the sample area corresponding to the liquid application level N is wet. Pressing the "No" key is an example of an input indicating that the sample area corresponding to the liquid application level N is not wet.

When the controller 100 receives the pressing of the "No" key (NO in step S704), in step S705, the controller 100 determines whether the variable N has reached 6 (in other words, a value corresponding to the maximum liquid application level 6).

When the variable N is less than 6 (NO in step S705), in step S706, the controller 100 increases the variable N by 1. Then, the controller 100 executes the operations of step S703 and the following steps again. In other words, when NO in step S704, the controller 100 asks the operator whether the sample area is wet through the screen for confirming the amount of liquid to be applied in order from the sample area containing the smallest liquid application amount, until the operator determines that the sample area is wet.

When the variable N reaches 6 (YES in step S705), the controller 100 executes the operation of step S710 described later.

When the controller 100 receives the pressing of the "Yes" key (YES in step S704), in step S707, the controller 100 determines whether the variable N is less than 3.

When the variable N is not less than 3 (NO in step S707), in step S708, the controller 100 determines whether the variable N is greater than 3. The liquid application level 3 corresponding to N=3 is an example of a predetermined reference level. The reference level is not limited to the liquid application level 3 and may be any one of the liquid application levels 2 to 5 other than the liquid application level 1 at which the liquid application amount is the smallest and the liquid application level 6 at which the liquid application amount is the largest. However, the reference level is preferably a liquid application level close to the median of the plurality of liquid application levels 1 to 6.

When the variable N is less than 3, in other words, when receiving, through the control panel 110, an input indicating that the sample areas corresponding to the liquid application levels 1 and 2 less than the reference level are wet (YES in step S707), in step S709, the controller 100 decreases the liquid application amount indicated by each of the plurality of liquid application levels 1 to 6 by a first amount.

By contrast, when receiving, through the control panel 110, an input indicating that the sample areas corresponding to the liquid application levels 3 to 6 equal to or greater than the reference level are not wet (NO in step S707) and when the variable N is greater than 3 (YES in step S708), in step S710, the controller 100 increases the liquid application amount indicated by each of the plurality of liquid application levels 1 to 6 by a second amount.

Each of the first amount and the second amount is a predetermined amount of liquid (for example, 0.5 ml). The first amount and the second amount may be the same value or different values. Then, the controller 100 executes the operations of step S701 and the following steps again by using the liquid application amount updated in step S709 or S710. In other words, the controller 100 applies the liquid by a new liquid application amount indicated by each of the plurality of liquid application levels 1 to 6 to the corresponding sample area on the sheet P and outputs a new liquid sample to the output tray 26.

When the operator determines that the sample area is wet for the first time when the variable N is 3 (NO in step S708), in step S711, the controller 100 registers, in HDD 104, the liquid application amount at each of the plurality of liquid application levels 1 to 6.

Thus, the controller 100 ends the process for adjusting the liquid application level. In other words, in the process for adjusting the liquid application level, the controller 100 asks the operator whether the sample areas are wet in order from the sample area at the lowest liquid application level. Until the controller 100 determines that the sample areas at liquid application levels lower than the reference level are not wet and that the sample area at the reference level is wet for the first time, the controller 100 repeats preparing the liquid sample by increasing or decreasing the liquid application amount for each of the liquid application levels 1 to 6.

Now, a description is given of a process for setting the amount of liquid to be applied (i.e., the liquid application amount).

Figure 18:
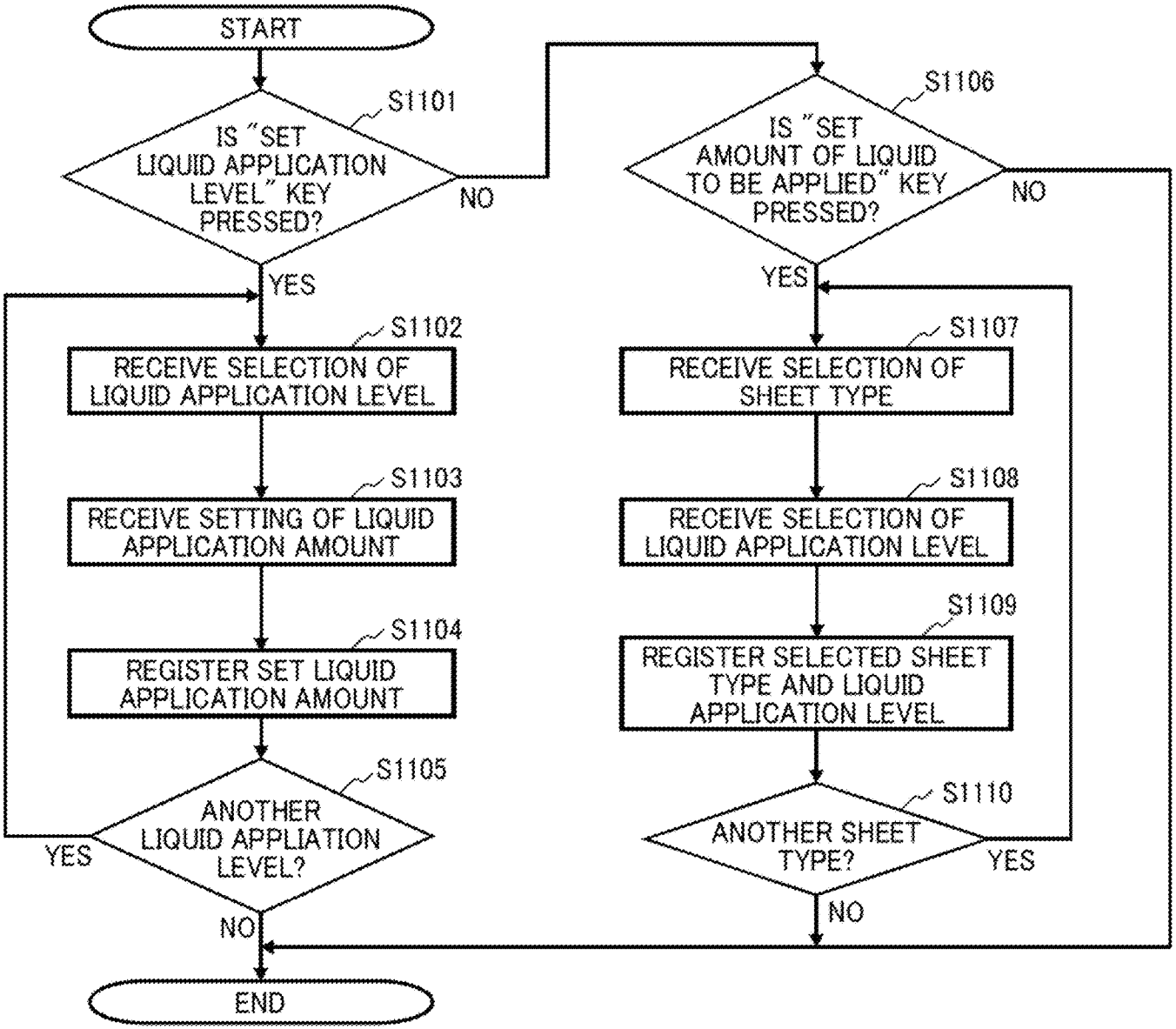
FIG. 18 is a flowchart of an example process for setting the amount of liquid to be applied.

FIG. 18 is a flowchart of an example process for setting the amount of liquid to be applied.

Figure 19A:
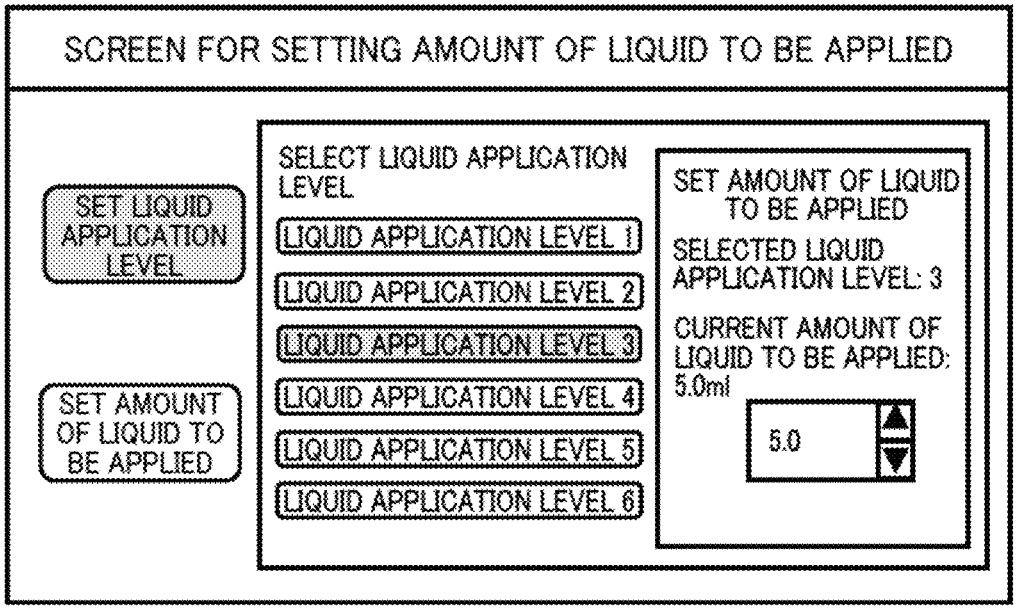
FIGS. 19A and 19B are diagrams illustrating example screens for setting the amount of liquid to be applied.
Figure 19B:
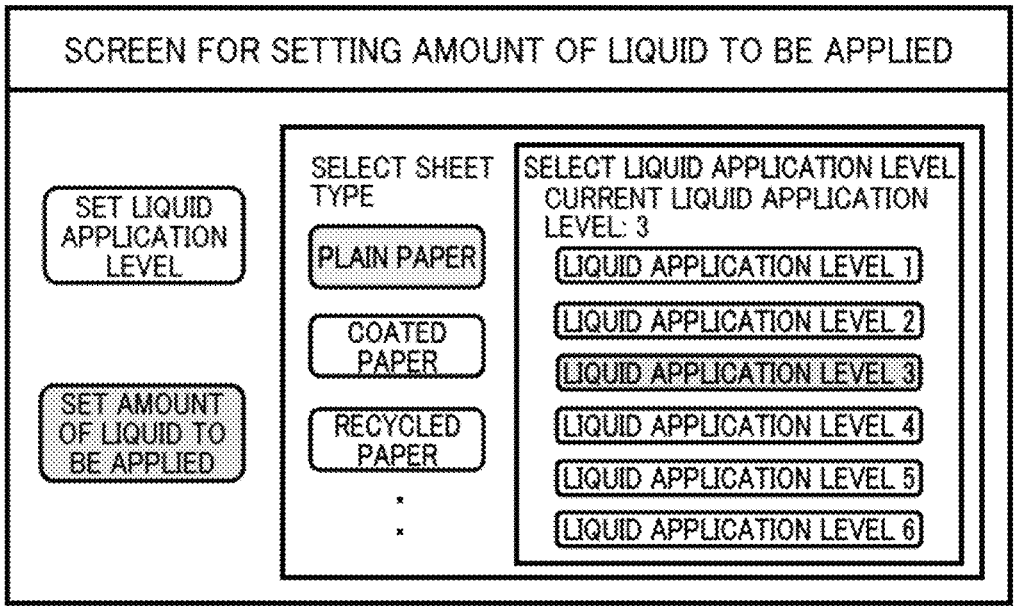

FIGS. 19A and 19B are diagrams illustrating example screens for setting the amount of liquid to be applied.

The process for setting the amount of liquid to be applied includes causing an operator to set the liquid application amounts corresponding to the liquid application levels 1 to 6 and causing the operator to set the correspondence relation between the type of the sheet P on which an image is formed and the liquid application level. The HDD 104 stores one of the liquid application levels 1 to 6 indicating different liquid application amounts in association with each type of the sheet P (for example, plain paper, coated paper, and recycled paper) on which an image can be formed by the image forming apparatus 2.

First, the controller 100 displays, on the display of the control panel 110, a screen for setting the amount of liquid to be applied, which is illustrated in FIG. 19A or 19B. The screen for setting the amount of liquid to be applied includes at least a "set liquid application level" key and a "set amount of liquid to be applied" key. The controller 100 receives the pressing of the "set liquid application level" key or the "set amount of liquid to be applied" key through the control panel 110. Specifically, in step S1101 in FIG. 18, the controller 100 determines whether the "set liquid application level" key is pressed.

When the "set liquid application level" key is not pressed (NO in step S1101), in step S1106 in FIG. 18, the controller 100 determines whether the "set amount of liquid to be applied" key is pressed.

By contrast, when the "set liquid application level" key is pressed (YES in step S1101 in FIG. 18), the controller 100 displays, on the screen for setting the amount of liquid to be applied, "liquid application level 1" to "liquid application level 6" keys for receiving the selection of a liquid application level, as illustrated in FIG. 19A.

In step S1102 in FIG. 18, the controller 100 receives the selection of one of the "liquid application level 1" to "liquid application level 6" keys through the control panel 110. The controller 100 then displays, on the screen for setting the amount of liquid to be applied, an area (for example, a spin key or a text box) for receiving the setting of the liquid application amount corresponding to the selected liquid application level. For example, when the "liquid application level 3" key is pressed, the controller 100 displays, on the screen for setting the amount of liquid to be applied, the liquid application amount currently set for the selected liquid application level 3, which is 5.0 ml in the example illustrated in FIG. 19A. The liquid application amount that is currently set (for example, 5.0 ml in the example illustrated in FIG. 19A) can be set again by the operator increasing or decreasing the liquid application amount as desired.

In step S1103 in FIG. 18, the controller 100 receives the setting of the liquid application amount through the control panel 110.

In step S1104 in FIG. 18, the controller 100 registers, in the HDD 104, the set liquid application amount in association with the selected liquid application level.

In step S1105, the controller 100 determines whether another liquid application level is selected.

When another liquid application level is selected (YES in step S1105), the controller 100 executes the operations of step S1102 and the following steps in FIG. 18 for the newly selected liquid application level.

By contrast, when no other liquid application level is selected (NO in step S1105), the process for setting the liquid application amount ends.

On the other hand, when the "set amount of liquid to be applied" key is not pressed (NO in step S1106 in FIG. 18), the process for setting the liquid application amount ends.

By contrast, when the "set amount of liquid to be applied" key is pressed (YES in step S1106 in FIG. 18), the controller 100 displays keys for selecting the type of sheet P on a screen for selecting the amount of liquid to be applied. The keys for selecting the type of sheet P are "plain paper," "coated paper," and "recycled paper" keys in the example illustrated in FIG. 19B. In the following description, the type of sheet P may be referred to as a sheet type.

In step S1107 in FIG. 18, the controller 100 receives the selection of the sheet type through the screen for selecting the liquid application amount. The controller 100 then displays, on the screen for setting the amount of liquid to be applied, the "liquid application level 1" to "liquid application level 6" keys for receiving the selection of the liquid application level. For example, when the "plain paper" key is pressed, the controller 100 displays, on the screen for selecting the amount of liquid to be applied, the liquid application level currently associated with the selected sheet type, which is the liquid application level 3 in the example illustrated in FIG. 19B.

In step S1108 in FIG. 18, the controller 100 receives the selection of one of the "liquid application level 1" to "liquid application level 6" keys through the control panel 110.

In step S1109 in FIG. 18, the controller 100 registers, in the HDD 104, the selected sheet type and the selected liquid application level in association with each other.

In step S1110 in FIG. 18, the controller 100 determines whether another sheet type is selected.

When another sheet type is selected (YES in step S1110), the controller 100 executes the operations of step S1107 and the following steps in FIG. 18 for the newly selected sheet type.

By contrast, when no other sheet type is selected (NO in step S1110), the process for setting the liquid application amount ends.

A description is now given of some or all of the advantages according to the embodiment described above, enumeration of which is not exhaustive or limiting.

According to the embodiment described above, preparation of a liquid sample allows an operator to confirm the liquid application amount for each of the liquid application levels 1 to 6. As an example, when the liquid sample is prepared in the manufacturing process of the post-processing apparatus 3, product variations of the medium processing apparatus can be leveled. As another example, when the liquid sample is prepared at the time of maintenance of the post-processing apparatus 3, variation in the liquid application amount due to aging of, for example, the liquid application member 44 can be corrected. However, the time when the liquid sample is prepared is not limited to the aforementioned examples.

In addition, according to the embodiment described above, the operator can input the liquid application amount for each of the liquid application levels 1 to 6 through the screen for setting the amount of liquid to be applied. Accordingly, the liquid application amount can be set as appropriate for each of the liquid application levels 1 to 6 with the feeling of the operator who has checked the liquid sample. Further, the liquid application amount can be customized for each of the liquid application levels 1 to 6 according to the preference of the operator of the post-processing apparatus 3.

The operator subjectively determines the liquid application amount based on, for example, the wetness of a sample area, a change in the color tone of the sample area when the sample area is wet, or a color density in a case where a colored liquid is applied. However, the operator may subjectively determine the liquid application amount in another way other than the aforementioned examples. For example, the operator may subjectively determine the liquid application amount based on the amount of emitted light passing through the sample area or by directly measuring the amount of liquid in the sample area with a sensor.

The post-processing apparatus 3 may or may not store the plurality of liquid application levels 1 to 6. Specifically, the operator selects, from a plurality of sample areas on a liquid sample, a sample area to which an appropriate amount of liquid is applied. The operator then inputs the selected sample area through the control panel 110.

In step S1303 in FIG. 12, the controller 100 may cause the liquid applier 31 to apply, to the sheet P, the same amount of liquid as the amount of liquid applied to the sample area input through the control panel 110.

According to the embodiment described above, the liquid application amount can be increased or decreased for each of the liquid application levels 1 to 6 by causing the operator to input whether each sample area is wet. Accordingly, product variations and aging of the medium processing apparatus can be semi-automatically corrected. The process for adjusting the liquid application level illustrated in FIG. 14 may or may not be executed by the controller 100. For example, the process for adjusting the liquid application level may be manually executed by an operator through the screen for setting the amount of liquid to be applied, which is illustrated in FIG. 19A.

According to the embodiment described above, an image is formed on the liquid sample to specify the position of each of the plurality of sample areas. Thus, the visibility of the area to which the liquid is applied is enhanced on the liquid sample. In addition, an image is formed on the liquid sample to specify the amount of liquid applied to each of the plurality of sample areas. Thus, the visibility of the amount of liquid applied to each sample area is enhanced.

The embodiments of the present disclosure are applied to the edge binder 25 that executes the edge binding as described above. However, the embodiments of the present disclosure may be applied to the saddle binder 28 that executes the saddle binding.

Referring now to FIGS. 20 to 28, a description is given of a post-processing apparatus 3A according to a second embodiment of the present disclosure.

In the following description, components like those of the post-processing apparatus 3 according to the first embodiment are denoted by like reference numerals, and redundant descriptions thereof may be omitted unless otherwise required.

The post-processing apparatus 3A according to the second embodiment includes an edge binder 251. The edge binder 251 is different from the edge binder 25 of the post-processing apparatus 3 according to the first embodiment in which the liquid applier 31 and the crimper 32 are arranged side by side. The edge binder 251 includes a crimper 32' and a liquid applier 131 is disposed at an upstream position in a direction in which the sheet P is conveyed. Such a configuration allows a given number of sheets P to be stacked after the liquid application process and conveyed to the crimper 32' of the edge binder 251 disposed at a downstream position in the direction in which the sheet P is conveyed. Accordingly, the productivity of the binding process performed by the crimper 32' is enhanced.

Since the direction in which the conveyance roller pairs 10, 11, and 14 convey the sheet P is opposite to the "conveyance direction" defined above, the direction in which the conveyance roller pairs 10, 11, and 14 convey the sheet P is defined as an "opposite conveyance direction" in the following description. A direction that is orthogonal to the opposite conveyance direction and the thickness direction of the sheet P is defined as the "main scanning direction" or the "width direction of the sheet P." The liquid application position to which the liquid is applied on the sheet P or the sheet bundle Pb by the liquid applier 131 corresponds to the binding position on the sheet bundle Pb to be crimped and bound by the crimper 32'. For this reason, in the following description, the liquid application position and the binding position are denoted by the same reference numeral.

Figure 20:
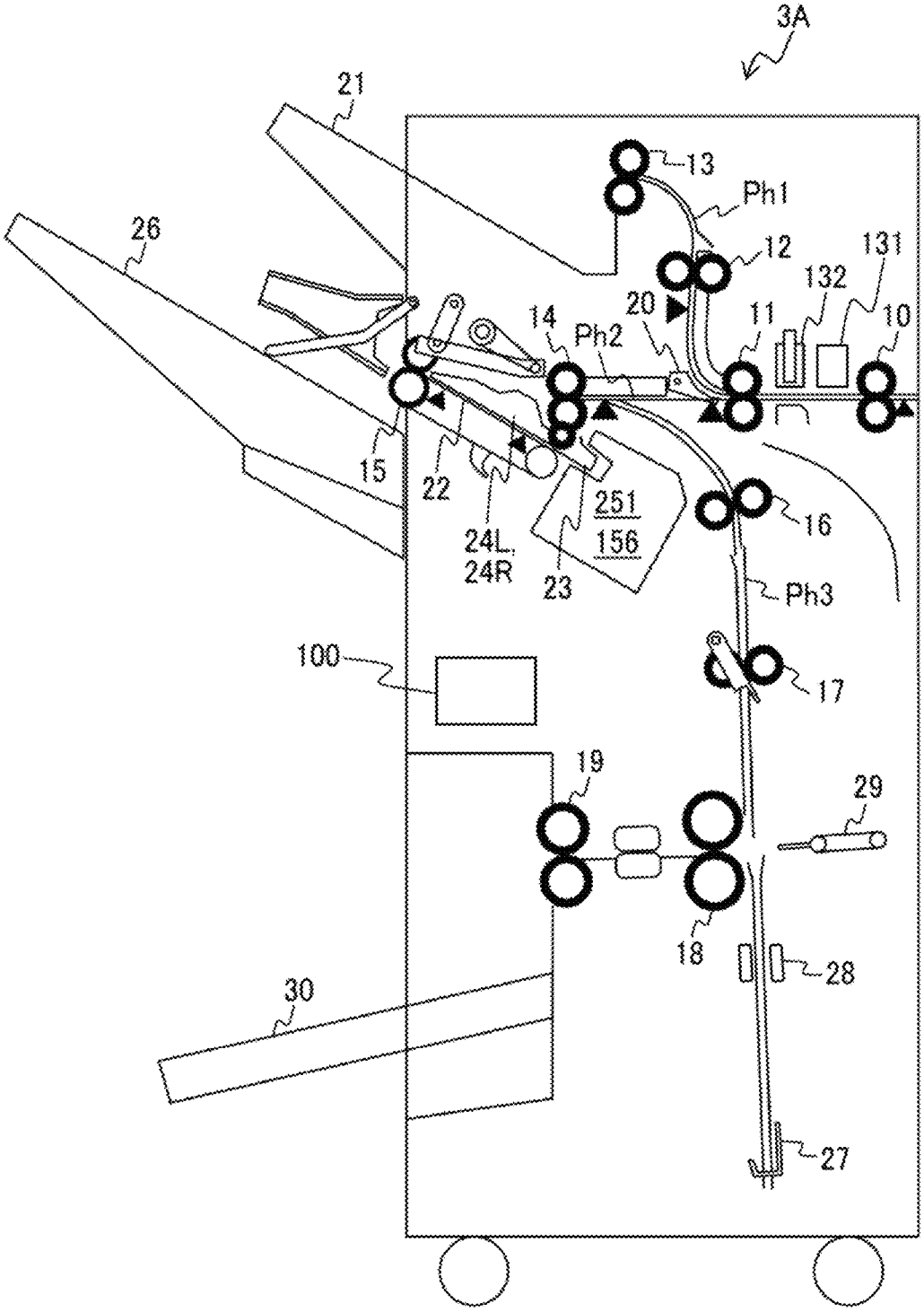
FIG. 20 is a diagram illustrating an internal configuration of a post-processing apparatus according to a second embodiment of the present disclosure.

FIG. 20 is a diagram illustrating an internal configuration of the post-processing apparatus 3A according to the second embodiment of the present disclosure.

Figure 21A:
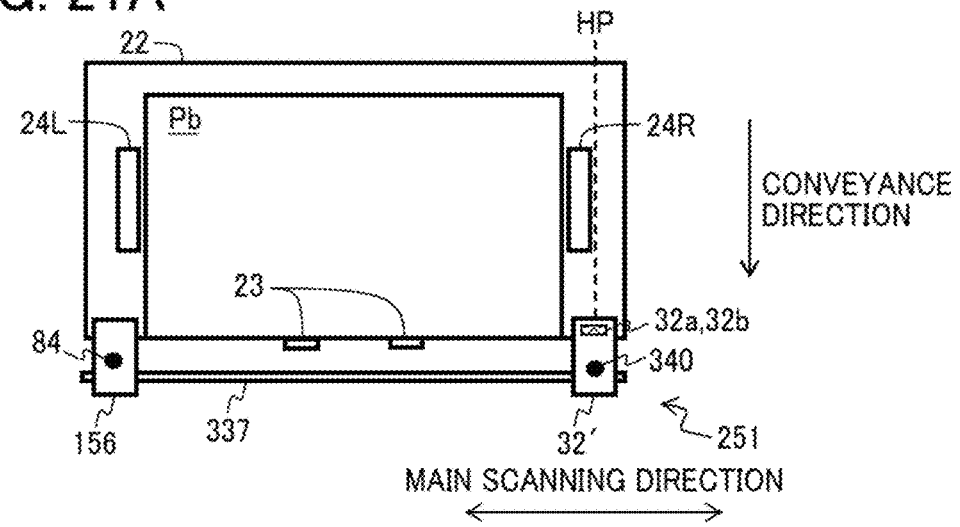
FIGS. 21A to 21C are views of an internal tray of the post-processing apparatus of FIG. 20 in a thickness direction of a sheet.
Figure 21B:
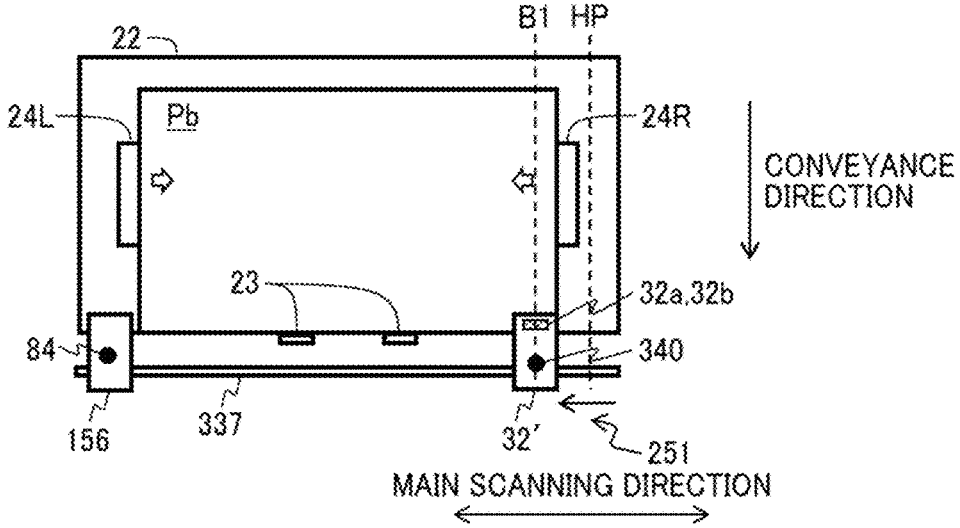
Figure 21C:
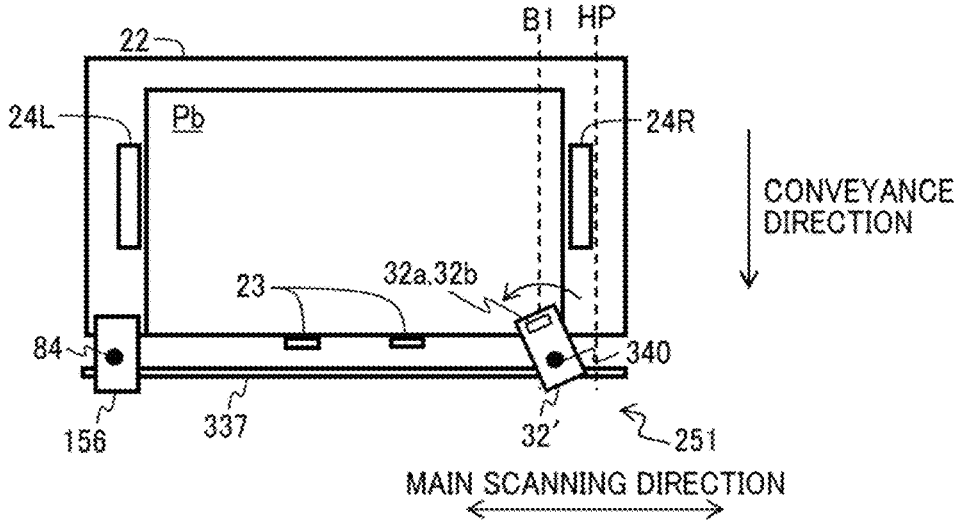

As illustrated in FIGS. 21A to 21C, the edge binder 251 includes the crimper 32'. As illustrated in FIG. 20, the crimper 32' and a stapling unit 156 are disposed downstream from the internal tray 22 in the conveyance direction. In addition, the crimper 32' and the stapling unit 156 are located to face the downstream end, in the conveyance direction, of the sheet bundle Pb placed on the internal tray 22 and is movable in the main scanning direction. Further, the crimper 32' and the stapling unit 156 are respectively rotatable in the forward and reverse directions about a crimper shaft 340 and a stapler shaft 84 both extending in the thickness direction of the sheet bundle Pb placed on the internal tray 22. In other words, the crimper 32' and the stapling unit 156 bind, at a desired angle, a desired position in the main scanning direction on the sheet bundle Pb placed on the internal tray 22 in, for example, corner oblique binding, parallel one-point binding, or parallel two-point binding.

The crimper 32' presses and deforms the sheet bundle Pb with the serrate upper binding teeth 32*b* and the serrate lower crimping teeth 32*b* to bind the sheet bundle Pb. In the following description, such a binding way may be referred to as "crimp binding." In other words, the crimper 32' crimps and binds the sheet bundle Pb or performs the crimp binding on the sheet bundle Pb. On the other hand, the stapling unit 156 passes the staple through a binding position on the sheet bundle Pb placed on the internal tray 22 to staple the sheet bundle Pb.

Each of FIGS. 21A to 21C is a view of the internal tray 22 in the thickness direction of the sheet bundle Pb.

Figure 22:
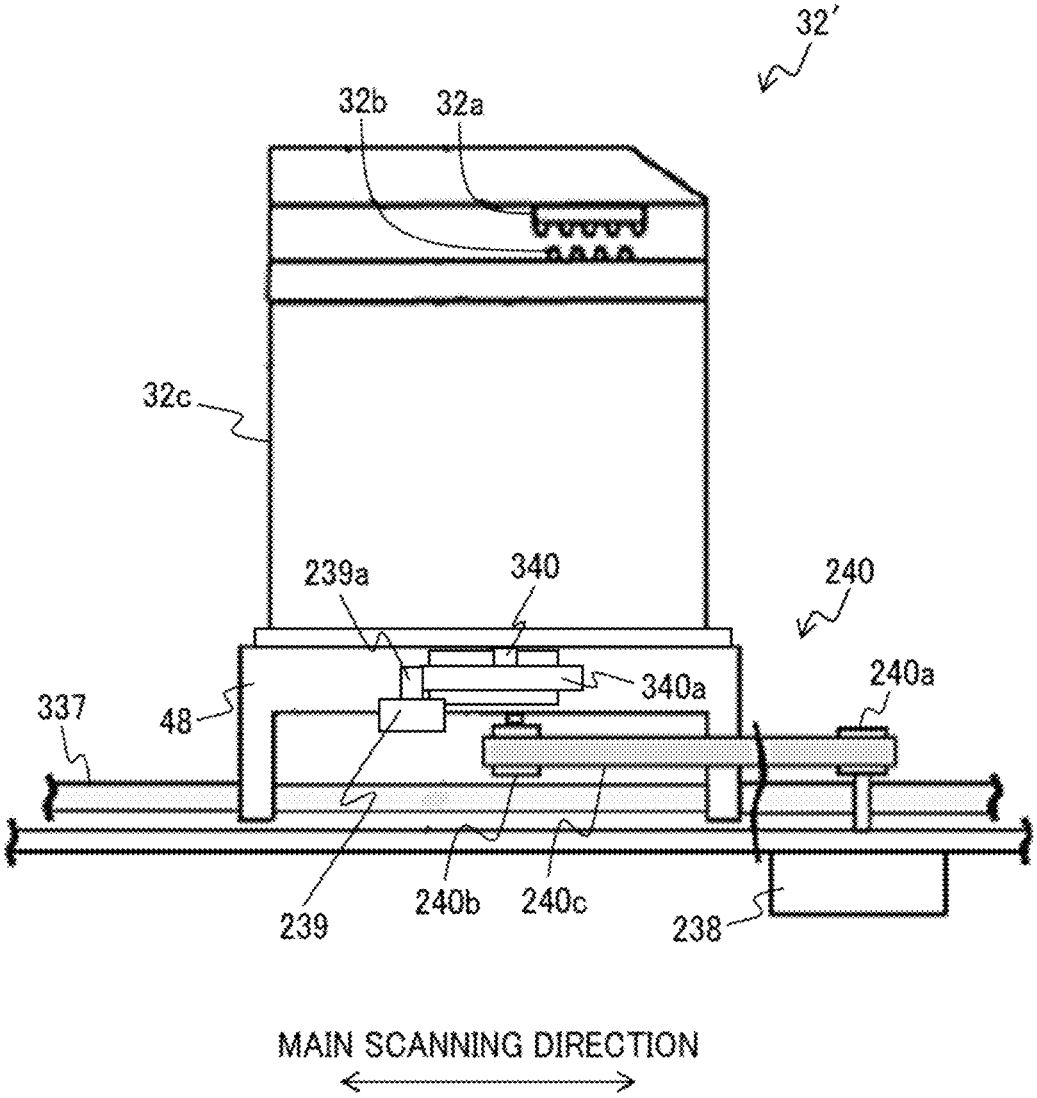
FIG. 22 is a schematic view of a downstream side of a crimper of the post-processing apparatus of FIG. 20 in a conveyance direction.

FIG. 22 is a schematic view of a downstream side of the crimper 32' in the conveyance direction.

As illustrated in FIGS. 21A to 21C, the crimper 32' and the stapling unit 156 are disposed downstream from the internal tray 22 in the conveyance direction. The crimper 32' is movable in the main scanning direction along the surface of the sheet bundle Pb placed on the internal tray 22. The crimper 32' is also rotatable in the forward and reverse directions about the crimper shaft 340 extending in the thickness direction of the sheet bundle Pb placed on the internal tray 22. Similarly, the stapling unit 156 is movable in the main scanning direction of the sheet bundle Pb and is rotatable in the forward and reverse directions about the stapler shaft 84 extending in the thickness direction of the sheet bundle Pb. Since the other configurations of the stapling unit 156 are like those of the stapling unit 155 (illustrated in FIG. 9) of the post-processing apparatus 3 according to the first embodiment, a detailed description thereof will be omitted unless otherwise required.

As illustrated in FIG. 22, the crimper 32' includes a guide rail 337 extending in the main scanning direction at a position downstream from the internal tray 22 in the conveyance direction. The crimper 32' is moved in the main scanning direction along the surface of the sheet bundle Pb placed on the internal tray 22, in other words, along the guide rail 337, by a driving force that is transmitted from a crimper movement motor 238 by a drive transmission assembly 240 including pullies 240*a* and 240*b* and a timing belt 240*c*. The crimper shaft 340 provided with a drive transmission gear 340*a* is fixed to a bottom face of the crimping frame 32*c* that holds the components of the crimper 32'. The crimper shaft 340 and the drive transmission gear 340*a* are held by the base 48 on which the crimping frame 32*c* is disposed, so as to be rotatable in the forward and reverse directions. The drive transmission gear 340*a* meshes with an output gear 239*a* of a crimper pivot motor 239. The crimper 32' is rotated in the forward and reverse directions on the base 48 about the crimper shaft 340 extending in the thickness direction of the sheet P placed on the internal tray 22, by a driving force transmitted from the crimper pivot motor 239 to the crimper shaft 340 via the output gear 239*a* and the drive transmission gear 340*a*. The guide rail 337, the crimper movement motor 238, the crimper pivot motor 239, the crimper shaft 340, and the drive transmission assembly 240 construct a driving assembly of the crimper 32'.

The crimper 32' is movable between the standby position HP as illustrated in FIG. 21A and a position where the crimper 32' faces the binding position B1 as illustrated in FIGS. 21B and 21C. The standby position HP is away in the main scanning direction from the sheet bundle Pb placed on the internal tray 22. For example, in FIGS. 21A to 21C, the standby position HP is distanced to the right of the sheet bundle Pb along the main scanning direction. The binding position B1 is a position on the sheet bundle Pb placed on the internal tray 22. However, the specific position of the binding position B1 is not limited to the position illustrated in FIGS. 21B and 21C. The binding position B1 may be one or more positions along the main scanning direction at the downstream end, in the conveyance direction, of the sheet P.

The posture of the crimper 32' changes between the parallel binding posture illustrated in FIG. 21B and the oblique binding posture illustrated in FIG. 21C. In other words, the crimper 32' is rotatable in the forward and reverse directions about the crimper shaft 340. The parallel binding posture is a posture of the crimper 32' in which the length of the upper crimping teeth 32*a* and the lower crimping teeth 32*b* (in other words, a rectangular crimp binding trace) is along the main scanning direction. The oblique binding posture is a posture of the crimper 32' in which the length of the upper crimping teeth 32*a* and the lower crimping teeth 32*b* (in other words, the rectangular crimp binding trace) is inclined with respect to the main scanning direction.

The rotational angle, which is an angle of the upper crimping teeth 32*a* and the lower crimping teeth 32*b* with respect to the main scanning direction, in the oblique binding posture is not limited to the angle illustrated in FIG. 21C. The rotational angle in the oblique binding posture may be any angle provided that the upper crimping teeth 32*a* and the lower crimping teeth 32*b* face the sheet bundle Pb placed on the internal tray 22.

Figure 28:
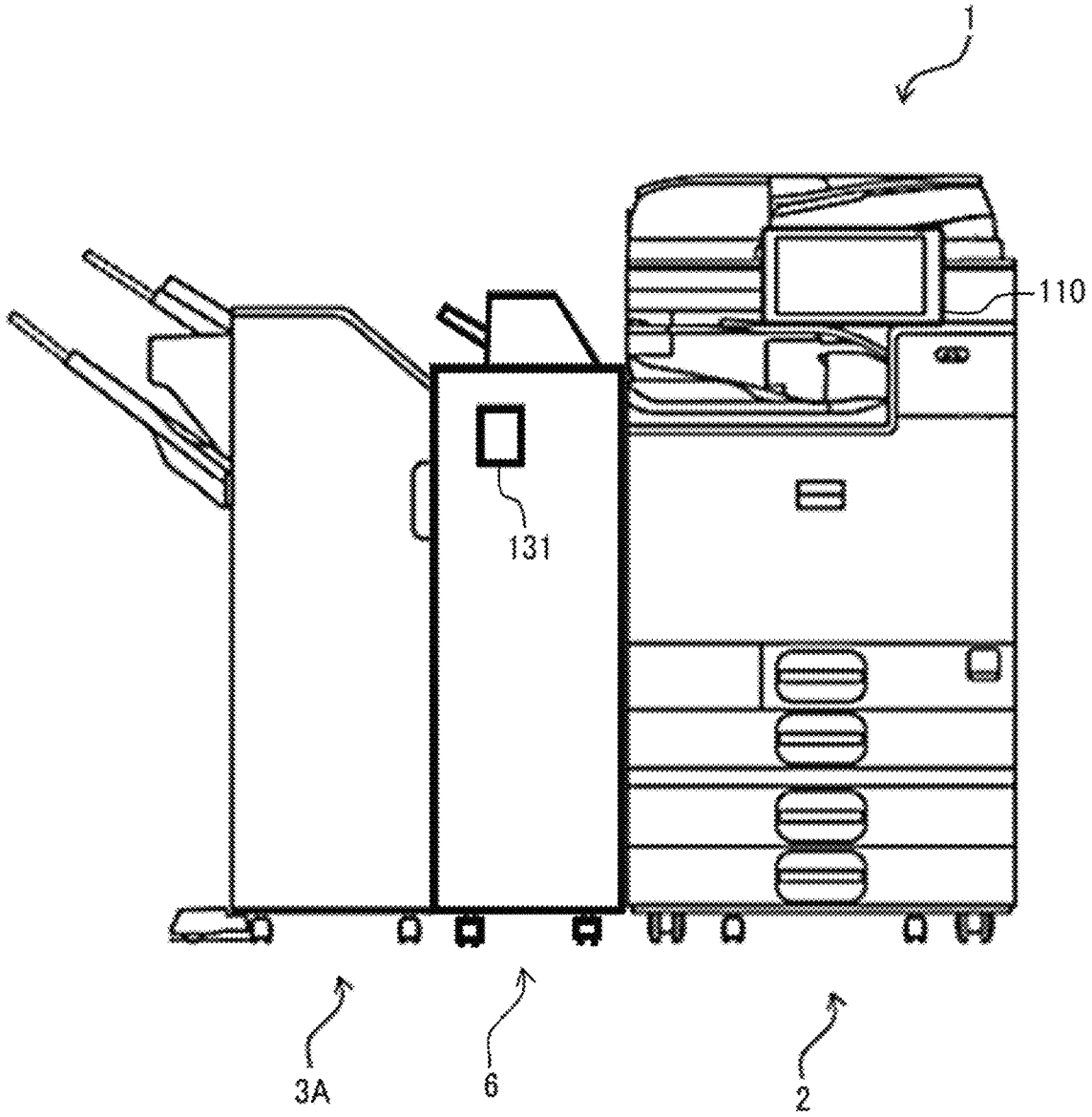
FIG. 28 is a diagram illustrating the overall configuration of an image forming system as a modification of the image forming system of FIG. 1.

The post-processing apparatus 3A includes the liquid applier 131 and a hole punch 132 serving as a processing device. The liquid applier 131 and the hole punch 132 are disposed upstream from the internal tray 22 in the opposite conveyance direction. In addition, the liquid applier 131 and the hole punch 132 are disposed at different positions in the opposite conveyance direction to simultaneously face one sheet P that is conveyed by the conveyance roller pairs 10 to 19. The liquid applier 131 and the hole punch 132 according to the present embodiment are disposed between the conveyance roller pairs 10 and 11. However, the arrangement of the liquid applier 131 and the hole punch 132 is not limited to the arrangement illustrated in FIG. 20. For example, in a case where an inserter 6 is disposed between the image forming apparatus 2 and the post-processing apparatus 3A as illustrated in FIG. 28, the liquid applier 131 may be disposed inside the inserter 6 located upstream from the post-processing apparatus 3A in a direction in which the sheet P is conveyed from the image forming apparatus 2 to the post-processing apparatus 3A. Examples of the inserter 6 include, but are not limited to, an apparatus that allows a pre-printed medium, which is to be conveyed to the post-processing apparatus 3A together with the sheet P conveyed from the image forming apparatus 2, to be fed as a cover sheet, an insertion sheet, or a partition sheet without passing through the image forming apparatus 2.

Figure 23A:
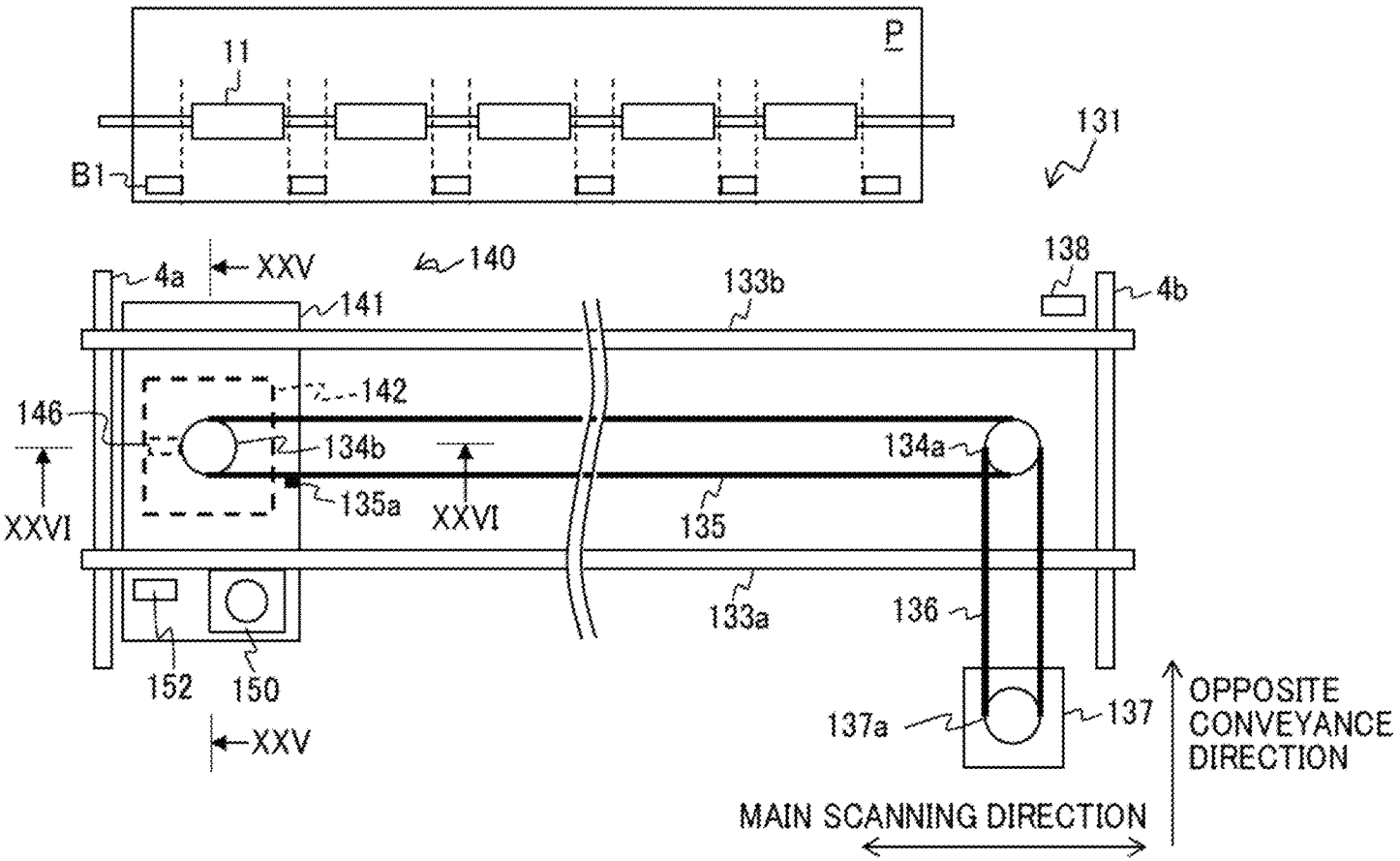
FIGS. 23A and 23B are views of a liquid applier of the post-processing apparatus of FIG. 20 in the thickness direction of the sheet.

As illustrated in FIG. 23A, the conveyance roller pair 11 is located so as not to overlap, in the main scanning direction, the liquid application position B1 on the sheet P to which the liquid is applied by a liquid application head 146 of the liquid applier 131. This is to prevent the amount of liquid at the liquid application position B1 from decreasing due to the plurality of roller pairs pressing the liquid application position B1 when the conveyance roller pair 11 conveys the sheet P. As a result, when the sheet P reaches the crimper 32' disposed downstream from the liquid applier 131 in the opposite conveyance direction, the amount of liquid at the liquid application position B1 is sufficient to maintain the binding strength. Accordingly, the binding strength of the sheet bundle Pb is prevented from decreasing due to a decrease in the amount of liquid at the liquid application position B1 (corresponding to the binding position B1) while the sheet P is conveyed.

In addition, the plurality of roller pairs of the conveyance roller pair 11 that is located so as not to overlap the liquid application position B1 on the sheet P in the main scanning direction prevents the conveying performance of the sheet P from being worse due to the adhesion of liquid to the plurality of roller pairs and further prevents a conveyance jam that may be caused by the worsened conveying performance of the sheet P.

Although only the conveyance roller pair 11 has been described above, the plurality of roller pairs of the conveyance roller pairs 14 and 15 are preferably located so as not to overlap the liquid application position B1 on the sheet P in the main scanning direction, like the plurality of roller pairs of the conveyance roller pair 11.

The liquid applier 131 applies liquid to the sheet P that is conveyed by the conveyance roller pairs 10 and 11. In the following description, the application of liquid may be referred to as "liquid application." The hole punch 132 punches a hole in the sheet P that is conveyed by the conveyance roller pairs 10 and 11 such that the hole penetrates the sheet P in the thickness direction of the sheet P. The processing device disposed near the liquid applier 131 is not limited to the hole punch 132. Alternatively, the processing device may be an inclination corrector that corrects an inclination or skew of the sheet P that is conveyed by the conveyance roller pairs 10 and 11.

Figure 23B:
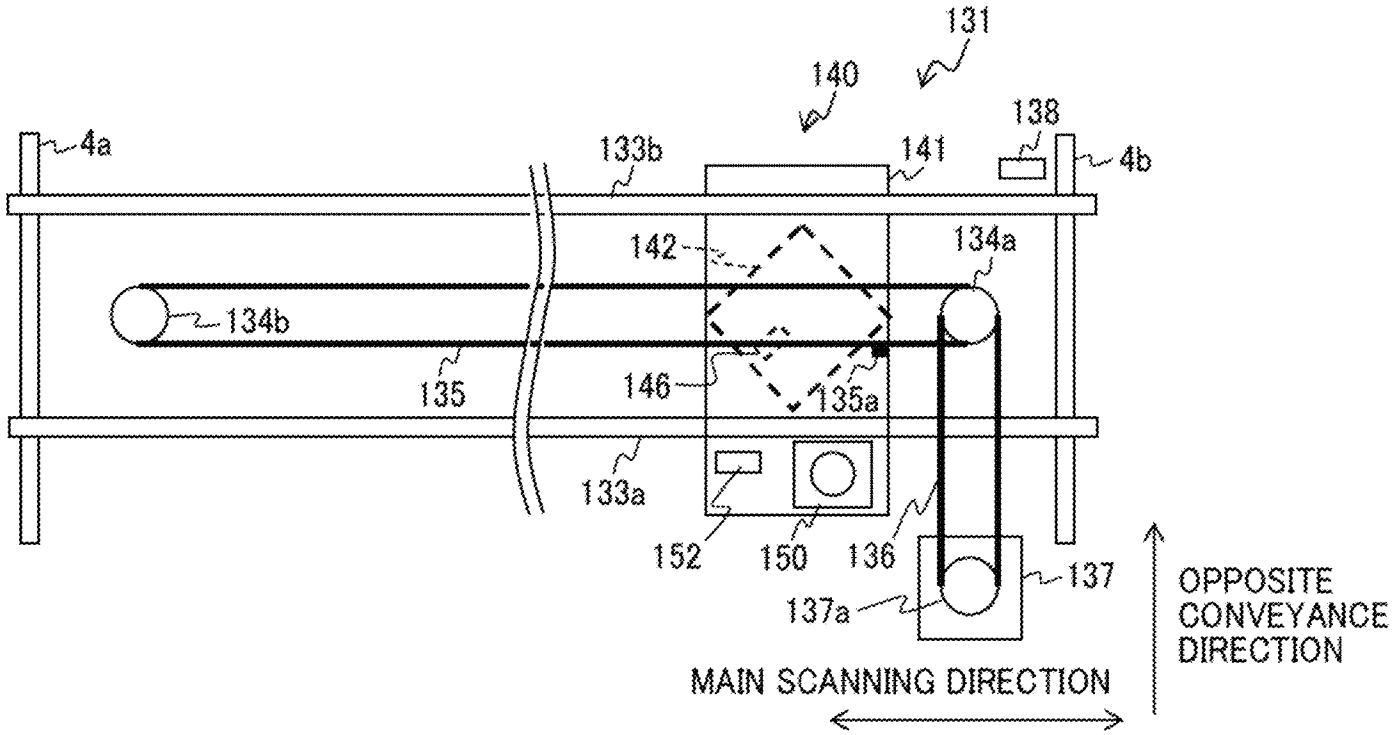

FIGS. 23A and 23B are views of the liquid applier 131 in the thickness direction of the sheet P, according to the second embodiment of the present disclosure.

Figure 24A:
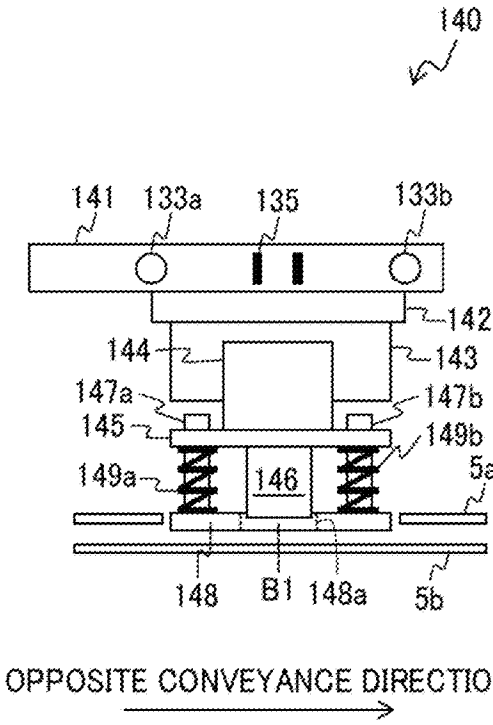
FIGS. 24A to 24C are cross-sectional views of a liquid application unit of the liquid applier taken through XXV-XXV of FIG. 23A.
Figure 24B:
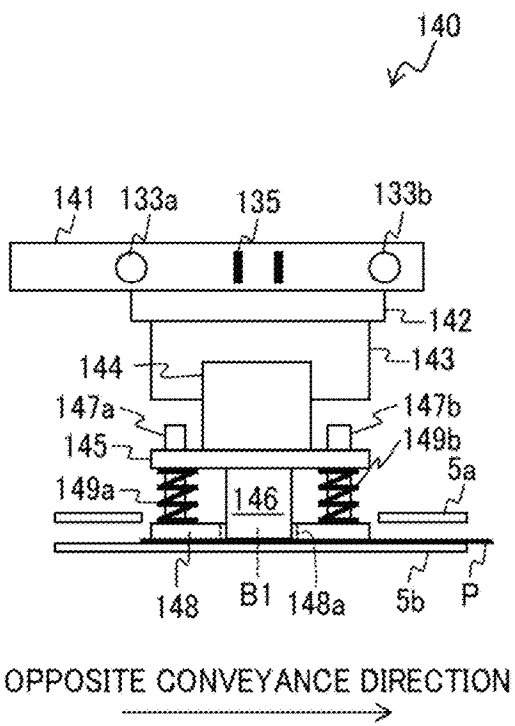
Figure 24C:
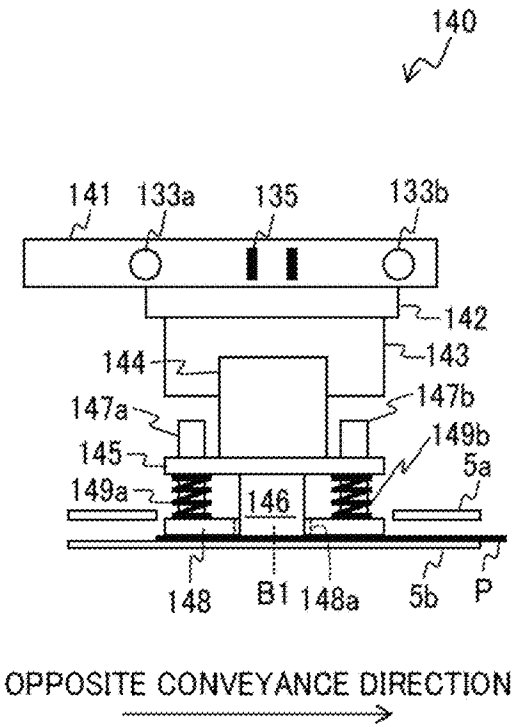

FIGS. 24A to 24C are cross-sectional views of a liquid application unit 140 of the liquid applier 131 taken through XXV-XXV of FIG. 23A.

Figure 25A:
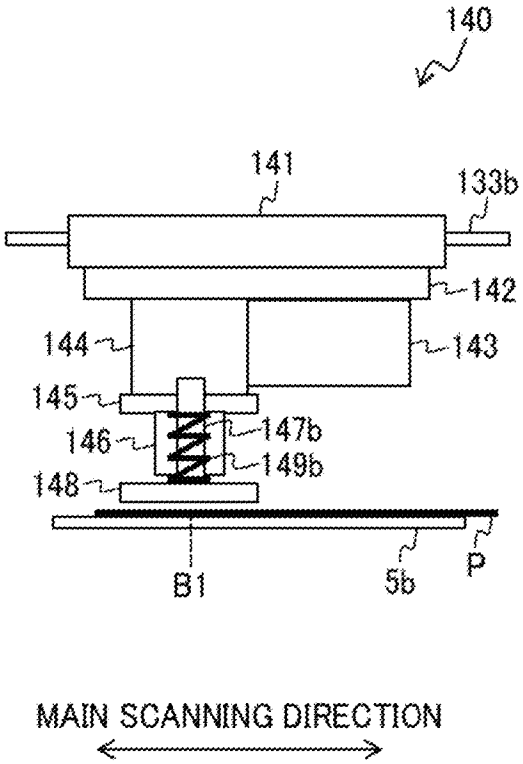
FIGS. 25A to 25C are cross-sectional views of the liquid application unit of the liquid applier taken through XXVI-XXVI of FIG. 23A.
Figure 25B:
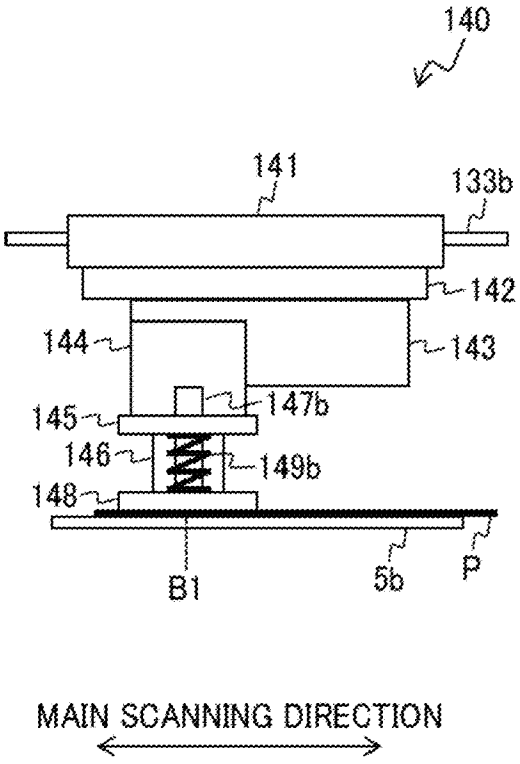
Figure 25C:
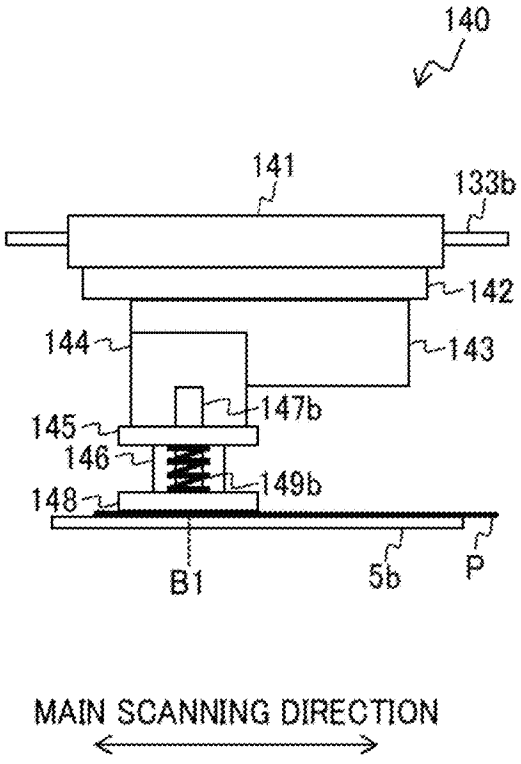

FIGS. 25A to 25C are cross-sectional views of the liquid application unit 140 of the liquid applier 131 taken through XXVI-XXVI of FIG. 23A.

Figure 26:
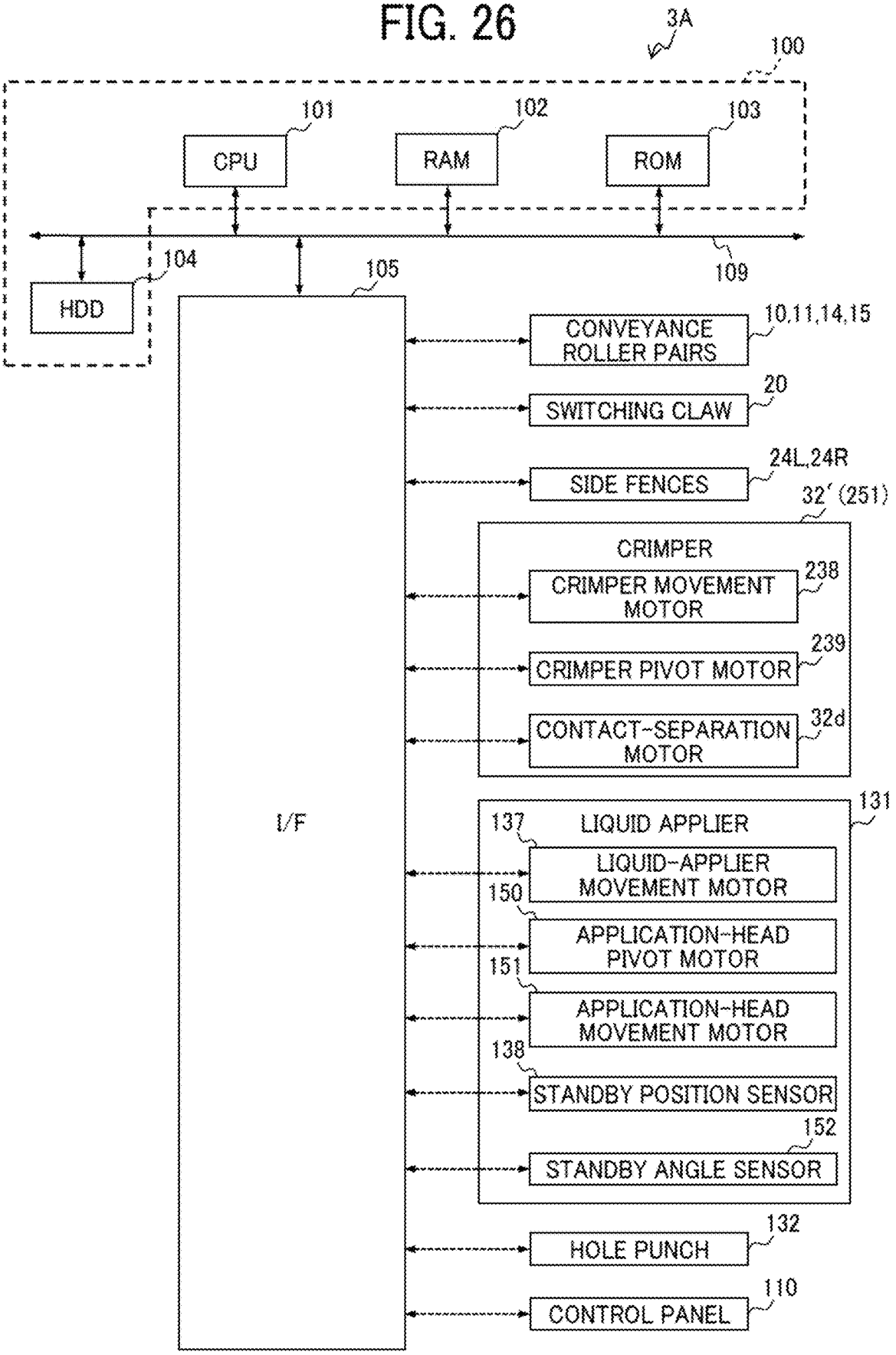
FIG. 26 is a block diagram illustrating a hardware configuration of the post-processing apparatus of FIG. 20.

As illustrated in FIGS. 23A to 25C, the liquid applier 131 includes a pair of guide shafts 133*a* and 133*b*, a pair of pulleys 134*a* and 134*b*, endless annular belts 135 and 136, a liquid-applier movement motor 137, a standby position sensor 138, which is also illustrated in FIG. 26, and the liquid application unit 140.

The guide shafts 133*a* and 133*b*, each extending in the main scanning direction, are apart from each other in the opposite conveyance direction. The pair of guide shafts 133*a* and 133*b* is supported by a pair of side plates 4*a* and 4*b* of the post-processing apparatus 3A. On the other hand, the pair of guide shafts 133*a* and 133*b* supports the liquid application unit 140 such that the liquid application unit 140 can move in the main scanning direction.

The pair of pulleys 134*a* and 134*b* is disposed between the guide shafts 133*a* and 133*b* in the opposite conveyance direction. On the other hand, the pulleys 134*a* and 134*b* are apart from each other in the main scanning direction. The pulleys 134*a* and 134*b* are supported by a frame of the post-processing apparatus 3A so as to be rotatable in the forward and reverse directions about the respective shafts extending in the thickness direction of the sheet P.

The endless annular belt 135 is entrained around the pair of pulleys 134*a* and 134*b*. The endless annular belt 135 is coupled to the liquid application unit 140 by a connection 135*a*. The endless annular belt 136 is entrained around the pulley 134*a* and a driving pulley 137*a* that is fixed to an output shaft of the liquid-applier movement motor 137. The liquid-applier movement motor 137 generates a driving force to move the liquid application unit 140 in the main scanning direction.

As the liquid-applier movement motor 137 rotates, the endless annular belt 136 circulates around the pulley 134*a* and the driving pulley 137*a* to rotate the pulley 134*a*. As the pulley 134*a* rotates, the endless annular belt 135 circulates around the pair of pulleys 134*a* and 134*b*. As a result, the liquid application unit 140 moves in the main scanning direction along the pair of guide shafts 133*a* and 133*b*. The liquid application unit 140 reciprocates in the main scanning direction in response to the rotation direction of the liquid-applier movement motor 137 being switched.

The standby position sensor 138 detects the arrival of the liquid application unit 140 at a standby position in the main scanning direction. The standby position sensor 138 then outputs a standby position signal indicating the detection result to the controller 100 as circuitry, which will be described below with reference to FIG. 26. The standby position sensor 138 is, for example, an optical sensor including a light emitting unit and a light receiving unit. The liquid application unit 140 at the standby position blocks an optical path between the light emitting unit and the light receiving unit. Then, the standby position sensor 138 outputs the standby position signal in response to the light output from the light emitting unit not being received by the light receiving unit. The specific configuration of the standby position sensor 138 is not limited to the configuration described above.

As illustrated in FIGS. 24A to 24C, the conveyance passage inside the post-processing apparatus 3A is defined by an upper guide plate 5*a* and a lower guide plate 5*b*, which are apart from each other in the thickness direction of the sheet P. The liquid application unit 140 is located to face an opening of the upper guide plate 5*a*. In other words, the liquid application unit 140 faces the conveyance passage through the opening of the upper guide plate 5*a* to face the sheet P conveyed along the conveyance passage.

As illustrated in FIGS. 23A to 25C, the liquid application unit 140 includes a base 141, a rotary bracket 142, a liquid storage tank 143, a mover 144, a holder 145, the liquid application head 146, columns 147*a* and 147*b*, a pressure plate 148, coil springs 149*a* and 149*b*, an application-head pivot motor 150, an application-head movement motor 151 illustrated in FIG. 26, and a standby angle sensor 152, which is also illustrated in FIG. 26.

The base 141 is supported by the pair of guide shafts 133*a* and 133*b* so as to be slidable in the main scanning direction. The base 141 is coupled to the endless annular belt 135 by the connection 135*a*. On the other hand, the base 141 supports the components of the liquid application unit 140 such as the rotary bracket 142, the liquid storage tank 143, the mover 144, the holder 145, the liquid application head 146, the columns 147*a* and 147*b*, the pressure plate 148, the coil springs 149*a* and 149*b*, the application-head pivot motor 150, the application-head movement motor 151, and the standby angle sensor 152.

The rotary bracket 142 is attached to a lower face of the base 141 so as to be rotatable in the forward and reverse directions about a shaft extending in the thickness direction of the sheet P. The rotary bracket 142 is rotated in the forward and reverse directions with respect to the base 141 by a driving force transmitted from the application-head pivot motor 150. On the other hand, the rotary bracket 142 holds the liquid storage tank 143, the mover 144, the holder 145, the liquid application head 146, the columns 147*a* and 147*b*, the pressure plate 148, and the coil springs 149*a* and 149*b*.

The standby angle sensor 152, which is illustrated in FIG. 26, detects that the rotary bracket 142 has reached a standby angle. The standby angle sensor 152 then outputs a standby angle signal indicating the detection result to the controller 100. The standby angle is, for example, an angle for the parallel binding. The standby angle sensor 152 is, for example, an optical sensor including a light emitting unit and a light receiving unit. The rotary bracket 142 at the standby angle blocks an optical path between the light emitting unit and the light receiving unit. Then, the standby angle sensor 152 outputs the standby angle signal in response to the light output from the light emitting unit not being received by the light receiving unit. The specific configuration of the standby angle sensor 152 is not limited to the configuration described above.

Note that FIG. 23A illustrates the rotary bracket 142 in a position for the parallel binding that is performed by the crimper 32' disposed downstream from the liquid applier 131 in a direction in which the sheet P is conveyed. FIG. 23B illustrates the rotary bracket 142 in a position for the oblique binding (i.e., corner binding) that is performed by the crimper 32' disposed downstream from the liquid applier 131 in the direction in which the sheet P is conveyed.

The liquid storage tank 143 stores liquid to be applied to the sheet P. The mover 144 is attached to the liquid storage tank 143 so as to be movable (for example, up and down) in the thickness direction of the sheet P. The mover 144 is moved with respect to the liquid storage tank 143 by a driving force transmitted from the application-head movement motor 151. The holder 145 is attached to a lower end of the mover 144. The liquid application head 146 projects from the holder 145 toward the conveyance passage (downward in the present embodiment). The liquid that is stored in the liquid storage tank 143 is supplied to the liquid application head 146. The liquid application head 146 is made of a material having a relatively high liquid absorption (for example, sponge or fiber).

The columns 147*a* and 147*b* project downward from the holder 145 around the liquid application head 146. The columns 147*a* and 147*b* are movable relative to the holder 145 in the thickness direction. The columns 147*a* and 147*b* have respective lower ends holding the pressure plate 148. The pressure plate 148 has a through hole 148*a* at a position where the through hole 148*a* faces the liquid application head 146. The coil springs 149*a* and 149*b* are fitted around the columns 147*a* and 147*b*, respectively, between the holder 145 and the pressure plate 148. The coil springs 149*a* and 149*b* bias the columns 147*a* and 147*b* and the pressure plate 148 in a direction away from the holder 145.

As illustrated in FIGS. 24A and 25A, before the sheet P is conveyed to a position where the sheet P faces the opening of the upper guide plate 5*a*, the pressure plate 148 is positioned at or above the opening. Subsequently, when the sheet P that is conveyed by the conveyance roller pairs 10 and 11 stops at a position where the liquid application position B1 on the sheet P faces the opening, the application-head movement motor 151 is rotated in a first direction. As a result, the mover 144, the holder 145, the liquid application head 146, the columns 147*a* and 147*b*, the pressure plate 148, and the coil springs 149*a* and 149*b* are moved down together to allow the pressure plate 148 to contact the sheet P. Note that the liquid application position B1 corresponds to the binding position B1 to be crimped and bound by the edge binder 251, specifically, the crimper 32'.

As the application-head movement motor 151 keeps rotating in the first direction after the pressure plate 148 contacts the sheet P, the coil springs 149*a* and 149*b* are compressed to further move down the mover 144, the holder 145, the liquid application head 146, and the columns 147*a* and 147*b*. As a result, as illustrated in FIGS. 24B and 25B, a lower face of the liquid application head 146 contacts the sheet P through the through hole 148*a*. Then, the liquid contained in the liquid application head 146 is applied to the sheet P.

Further rotation of the application-head movement motor 151 in the first direction further strongly presses the liquid application head 146 against the sheet P as illustrated in FIGS. 24C and 25C. Accordingly, an increased amount of liquid is applied to the sheet P. In other words, the liquid applier 131 changes the pressing force of the liquid application head 146 against the sheet P to adjust the amount of liquid to be applied to the sheet P.

On the other hand, the rotation of the application-head movement motor 151 in a second direction opposite to the first direction moves up the mover 144, the holder 145, the liquid application head 146, the columns 147*a* and 147*b*, the pressure plate 148, and the coil springs 149*a* and 149*b* together. As a result, as illustrated in FIGS. 24A and 25A, the liquid application head 146 and the pressure plate 148 are separated from the sheet P. In other words, the liquid applier 131 includes the liquid application head 146 that can be separated from the sheet P.

FIG. 26 is a block diagram illustrating a hardware configuration of the post-processing apparatus 3A to control the operation of the post-processing apparatus 3A according to the second embodiment of the present disclosure.

As illustrated in FIG. 26, the post-processing apparatus 3A includes the CPU 101, the RAM 102, the ROM 103, the HDD 104, and the I/F 105. The CPU 101, the RAM 102, the ROM 103, the HDD 104, and the I/F 105 are connected to each other via the common bus 109.

The CPU 101 is an arithmetic unit and controls the overall operation of the post-processing apparatus 3A. The RAM 102 is a volatile storage medium that allows data to be read and written at high speed. The CPU 101 uses the RAM 102 as a work area for data processing. The ROM 103 is a read-only non-volatile storage medium that stores programs such as firmware. The HDD 104 is a non-volatile storage medium that allows data to be read and written and has a relatively large storage capacity. The HDD 104 stores, for example, an OS, various control programs, and application programs.

By an arithmetic function of the CPU 101, the post-processing apparatus 3A processes, for example, a control program stored in the ROM 103 and an information processing program (application program) loaded into the RAM 102 from a storage medium such as the HDD 104. Such processing configures a software controller including various functional modules of the post-processing apparatus 3A. The software controller that is thus configured cooperates with hardware resources of the post-processing apparatus 3A to construct functional blocks that implement functions of the post-processing apparatus 3A. In other words, the CPU 101, the RAM 102, the ROM 103, and the HDD 104 construct the controller 100 that controls the operation of the post-processing apparatus 3A.

The I/F 105 is an interface that connects the conveyance roller pairs 10, 11, 14, and the switching claw 20, the side fences 24L and 24R, the crimper movement motor 238, the crimper pivot motor 239, the contact-separation motor 32*d*, the liquid-applier movement motor 137, the application-head pivot motor 150, the application-head movement motor 151, the standby position sensor 138, the standby angle sensor 152, the hole punch 132, and the control panel 110 to the common bus 109. The controller 100 controls, via the I/F 105, the operations of the conveyance roller pairs 10, 11, 14, and 15, the switching claw 20, the side fences 24L and 24R, the crimper movement motor 238, the crimper pivot motor 239, the contact-separation motor 32*d*, the liquid-applier movement motor 137, the application-head pivot motor 150, the application-head movement motor 151, and the hole punch 132.

On the other hand, the controller 100 acquires, via the I/F 105, detection results from the standby position sensor 138 and the standby angle sensor 152. Although FIG. 26 mainly illustrates the components of the liquid applier 131 and the edge binder 251 (the crimper 32') that executes the edge binding, the components of the saddle binder 28 that executes the saddle binding are controlled by the controller 100 like the components of the liquid applier 131 and the edge binder 251 (the crimper 32') that executes the edge binding.

The control panel 110 includes an operation unit that receives instructions input by an operator and a display serving as a notifier that notifies the operator of information. Thus, the control panel 110 serves as an input device. The operation unit includes, for example, hard keys and a touch panel superimposed on a display. The control panel 110 acquires information from the operator through the operation unit and provides information to the operator through the display.

Figure 27:
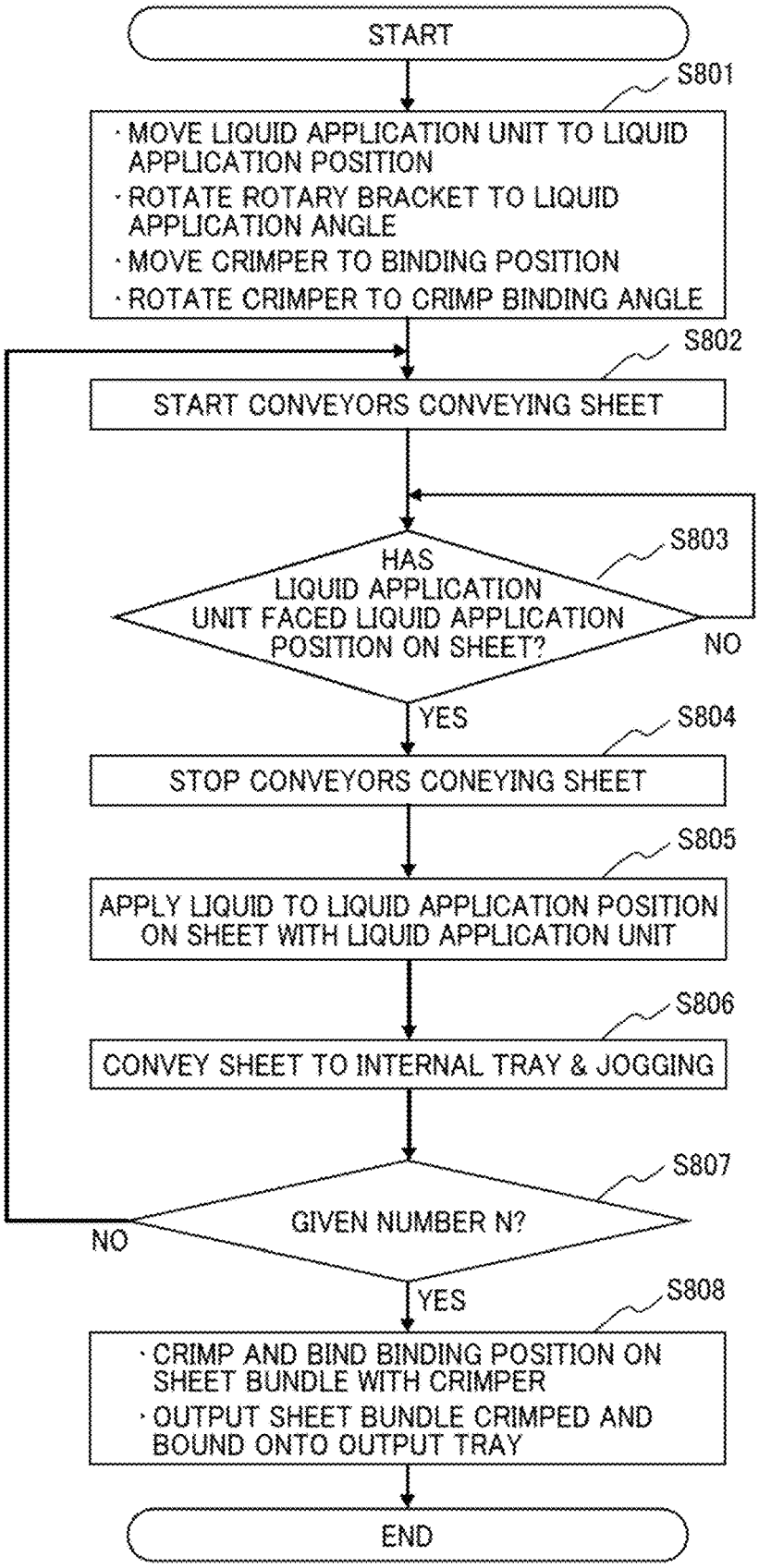
FIG. 27 is a flowchart of post-processing performed by the post-processing apparatus of FIG. 20.

FIG. 27 is a flowchart of post-processing performed by the post-processing apparatus 3A according to the second embodiment. Specifically, FIG. 27 is a flowchart of a process to execute the one-point binding illustrated in FIGS. 21A to 21C.

For example, the controller 100 executes the post-processing illustrated in FIG. 27 when the controller 100 acquires an instruction to execute the post-processing from the image forming apparatus 2. In the following description, the instruction to execute the post-processing may be referred to as a "post-processing command." The post-processing command includes, for example, the number of sheets P of the sheet bundle Pb, the number of sheet bundles Pb to be bound, the binding position B1 (corresponding to the liquid application position B1), the angle at the binding position B1 (corresponding to an angle at the liquid application position B1), the type of binding (for example, the parallel binding or the oblique binding), and the process that is executed in parallel with the liquid application process (i.e., punching a hole in the present embodiment). In the following description, the number of sheets P of the sheet bundle Pb may be referred to as "given number N" whereas the number of sheet bundles Pb to be bound may be referred to as "requested number of copies." Note that, at the start of the post-processing, the liquid application unit 140 is at the standby position HP (corresponding to the standby position HP illustrated in FIGS. 21A to 21C) whereas the rotary bracket 142 is held at the standby angle (corresponding to the "parallel binding posture").

First, in step S801, the controller 100 drives the liquid-applier movement motor 137 to move the liquid application unit 140 (corresponding to the liquid applier) in the main scanning direction such that liquid application head 146 moves from the standby position HP to a position where the liquid application head 146 can face the liquid application position B1 (corresponding to the binding position B1 illustrated in FIGS. 21B and 21C). When the type of binding that is instructed by the post-processing command is the "oblique binding," in step S801, the controller 100 also drives the application-head pivot motor 150 to rotate the rotary bracket 142 such that the liquid application head 146 rotates from the standby angle to a liquid application angle corresponding to the "oblique binding posture." It is ascertained based on a pulse signal output from a rotary encoder of the liquid-applier movement motor 137 that the liquid application head 146 has reached the position where the liquid application head 146 can face the liquid application position B1. Similarly, it is ascertained based on a pulse signal output from a rotary encoder of the application-head pivot motor 150 that the liquid application head 146 has reached the liquid application angle. When the type of binding that is instructed by the post-processing command is the "parallel binding," the controller 100 omits the aforementioned operation of rotating the rotary bracket 142. In other words, the liquid application unit 140 moves in the main scanning direction while holding the rotary bracket 142 at the standby angle.

In step S801, the controller 100 also drives the crimper movement motor 238 to move the crimper 32' from the standby position HP to the position where the crimper 32' can face the binding position B1 as illustrated in FIGS. 21A and 21B. When the type of binding that is instructed by the post-processing command is the "oblique binding," in step S801, the controller 100 also drives the crimper pivot motor 239 to rotate the crimper 32' from the standby angle to a crimp binding angle corresponding to the "oblique binding posture." It is ascertained based on a pulse signal output from a rotary encoder of the crimper movement motor 238 that the crimper 32' has reached the position where the crimper 32' can face the binding position B1. Similarly, it is ascertained based on a pulse signal output from a rotary encoder of the crimper pivot motor 239 that the crimper 32' has reached the crimp binding angle. When the type of binding that is instructed by the post-processing command is the "parallel binding," the controller 100 omits the aforementioned operation of rotating the crimper 32'. In other words, the crimper 32' moves in the main scanning direction while maintaining the standby angle.

Subsequently, in step S802, the controller 100 drives the conveyance roller pairs 10 and 11 to start conveying the sheet P on which an image is formed by the image forming apparatus 2.

In step S803, the controller 100 determines whether the liquid application position B1 on the sheet P has faced the liquid application unit 140 (more specifically, the liquid application head 146). In other words, the controller 100 determines whether the liquid application unit 140 has faced the liquid application position B1 on the sheet P.

When the liquid application position B1 on the sheet P has not faced the liquid application head 146 (NO in step S803), the controller 100 repeats the determination in step S803. In other words, the controller 100 continues driving the conveyance roller pairs 10 and 11 until the liquid application position B1 on the sheet P faces the liquid application head 146.

By contrast, when the liquid application position B1 on the sheet P has faced the liquid application head 146 (YES in step S803), in step S804, the controller 100 stops the conveyance roller pairs 10 and 11. It is ascertained based on a pulse signal output from a rotary encoder of a motor that drives the conveyance roller pairs 10 and 11 that the liquid application position B1 on the sheet P has faced the liquid application head 146.

In step S805, the controller 100 causes the liquid application unit 140 to execute the process to apply liquid to the liquid application position B1 on the sheet P. More specifically, the controller 100 rotates the application-head movement motor 151 in the first direction to bring the liquid application head 146 into contact with the liquid application position B1 on the sheet P. The controller 100 changes the pressing force of the liquid application head 146 (in other words, the amount of rotation of the application-head movement motor 151) depending on the amount of liquid to be applied to the sheet P.

The amount of liquid to be applied to the sheet P may be the same for all the sheets P of the sheet bundle Pb or may be different for each sheet P. For example, the controller 100 may apply a decreased amount of liquid to the sheet P conveyed later. The amount of rotation of the application-head movement motor 151 may be ascertained based on a pulse signal output from a rotary encoder of the application-head movement motor 151.

Subsequently, in step S806, the controller 100 drives the conveyance roller pairs 10, 11, 14, and 15 to place the sheet P on the internal tray 22. In step S806, the controller 100 also moves the side fences 24L and 24R to align the position, in the main scanning direction, of the sheet P or the sheet bundle Pb placed on the internal tray 22. In short, the controller 100 performs so-called jogging.

Subsequently, in step S807, the controller 100 determines whether the number of sheets P placed on the internal tray 22 has reached the given number N instructed by the post-processing command.

When the controller 100 determines that the number of sheets P placed on the internal tray 22 has not reached the given number N (NO in step S807), the controller 100 executes the operations of steps S802 to S806 again.

By contrast, when the controller 100 determines that the number of sheets P placed on the internal tray 22 has reached the given number N (YES in step S807), in step S808, the controller 100 causes the crimper 32' to crimp and bind the binding position B1 (corresponding to the liquid application position B1) on the sheet bundle Pb to which the liquid has been applied by the liquid application unit 140. In step S808, the controller 100 also rotates the conveyance roller pair 15 to output the sheet bundle Pb thus crimped and bound to the output tray 26.

Then, the controller 100 drives the liquid-applier movement motor 137 to move the liquid application unit 140 to the standby position HP and drives the crimper movement motor 238 to move the crimper 32' to the standby position HP.

When the post-processing command includes an instruction to form a plurality of sheet bundles Pb (i.e., the requested number of copies), the controller 100 determines whether the number of sheet bundles Pb output to the output tray 26 has reached the requested number of copies as in step S1308 in FIG. 12. When the controller 100 determines that the number of the sheet bundles Pb output to the output tray 26 has not reached the requested number of copies, the controller 100 repeats the operations of steps S802 to S808. By contrast, when the controller 100 determines that the number of sheet bundles Pb output to the output tray 26 has reached the requested number of copies, the controller 100 moves the liquid application unit 140 and the crimper 32' to the standby position HP as described above.

The control method described above may be implemented by, for example, a program. In other words, the control method may be executed by a computer causing an arithmetic device, a storage device, an input device, an output device, and a control device to operate in cooperation with each other based on a program. The program may be written in, for example, a storage device or a storage medium and distributed. Alternatively, the program may be distributed through, for example, an electric communication line.

Now, a description is given of some aspects of the present disclosure.

According to a first aspect, a medium processing apparatus includes a liquid applier, a post-processing device, and circuitry. The liquid applier applies liquid to a part of a medium, which is at least one medium. The post-processing device binds a bundle of media including the medium to which the liquid is applied by the liquid applier. The circuitry controls operations of the liquid applier and the post-processing device. The circuitry causes the liquid applier to apply different amounts of liquid to a plurality of sample areas in the medium.

According to a second aspect, the medium processing apparatus according to the first aspect further includes an input device that receives an input of an amount of liquid to be applied. The circuitry causes the liquid applier to apply the liquid to a liquid application position on the medium by the amount input through the input device. The circuitry causes the post-processing device to bind a binding position on the bundle of media. The binding position on the bundle of media includes the liquid application position on each of a plurality of media including the medium.

According to a third aspect, in the medium processing apparatus of the second aspect, the input device receives an input of a plurality of liquid application levels indicating different amounts of liquid to be applied and an input of an amount of liquid to be applied corresponding to each of the plurality of liquid application levels. The circuitry causes the liquid applier to apply the liquid to the liquid application position on the medium by the amount corresponding to one of the plurality of liquid application levels received by the input device.

According to a fourth aspect, in the medium processing apparatus of the second or third aspect, the input device receives an input of a liquid application level corresponding to a type of the medium of a plurality of liquid application levels indicating different amounts of liquid to be applied. The circuitry causes the liquid applier to apply the liquid to the liquid application position on the medium by the amount corresponding to the liquid application level received by the input device.

According to a fifth aspect, in the medium processing apparatus of any one of the second to fourth aspects, the amount of liquid to be applied corresponding to each of the plurality of liquid application levels is manually set via the input device.

According to a sixth aspect, the medium processing apparatus of any one of the first to fifth aspects includes an input device that receives an input of an amount of liquid to be applied. The circuitry causes the liquid applier to apply the liquid to each of the plurality of sample areas by an amount corresponding to a corresponding one of a plurality of liquid application levels. The circuitry decreases the amount of liquid corresponding to each of the plurality of liquid application levels by a first amount in response to an input, through the input device, indicating that a sample area of the plurality of sample areas corresponding to a liquid application level less than a predetermined reference level of the plurality of liquid application levels is wet. The circuitry increases the amount of liquid corresponding to each of the plurality of liquid application levels by a second amount in response to an input, through the input device, indicating that a sample area of the plurality of sample areas corresponding to a liquid application level greater than the predetermined reference level of the plurality of liquid application levels is not wet.

According to a seventh aspect, an image forming system includes an image forming apparatus and the medium processing apparatus according to any one of the first to sixth aspects. The image forming apparatus forms an image on a medium. The circuitry of the medium processing apparatus causes the liquid applier to apply the different amounts of liquid to the plurality of sample areas in the medium on which the image is formed by the image forming apparatus.

According to an eighth aspect, in the image forming system of the seventh aspect, the image forming apparatus forms the image on the medium to specify a position of each of the plurality of sample areas.

According to a ninth aspect, in the image forming system of the seventh or eighth aspect, the image forming apparatus forms the image on the medium to specify the different amounts of liquid to be applied to the plurality of sample areas.

According to one aspect of the present disclosure, a medium processing apparatus that performs the crimp binding after applying liquid to the binding position appropriately corrects a change in the amount of liquid to be applied due to product variation or aging of the medium processing apparatus.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. It is therefore to be understood that the disclosure of this patent specification may be practiced otherwise by those skilled in the art than as specifically described herein and such modifications and alternatives are within the technical scope of the appended claims.

Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. A medium processing apparatus comprising:

a liquid applier configured to apply liquid to a part of a medium, the medium being at least one medium;

a post-processing device configured to bind a bundle of media including the medium to which the liquid is applied by the liquid applier; and circuitry configured to control operations of the liquid applier and the post-processing device, the circuitry being configured to cause the liquid applier to apply different amounts of liquid to a plurality of sample areas in the medium.

2. The medium processing apparatus according to claim 1, further comprising an input device configured to receive an input of an amount of liquid to be applied, wherein the circuitry is configured to cause:

the liquid applier to apply the liquid to a liquid application position on the medium by the amount input through the input device; and the post-processing device to bind a binding position on the bundle of media, the binding position on the bundle of media including the liquid application position on each of a plurality of media including the medium.

3. The medium processing apparatus according to claim 2, wherein the input device is configured to receive:

an input of a plurality of liquid application levels indicating different amounts of liquid to be applied; and an input of an amount of liquid to be applied corresponding to each of the plurality of liquid application levels, and wherein the circuitry is configured to cause the liquid applier to apply the liquid to the liquid application position on the medium by the amount corresponding to one of the plurality of liquid application levels received by the input device.

4. The medium processing apparatus according to claim 2, wherein the input device is configured to receive an input of a liquid application level corresponding to a type of the medium of a plurality of liquid application levels indicating different amounts of liquid to be applied, and wherein the circuitry is configured to cause the liquid applier to apply the liquid to the liquid application position on the medium by the amount corresponding to the liquid application level received by the input device.

5. The medium processing apparatus according to claim 3, wherein the amount of liquid to be applied corresponding to each of the plurality of liquid application levels is manually set via the input device.

6. The medium processing apparatus according to claim 1, further comprising an input device configured to receive an input of an amount of liquid to be applied, wherein the circuitry is configured to:

cause the liquid applier to apply the liquid to each of the plurality of sample areas by an amount corresponding to a corresponding one of a plurality of liquid application levels;

decrease the amount of liquid corresponding to each of the plurality of liquid application levels by a first amount in response to an input, through the input device, indicating that a sample area of the plurality of sample areas corresponding to a liquid application level less than a predetermined reference level of the plurality of liquid application levels is wet; and increase the amount of liquid corresponding to each of the plurality of liquid application levels by a second amount in response to an input, through the input device, indicating that a sample area of the plurality of sample areas corresponding to a liquid application level greater than the predetermined reference level of the plurality of liquid application levels is not wet.

7. An image forming system comprising:

an image forming apparatus configured to form an image on a medium; and the medium processing apparatus according to claim 1, the circuitry of the medium processing apparatus being configured to cause the liquid applier to apply the different amounts of liquid to the plurality of sample areas in the medium on which the image is formed by the image forming apparatus.

8. The image forming system according to claim 7, wherein the image forming apparatus is configured to form the image on the medium to specify a position of each of the plurality of sample areas.

9. The image forming system according to claim 7, wherein the image forming apparatus is configured to form the image on the medium to specify the different amounts of liquid to be applied to the plurality of sample areas.

* * * * *